US012492516B2

(12) United States Patent
Mason et al.

(10) Patent No.: US 12,492,516 B2
(45) Date of Patent: Dec. 9, 2025

(54) ARMOURED JOINT-DISRUPTIVE FOLDED ANCHOR RAIL

(71) Applicant: Illinois Tool Works Inc., Glenview, IL (US)

(72) Inventors: Greg Stephen Mason, Brisbane (AU); Ryan Rogers, Brisbane (AU)

(73) Assignee: Illinois Tool Works Inc., Glenview, IL (US)

( * ) Notice: Subject to any disclaimer, the term of this patent is extended or adjusted under 35 U.S.C. 154(b) by 519 days.

(21) Appl. No.: 17/862,895

(22) Filed: Jul. 12, 2022

(65) Prior Publication Data

US 2023/0020378 A1 Jan. 19, 2023

(30) Foreign Application Priority Data

Jul. 12, 2021 (AU) ..... 2021204992

(51) Int. Cl.
*E01C 11/10* (2006.01)
*E01C 11/04* (2006.01)
(Continued)

(52) U.S. Cl.
CPC ..... *E01C 11/106* (2013.01); *E01C 11/04* (2013.01); *E04B 1/6807* (2013.01); *E04B 2005/322* (2013.01)

(58) Field of Classification Search
CPC .. E04B 1/483; E04B 1/6807; E04B 2005/322; E04B 2005/324; E04B 1/6804;
(Continued)

(56) References Cited

U.S. PATENT DOCUMENTS 2,094,853 A 10/1937 Shaw
2,181,005 A 11/1939 Westcott
(Continued)

FOREIGN PATENT DOCUMENTS

CA 2712305 7/2009
CN 206205381 U 5/2017
(Continued)

OTHER PUBLICATIONS

Diamond Dowel® System Tapered Plate Dowels for Formed Construction Joints brochure , PNA Construction Technologies, available Nov. 19, 2018 (2 pages).
(Continued)

*Primary Examiner* — Andrew J Triggs
(74) *Attorney, Agent, or Firm* — Neal, Gerber & Eisenberg LLP

(57) ABSTRACT

An armoured joint for protecting an edge of a first component formed of settable material and an edge of a second component formed of settable material at a joint, wherein the apparatus includes a first anchorage part for anchoring within the first component and a second anchorage part for anchoring within the second component, a first plate coupled to the first anchorage part, a second plate coupled to the second anchorage part, the first plate defining a first abutment surface, the second plate defining a second abutment surface, wherein the first abutment surface and the second abutment surface are shaped to facilitate abutment of at least a portion of the second abutment surface against the first abutment surface, and wherein the second anchorage part is adapted to be movable relative to the first anchorage part from an abutting configuration in which at least a portion of the second abutment surface is in abutment with the first abutment surface to a spaced configuration in which the second abutment surface is spaced relative to the first
(Continued)

abutment surface, wherein the first anchorage part includes an elongated angled anchorage lacer bar, the elongated angled anchorage lacer bar being supported by a series of spaced ribs and the rail being tilted out of the plane of the ribs.

14 Claims, 36 Drawing Sheets

(51) Int. Cl.
*E04B 1/68* (2006.01)
*E04B 5/32* (2006.01)

(58) Field of Classification Search
CPC .... E01C 11/14; E01C 11/106; E01C 2201/16; E01C 11/08; E01C 11/02; E01C 11/04
See application file for complete search history.

(56) References Cited

U.S. PATENT DOCUMENTS

| | | | | |
|---|---|---|---|---|
| 2,316,233 | A | 4/1943 | Fischer | |
| 2,349,983 | A | 5/1944 | Alexander | |
| 2,654,297 | A | 10/1953 | Nettleton | |
| 3,559,541 | A | 2/1971 | Watstein | |
| 3,862,810 | A | 1/1975 | Welch | |
| 4,733,513 | A | 3/1988 | Schrader et al. | |
| 4,942,912 | A | 7/1990 | Gakhar et al. | |
| 5,005,331 | A | 4/1991 | Shaw et al. | |
| 5,205,942 | A | 4/1993 | Fitzgerald | |
| 5,216,862 | A | 6/1993 | Shaw et al. | |
| 5,261,635 | A | 11/1993 | Flathau | |
| 5,458,433 | A | 10/1995 | Stastny | |
| 5,487,249 | A | 1/1996 | Shaw et al. | |
| 5,730,544 | A | 3/1998 | Dils et al. | |
| 5,830,378 | A | 11/1998 | Butler | |
| 6,019,546 | A | 2/2000 | Ruiz | |
| 6,021,994 | A | 2/2000 | Shartzer | |
| 6,145,262 | A | 11/2000 | Schrader et al. | |
| 6,354,760 | B1 | 3/2002 | Boxall et al. | |
| 6,550,213 | B1 | 4/2003 | Butler | |
| 6,629,681 | B1 | 10/2003 | Miller | |
| 6,775,952 | B2 | 8/2004 | Boxall et al. | |
| 6,874,288 | B1 | 4/2005 | Washa | |
| 6,926,463 | B2 | 8/2005 | Shaw et al. | |
| 7,228,666 | B2 | 6/2007 | Michiels | |
| 7,338,230 | B2 | 3/2008 | Shaw et al. | |
| 7,481,031 | B2 | 1/2009 | Boxall et al. | |
| 7,604,432 | B2 | 10/2009 | Shaw et al. | |
| 7,637,689 | B2 | 12/2009 | Boxall et al. | |
| 7,716,890 | B2 | 5/2010 | Boxall et al. | |
| 7,736,088 | B2 | 6/2010 | Boxall et al. | |
| 8,142,104 | B2 | 3/2012 | Connolly | |
| 8,302,359 | B2 | 11/2012 | Boxall et al. | |
| 8,303,210 | B2 | 11/2012 | Parkes et al. | |
| 8,356,955 | B2 | 1/2013 | Nadler | |
| 8,381,470 | B2 | 2/2013 | Boxall et al. | |
| 8,516,761 | B2 | 8/2013 | Laiho et al. | |
| 8,539,726 | B2 | 9/2013 | Laiho et al. | |
| 8,573,884 | B2 | 11/2013 | Nadler | |
| 8,627,626 | B2 | 1/2014 | Boxall et al. | |
| 9,260,867 | B2 * | 2/2016 | Arnold | E01C 11/08 |
| 9,574,309 | B2 | 2/2017 | Mcdonald | |
| 9,637,874 | B2 | 5/2017 | Ganey | |
| 9,765,485 | B2 | 9/2017 | Keen | |
| 10,094,075 | B2 | 10/2018 | Keen | |
| 10,323,359 | B2 | 6/2019 | Meuwissen et al. | |
| 10,711,410 | B2 | 7/2020 | Meuwissen et al. | |
| 10,851,501 | B2 * | 12/2020 | De Rivas | E01C 11/08 |
| 11,136,727 | B2 * | 10/2021 | Murdoch | E01C 23/045 |
| 11,136,728 | B2 * | 10/2021 | Murdoch | E01C 11/14 |
| 11,136,729 | B2 * | 10/2021 | Murdoch | E04F 15/142 |
| 11,136,756 | B2 * | 10/2021 | Murdoch | E04B 1/483 |
| 11,280,087 | B2 * | 3/2022 | Murdoch | E04B 1/6807 |
| 11,680,376 | B2 * | 6/2023 | Murdoch | E01C 11/14 404/60 |
| 12,116,774 | B2 * | 10/2024 | Mason | E04B 1/6804 |
| 12,203,264 | B2 * | 1/2025 | Mason | E04B 1/483 |
| 2003/0146365 | A1 | 8/2003 | Miller et al. | |
| 2006/0275078 | A1 | 12/2006 | Shaw et al. | |
| 2007/0269266 | A1 | 11/2007 | Kelly et al. | |
| 2008/0263981 | A1 | 10/2008 | Obrien | |
| 2009/0158682 | A1 * | 6/2009 | Arnold | E04F 15/14 52/364 |
| 2010/0054858 | A1 | 3/2010 | Mayo et al. | |
| 2010/0086351 | A1 | 4/2010 | Mercer | |
| 2017/0009446 | A1 * | 1/2017 | Eve | E01C 11/126 |
| 2018/0135297 | A1 | 5/2018 | Parkes et al. | |
| 2020/0325638 | A1 | 10/2020 | Murdoch et al. | |
| 2020/0332476 | A1 | 10/2020 | Murdoch et al. | |
| 2022/0010546 | A1 | 1/2022 | Mason | |
| 2023/0009418 | A1 * | 1/2023 | Mason | E01C 11/106 |
| 2023/0020378 | A1 * | 1/2023 | Mason | E01C 11/14 |
| 2023/0052491 | A1 * | 2/2023 | Mason | E01C 11/14 |
| 2023/0061463 | A1 * | 3/2023 | Mason | E04B 5/36 |

FOREIGN PATENT DOCUMENTS

| | | | | |
|---|---|---|---|---|
| DE | 20209995 | U1 * | 11/2002 | E01C 11/126 |
| DE | 102007020816 | | 10/2008 | |
| FR | 3029949 | A1 | 6/2016 | |
| FR | 3043105 | | 5/2017 | |
| GB | 2285641 | | 7/1995 | |
| GB | 2421049 | | 6/2006 | |
| GB | 2467877 | | 8/2010 | |
| GB | 2500626 | | 10/2013 | |
| GB | 2511729 | | 9/2014 | |
| GB | 2530344 | | 3/2016 | |
| KR | 100786357 | B1 | 12/2007 | |
| WO | WO 2004/065694 | | 8/2004 | |
| WO | WO 2005/103412 | | 11/2005 | |
| WO | WO 2005/111332 | | 11/2005 | |
| WO | WO 2006/123176 | | 11/2006 | |
| WO | WO 2009/153604 | | 12/2009 | |
| WO | WO 2010/004294 | | 1/2010 | |
| WO | WO 2013/076500 | | 5/2013 | |
| WO | WO 2013/128151 | | 9/2013 | |
| WO | WO 2014/060752 | | 4/2014 | |
| WO | WO 2014/096980 | | 6/2014 | |
| WO | WO 2014/111712 | | 7/2014 | |
| WO | WO 2019/074632 | | 4/2019 | |

OTHER PUBLICATIONS

Diamond™ Dowel Load Transfer System Industrial Slab on Ground brochure, Danley™ Systems, available Nov. 19, 2018 (8 pages).
Load Transfer Systems Dowel Cradles Industrial Slab on Ground brochure, ITW Construction Systems and Danley Systems, available prior to Nov. 19, 2018 (12 pages).

* cited by examiner

ARMOURED JOINT-DISRUPTIVE FOLDED ANCHOR RAIL

PRIORITY CLAIM

The present application claims priority to and the benefit of Australian Patent Application No. 2021204992, filed Jul. 12, 2021, the entire contents of which are incorporated herein by reference.

CROSS-REFERENCE TO RELATED APPLICATIONS

This application is related to the following commonly owned co-pending patent applications: U.S. application Ser. No. 17/862,011, entitled "JOINT EDGE PROTECTION APPARATUS-FULLY BRIDGED WAVE PLATES,"; U.S. application Ser. No. 17/862,029, entitled "EDGE PROTECTION SYSTEM-FLOATING COVER PLATE ON INTERSECTION,"; U.S. application Ser. No. 17/862,637, entitled "EDGE PROTECTION SYSTEM-INTERSECTION CONTINUOUS PERIMETER JOINT LINE,"; U.S. application Ser. No. 17/862,639, entitled "EDGE PROTECTION SYSTEM-JOINT ORIENTATION MARKER,"; and U.S. application Ser. No. 17/862,878, entitled "ARMOURED JOINT-ANTI-SKEW STAKE BRACKET,".

FIELD

The present disclosure relates broadly to an edge protection system, or an armoured joint, for protecting the edges of components formed of settable material such as concrete. The components formed of settable material may be in the form of concrete flooring components, for example, flooring components of industrial concrete flooring. The present disclosure relates to a fully bridged wave plate and, more particularly, but not exclusively, to a fully bridged and supported top wave plate.

BACKGROUND

It is known that the edges of components formed of settable material—such as concrete—may be subject to damage. In particular, where the components formed of settable material are in the form of concrete flooring components forming a floor surface (such as in a warehouse or storage facility), the edges of the concrete flooring components may be subject to damage as forklifts and the like travel from one concrete component onto a neighbouring concrete component. This damage may be exacerbated where one flooring component rises relative to the neighbouring flooring component forming a raised bump which is subject to wear.

It has been proposed to provide an edge protection system to protect the edges of concrete flooring components. However, the applicant has determined that existing edge protection systems are relatively expensive, may be over-engineered, may be subject to incorrect installation and/or may not adequately prevent movement of one concrete panel relative to a neighbouring concrete panel. Examples of the present disclosure aim to improve the life-cycle of a material handling equipment (MHE) crossing by providing an impact free joint, providing an alternative to straight gap systems with wheel impact.

The applicant has determined that it would be advantageous for there to be provided an improved edge protection system which alleviates or at least ameliorates one or more of the disadvantages of existing edge protection systems. In particular, the applicant has identified that it would be advantageous for there to be provided a joint edge management system which provides load transfer, protecting concrete edges from spelling caused by materials handling equipment (MHE) with small hard wheels, travelling at speed, carrying high loads.

SUMMARY

There is disclosed a joint edge protection apparatus for protecting an edge of a first component formed of settable material and an edge of a second component formed of settable material at a joint, wherein the apparatus includes a first anchorage part for anchoring within the first component and a second anchorage part for anchoring within the second component, a first plate coupled to the first anchorage part, a second plate coupled to the second anchorage part, the first plate defining a first abutment surface, the second plate defining a second abutment surface, wherein the first abutment surface and the second abutment surface are shaped to facilitate abutment of at least a portion of the second abutment surface against the first abutment surface, and wherein the second anchorage part is adapted to be movable relative to the first anchorage part from an abutting configuration in which at least a portion of the second abutment surface is in abutment with the first abutment surface to a spaced configuration in which the second abutment surface is spaced relative to the first abutment surface, wherein the first anchorage part defines a support surface to support the second plate as the second anchorage part is moved between the abutting configuration and the spaced configuration, and wherein, in the abutting configuration an interface between the first abutment surface and the second abutment surface is offset relative to an interface between the first anchorage part and the second anchorage part such that the interface of the first abutment surface and the second abutment surface is positioned above the support surface.

Preferably, the first abutment surface and the second abutment surface are correspondingly shaped to facilitate abutment of the second abutment surface against the first abutment surface, such that in the abutting configuration the second abutment surface is in abutment with the first abutment surface.

Preferably, the first abutment surface and the second abutment surface are correspondingly shaped with a wave shape to facilitate abutment of the second abutment surface against the first abutment surface. In one form, the wave shape of the first abutment surface is matched to the wave shape of the second abutment surface to facilitate continuous abutment in the abutting configuration. In an alternative form, the wave shape of the first abutment surface is mismatched to the wave shape of the second abutment surface to facilitate periodic abutment in the abutting configuration.

In a preferred form, the apparatus is arranged such that a gap between the first abutment surface and the second abutment surface, throughout a range of movement, is located above said support surface such that the gap is fully spanned by the support surface. More preferably, the gap is fully bridged by the support surface such that contaminants including vermin and debris are prevented from entering the joint between the first component and the second component. Even more preferably, the fully bridged gap provides a well for application of joint material. In one example, the joint material is in the form of a joint epoxy and/or sealant.

Preferably, the range of movement corresponds to a gap between the first abutment surface and the second abutment surface being between 0 mm and 20 mm.

In a preferred form, said offset, in use, results in the interface between the first abutment surface and the second abutment surface being offset from a centre of the joint between the first component and the second component.

Preferably, the first anchorage part includes a first lacer bar supported by a series of spaced ribs.

It is preferred that the second anchorage part includes a second lacer bar supported by a series of spaced ribs.

Preferably, the or each lacer bar is in the form of a rail.

There is also disclosed a joint edge protection apparatus for protecting an edge of a first component formed of settable material and an edge of a second component formed of settable material at a joint, wherein the apparatus includes a first anchorage part for anchoring within the first component and a second anchorage part for anchoring within the second component, the first anchorage part being provided with a first plate, the second anchorage part being provided with a second plate, the first plate defining a first interface surface, the second plate defining a second interface surface, wherein the first interface surface and the second interface surface are shaped to facilitate abutment of at least a portion of the second interface surface against the first interface surface, and wherein the second anchorage part is adapted to be movable relative to the first anchorage part from an abutting configuration in which at least a portion of the second interface surface is in abutment with the first interface surface to a spaced configuration in which the second interface surface is spaced relative to the first interface surface, wherein the first interface surface and the second interface surface are each shaped with a wave shape, wherein the wave shape of the first interface surface is mismatched to the wave shape of the second interface surface to facilitate periodic abutment of the second interface surface against the first interface surface in the abutting configuration.

In accordance with one aspect of the present disclosure, there is provided an armoured joint for protecting an edge of a first component formed of settable material and an edge of a second component formed of settable material at a joint, wherein the apparatus includes a first anchorage part for anchoring within the first component and a second anchorage part for anchoring within the second component, a first plate coupled to the first anchorage part, a second plate coupled to the second anchorage part, the first plate defining a first abutment surface, the second plate defining a second abutment surface, wherein the first abutment surface and the second abutment surface are correspondingly shaped to facilitate abutment of the second abutment surface against the first abutment surface, and wherein the second anchorage part is adapted to be movable relative to the first anchorage part from an abutting configuration in which the second abutment surface is in abutment with the first abutment surface to a spaced configuration in which the second abutment surface is spaced relative to the first abutment surface, wherein the first anchorage part includes an elongated angled anchorage lacer bar, the elongated angled anchorage lacer bar being supported by a series of spaced ribs and the rail being tilted out of the plane of the ribs.

Preferably, the elongated angled anchorage lacer bar is substantially perpendicular to the first plate.

Preferably, the first anchorage part and the second anchorage part each have a respective elongated angled anchorage lacer bar, each of the respective elongated angled anchorage lacer bars being supported by a respective series of spaced ribs and each lacer bar being tilted out of the plane of the respective ribs.

It is preferred that the armoured joint includes at least one dowel for maintaining level of the second anchorage part relative to the first anchorage part.

In one form, the anchorage lacer bar varies in width between ribs.

Preferably, each of the spaced ribs has a tapered foot which tapers outwardly into the lacer bar. More preferably, each tapered foot progressively tapers outwardly into the lacer bar.

Preferably, each rib is bent at the tapered foot such that the lacer bar is tilted out of a plane of the ribs.

In a preferred form, each of the ribs is angled at an acute angle relative to the first plate, and the lacer bar is tilted to be substantially perpendicular to the first plate.

Preferably, between each pair of successive ribs, an upper edge of the lacer bar is tapered progressively outwardly then progressively inwardly.

It is preferred that, between each pair of successive ribs, an upper edge of the lacer bar has a generally wave-like form. More preferably, between each pair of successive ribs, the upper edge of the lacer bar has a single wave form.

In one form, the lacer bar is in the form of a part of sheet metal.

There is also disclosed, an armoured joint for protecting an edge of a first component formed of settable material and an edge of a second component formed of settable material at a joint, wherein the apparatus includes a first anchorage part for anchoring to the first component and a second anchorage part for anchoring to the second component, a first plate coupled to the first anchorage part, a second plate coupled to the second anchorage part, the first plate defining a first edge, the second plate defining a second edge, wherein the first edge and the second edge are correspondingly shaped to facilitate bringing together of the first edge and the second edge, and wherein the second anchorage part is adapted to be movable relative to the first anchorage part from a close configuration in which the second edge is brought together with the first edge to a spaced configuration in which the second edge is spaced relative to the first edge, wherein the first anchorage part or the second anchorage part has a support section, the armoured joint including a bracket for supporting the armoured joint relative to a ground surface, the bracket comprising an angled upper leg and an angled lower leg, wherein the bracket is fixed to the support section by the angled upper leg and the angled lower leg, the angled upper leg being fixed to the support section to extend downwardly from the support section at a first angle and the angled lower leg being fixed to the support section to extend upwardly from the support section at a second angle of the same magnitude as the first angle.

Preferably, a distal end of the upper leg is fixed relative to a distal end of the lower leg.

It is preferred that the upper leg is in the form of a straight part and the lower leg is in the form of a straight part.

Preferably, the upper leg is provided with an aperture for receiving a support stake, for supporting the armoured joint relative to a ground surface, and the lower leg is provided with an aperture for receiving the support stake. More preferably, the aperture of the upper leg and the aperture of the lower leg are arranged to receive the support stake with the support stake in a substantially perpendicular orientation relative to a plane of the first plate.

Even more preferably, the apertures and the support stake are arranged to provide a sliding condition in which the stake is able to be slid relative to the bracket and a locked condition in which the stake is locked against sliding relative to the bracket, wherein the stake is rotated about its longitudinal axis relative to the bracket between the sliding condition and the locked condition.

Preferably, the upper leg meets the lower leg at a bent portion of the bracket.

In a preferred form, the upper leg meets the lower leg at an intermediate vertical section between the upper leg and the lower leg.

Preferably, the bracket is symmetrical in a horizontal central plane.

There is also disclosed an assembly including an armoured joint as described above, in combination with a stake, wherein the stake extends through the upper leg and the lower leg.

Preferably, the stake is non-circular and an aperture in each of the upper leg and lower leg is non-circular, such that the stake is able to be rotated relative to the bracket between a sliding condition, in which the stake is able to be slid relative to the bracket, and a locked condition, in which the stake is locked against sliding relative to the bracket.

In a preferred form, the first anchorage part includes an elongated angled anchorage lacer bar, the elongated angled anchorage lacer bar being supported by a series of spaced ribs and the lacer bar being tilted out of the plane of the ribs.

Preferably, the first anchorage part defines a support surface to support the second plate as the second anchorage part is moved between the close configuration and the spaced configuration, and wherein, in the close configuration an interface between the first edge and the second edge is offset relative to a joint between the first component and the second component such that the interface of the first edge and the second edge is positioned above the support surface.

Preferably, each of the apertures is in the shape of a slot, and the stake has a cross-sectional shape having opposed parallel flat sides connected at either end by a round portion.

There is also disclosed an edge protection system including a first expandable armoured joint to protect a first joint extending in a first direction, a second expandable armoured joint to protect a second joint extending in a second direction and an intersection module including a cover plate located at an intersection of the first expandable armoured joint and the second expandable armoured joint.

Preferably, the first expandable armoured joint includes a first pair of plates arranged to be moved apart to open a crevice between the plates in response to expansion of the first joint, and the second expandable armoured joint includes a second pair of plates arranged to be moved apart to open a crevice between the plates in response to expansion of the second joint. More preferably, each of the first pair of plates has a wavy edge, the wavy edges being brought together in a contracted condition of the first expandable armoured joint, and wherein each of the second pair of plates has a wavy edge, the wavy edges being brought together in a contracted condition of the second expandable armoured joint.

Preferably, the cover plate is removable from a remainder of said intersection module. More specifically, the plate is removable to facilitate installation. Although not the main function, the removability of the plate may be used for repair and/or top plate replacement.

Preferably, the edge protection system includes an anchored support for supporting the intersection module relative to a ground surface, an upper support of the intersection module being adapted to receive the cover plate fastened thereto.

More preferably, the anchored support anchors the intersection module in a fixed location relative to the ground surface during expansion of the first expandable armoured joint and the second expandable armoured joint.

In a preferred form, the first joint is a joint between concrete slab sections and the second joint is a joint between concrete slab sections. More preferably, the cover plate is a load supporting member being braced by each slab section when the slab sections move through slab shrinkage. Even more preferably, the cover plate is a load supporting member being braced by each slab section when the slab sections move through slab shrinkage with each slab moving up to 20 mm.

In a preferred form, the intersection module includes a central support column, the central support column having an upper support plate and a lower anchor plate, the cover plate being fastened to the upper support plate so as to be connected to the central support column and the lower anchor plate to remain vertically coupled to the concrete slab sections.

More preferably, the edge protection system includes a stake which is inserted through the central support column for supporting the intersection module relative to the ground surface.

Preferably, the upper support plate is in the form of an upper cleat plate which is spaced vertically from the lower anchor plate.

In a preferred form, the stake is in the form of a star picket. More preferably, the stake is arranged to prevent the central support column from rotating relative to the ground surface and from translational movement relative to the ground surface. Even more preferably, the cleat plate and the lower anchor plate restrict movement of the star picket angularly at spaced locations of the central support column.

Preferably, the first direction is not parallel to the second direction. More preferably, the first direction is perpendicular to the second direction.

There is also disclosed an edge protection system including a first expandable armoured joint to protect a first joint extending in a first direction, a second expandable armoured joint to protect a second joint extending in a second direction and an intersection module at an intersection of the first expandable armoured joint and the second expandable armoured joint, wherein the first expandable armoured joint has a first joint line, the second expandable armoured joint has a second joint line, and wherein the intersection module provides a perimeter joint line such that there is a continuous joint line including the first joint line, the perimeter joint line and the second joint line.

Preferably, the intersection module includes a cover plate, and the continuous joint line extends at least partially around a perimeter of the cover plate between the first joint line and the second joint line.

Preferably, the first joint line has a generally wavy form and the second joint line has a generally wavy form. More preferably, the cover plate is arranged such that, regardless of where lengths of the wavy first and second joints are cut, the wavy first joint line and the wavy second joint line will connect to the active joint line of the intersection module. In one form, the cover plate is arranged to ensure such that joint lines are matched to standard joint runs.

Preferably, joint openings at the perimeter of the cover plate are halved in thickness when used in a four-way intersection configuration. More preferably, a joint gap is split up on either side of the cover plate.

There is also disclosed an edge protection system including a first expandable armoured joint to protect a first joint extending in a first direction, a second expandable armoured joint to protect a second joint extending in a second direction and an intersection module at an intersection of the first expandable armoured joint and the second expandable armoured joint, wherein the intersection module has an indicator to enable a user to ensure correct orientation of the intersection module.

Preferably, the intersection module includes a cover plate which is generally symmetrical in shape. More preferably, the cover plate is generally octagonal in shape.

In one form, the indicator is in the form of a discreet marking.

In one particular form, the indicator is in the form of a small hole in the cover plate.

Preferably, the indicator is provided to enable a user to orientate joints during installation on-site in a common direction to ensure joint lines match.

In a preferred form, the indicator is positioned in one of four orientations on a first intersection module on-site depending upon a first pour location. More preferably, subsequent intersection modules are placed each with the respective indicator oriented in the same direction as for the first intersection module.

Preferably, the intersection module is arranged to allow for two-way, three-way and four-way intersections to be formed without adjusting orientation of the intersection module.

Preferably, the indicator is repeated on a plurality of assembly pieces of the intersection module to assist with orientation of star picket guides to a common orientation. More preferably, the indicator is repeated on an upper support plate and a lower support plate of a support column of the intersection module.

In one form, the first expandable armoured joint has a first joint line, the second expandable armoured joint has a second joint line, and the intersection module provides a perimeter joint line such that there is a continuous joint line including the first joint line, the perimeter joint line and the second joint line.

BRIEF DESCRIPTION OF THE DRAWINGS

The present disclosure is further described by way of non-limiting example only with reference to the accompanying drawings, in which.

DETAILED DESCRIPTION

Figure 1:
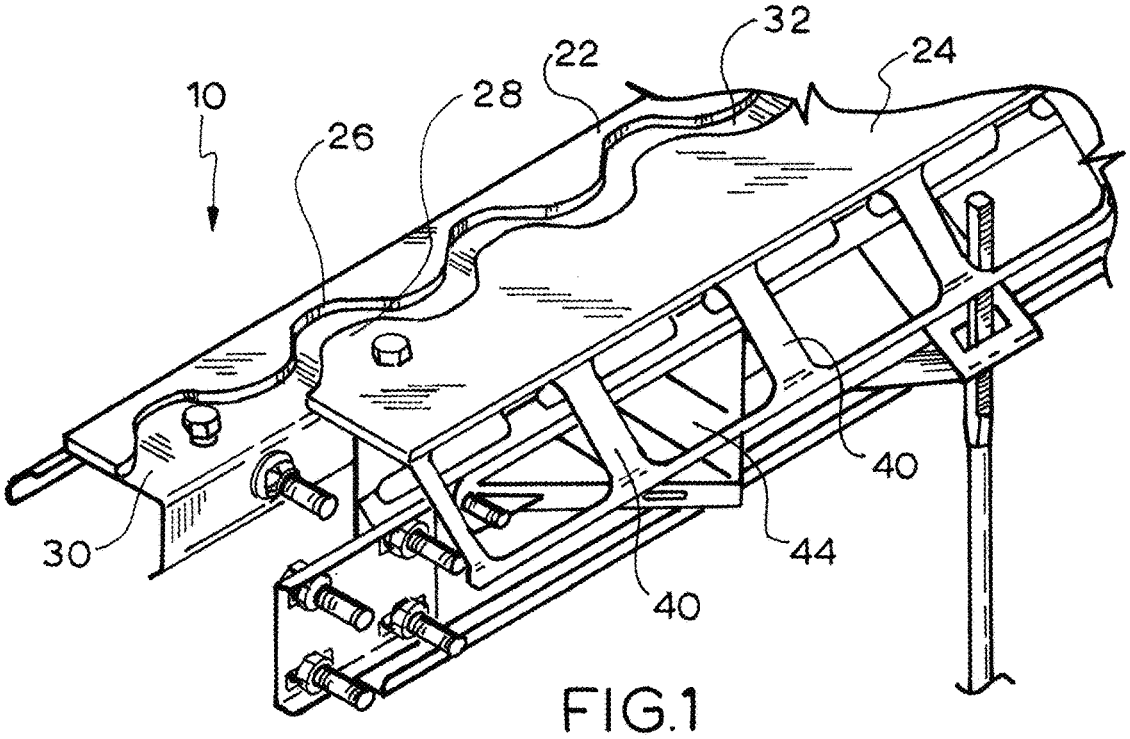
FIG. 1 shows a perspective view of a joint edge protection apparatus having fully bridged and supported top wave plates.
Figure 2:
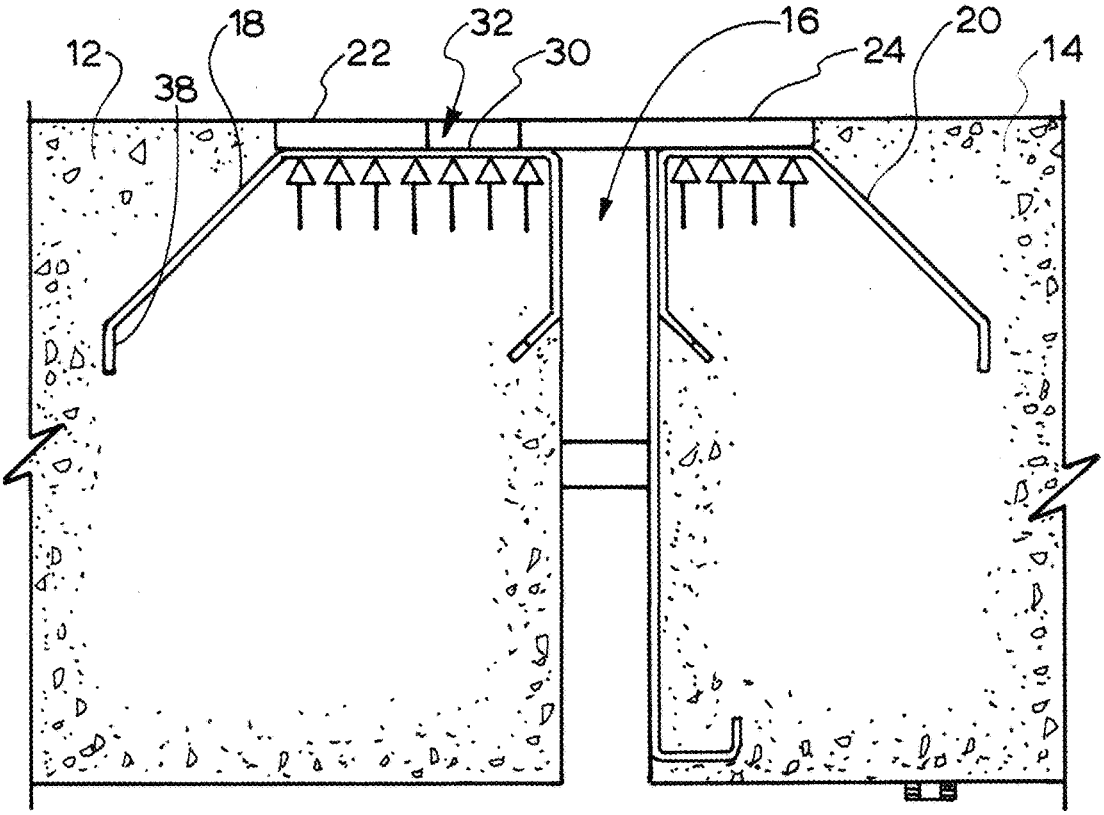
FIG. 2 shows a cross sectional view of the joint edge protection apparatus cast into concrete slabs.

1. Fully Bridged and Supported Top Wave Plates

With reference to FIGS. 1 to 7 and FIGS. 26 to 34, there is shown a joint edge protection apparatus having fully bridged and supported top wave plates in accordance with an example of the present disclosure.

More specifically, there is provided a joint edge protection apparatus 10 for protecting an edge of a first component 12 formed of settable material and an edge of a second component 14 formed of settable material at a joint 16. The apparatus 10 includes a first anchorage part 18 for anchoring within the first component 12 and a second anchorage part 20 for anchoring within the second component 14. The apparatus 10 also includes a first plate 22 coupled to the first anchorage part 18, a second plate 24 coupled to the second anchorage part 20, the first plate 22 defining a first abutment surface 26 and the second plate 24 defining a second abutment surface 28.

The first abutment surface 26 and the second abutment surface 28 are correspondingly shaped to facilitate abutment of the second abutment surface 28 against the first abutment surface 26. The second anchorage part 20 is adapted to be movable relative to the first anchorage part 18 from an abutting configuration (the FIG. 32) in which the second abutment surface 28 is in abutment with the first abutment surface 26 to a spaced configuration (the FIG. 30) in which the second abutment surface 28 is spaced relative to the first abutment surface 26. The first anchorage part 18 defines a support surface 30 to support the second plate 24 as the second anchorage part 20 is moved between the abutting configuration and the spaced configuration. In the abutting configuration, an interface between the first abutment surface 26 and the second abutment surface 28 is offset relative to an interface between the first anchorage part 18 and the second anchorage part 20 such that the interface of the first abutment surface 26 and the second abutment surface 28 is positioned above the support surface 30. In other words, the line of abutment between the first abutment surface 26 and the second abutment surface 28 is offset relative to the joint 16 such that the second plate 24 is supported by the first anchorage part 18 having the support surface 30.

The first abutment surface 26 and the second abutment surface 28 are correspondingly shaped with a wave shape (the FIG. 1) to facilitate abutment of the second abutment surface 28 against the first abutment surface 26.

In the preferred example shown in the drawings, the apparatus 10 is arranged such that a gap 32 between the first abutment surface 26 and the second abutment surface 28, throughout a range of movement, is located above the support surface 30 such that the gap 32 is fully spanned by the support surface 30. In this way, the gap 32 is fully bridged by the support surface 30 such that debris is prevented from entering the joint 16 between the first component 12 and the second component 14. The fully bridged gap 32 may provide a well 34 for application of joint material 36. The joint material 36 may be in the form of a joint epoxy and/or sealant.

The range of movement corresponds to a gap 32 between the first abutment surface 26 and the second abutment surface 28 being between 0 mm and 20 mm.

In use, the offset results in the interface between the first abutment surface 26 and the second abutment surface 28 being offset from a centre of the joint 16 between the first component 12 and the second component 14.

The first anchorage part 18 may include a first lacer bar 38 supported by a series of spaced ribs 40. Similarly, the second anchorage part 20 may include a second lacer bar 42 supported by a series of spaced ribs 40. Each of the lacer bars 38, 42 may be in the form of a rail.

Accordingly, as will be appreciated from the above, this aspect relates to:

The separation plate and joint line under the top wave plates 22, 24 is offset from the centre of the joint 16 to allow 20 mm of supported opening of the waved top plates 22, 24 while fully supporting both sides of the joint 16 with concrete and steel.

The resultant waved gap 32 between wave plates 22, 24 at 20 mm is fully enclosed and does not allow debris the enter the remaining section (slab height—6 mm) of the joint 16.

Enclosing the joint gap 32 with the support surface 30 helps to reduce corrosion and binding (debris) of the load transfer mechanisms (dowels).

The fully enclosed bridged gap 32 can act as a 6 mm deep well 34 for application of joint epoxies and sealants (if required). Epoxy is fully supported by steel and concrete.

The bridged gap 32 acts as barrier against foreign objects entering the potential 20 mm joint 16.

2. Disruptive Folded Continuous Sheet Metal Anchor Rail

With reference to FIGS. 5 to 7 and FIGS. 35 to 41, there is also disclosed an armoured joint having a disruptive folded continuous sheet metal anchor rail.

Figure 5:
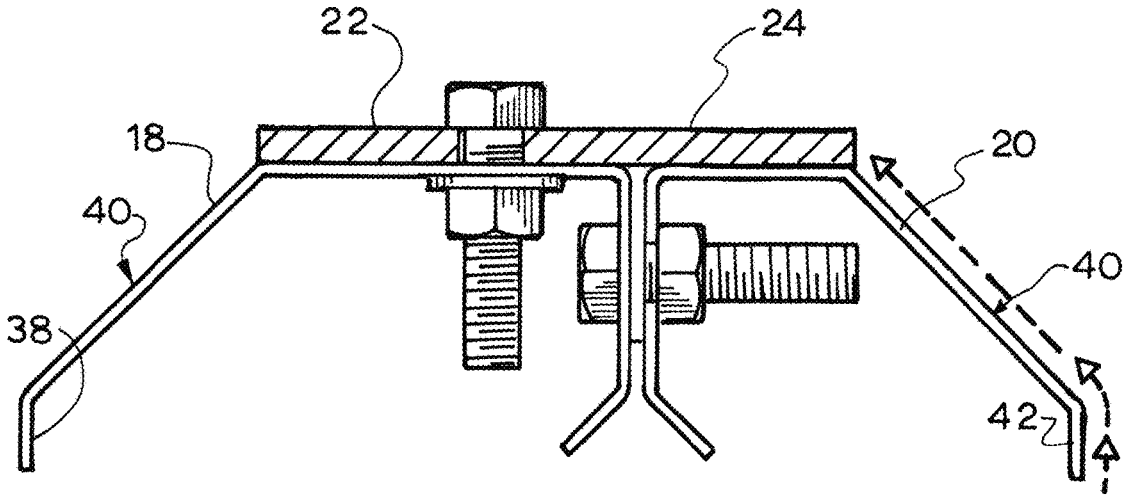
FIG. 5 shows a cross sectional view of the joint edge protection apparatus showing transfer of forces.
Figure 6:
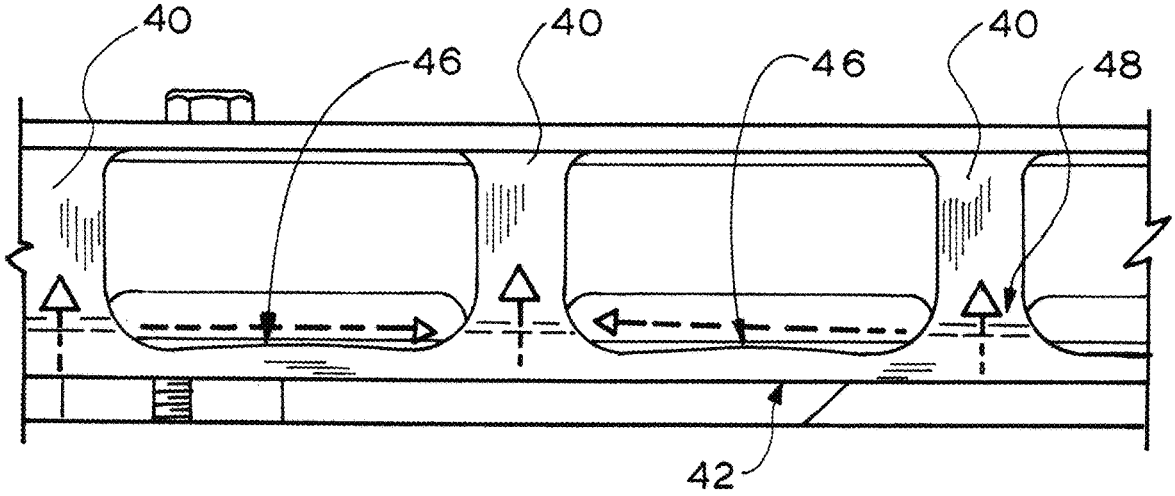
FIG. 6 shows a detailed side view of the disruptive folded anchor rail depicting passage of forces.
Figure 7:
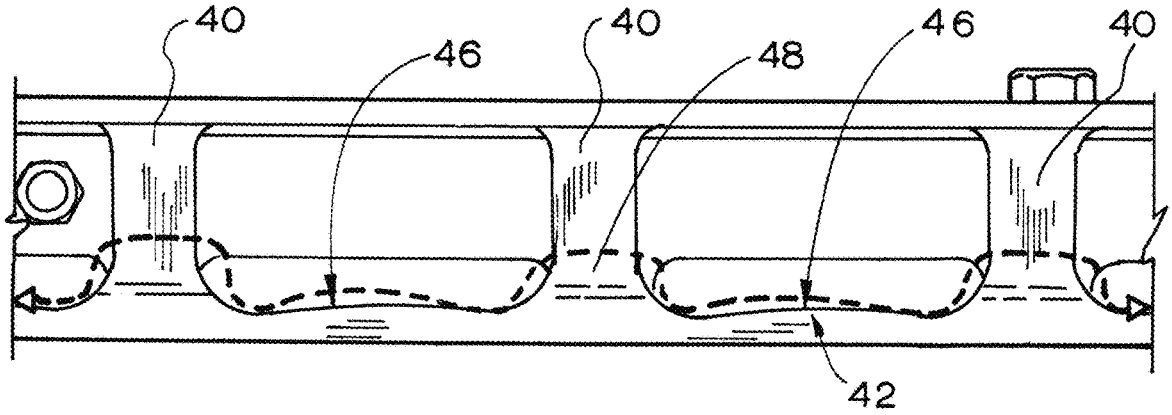
FIG. 7 shows a further detailed side view of the disruptive folded anchor rail.

More specifically, as shown in FIGS. 5 to 7, the joint edge protection apparatus 10 forms an armoured joint having a disruptive folded continuous sheet metal anchor rail. In particular, the armoured joint protects an edge of the first component 12 formed of settable material and an edge of the second component 14 formed of settable material at the joint 16. The apparatus 10 includes the first anchorage part 18 for anchoring within the first component 12 and the second anchorage part 20 for anchoring within the second component 14. The first plate 22 is coupled to the first anchorage part 18 and the second plate 24 is coupled to the second anchorage part 20. The first plate 22 defines the first abutment surface 26, and the second plate 24 defines the second abutment surface 28. The first abutment surface 26 and the second abutment surface 28 are correspondingly shaped to facilitate abutment of the second abutment surface 28 against the first abutment surface 26. The second anchorage part 20 is adapted to be movable relative to the first anchorage part 18 from an abutting configuration (see FIG. 32) in which the second abutment surface 28 is in abutment with the first abutment surface 26 to a spaced configuration (see FIG. 30) in which the second abutment surface 28 is spaced relative to the first abutment surface 26. The first anchorage part 18 includes the first lacer bar 38 which is in the form of an elongated angled anchorage lacer bar 38. The first lacer bar 38 is supported by a series of the spaced ribs 40 and the first lacer bar 38 is in the form of a rail which is tilted out of a plane of the ribs 40 (see FIG. 5).

The elongated angled anchorage lacer bar 38 is substantially perpendicular to the first plate 22. In particular, as seen in FIG. 5, the first lacer bar 38 may be substantially vertical whereas the first plate 22 may be substantially horizontal for supporting forklifts and the like moving across a working floor surface.

As can be seen in FIG. 5, the first anchorage part 18 and the second anchorage part 20 each have a respective elongated angled anchorage lacer bar 38, 42. Each of the respective elongated angled anchorage lacer bars are supported by a respective series of spaced ribs 40 and each lacer bar is tilted/bent out of a plane of the respective ribs 40. In this way, the joint edge protection apparatus 10 is provided with a disruptive folded continuous sheet metal anchor rail which provides more consistent anchorage along the armoured joint.

Figure 3:
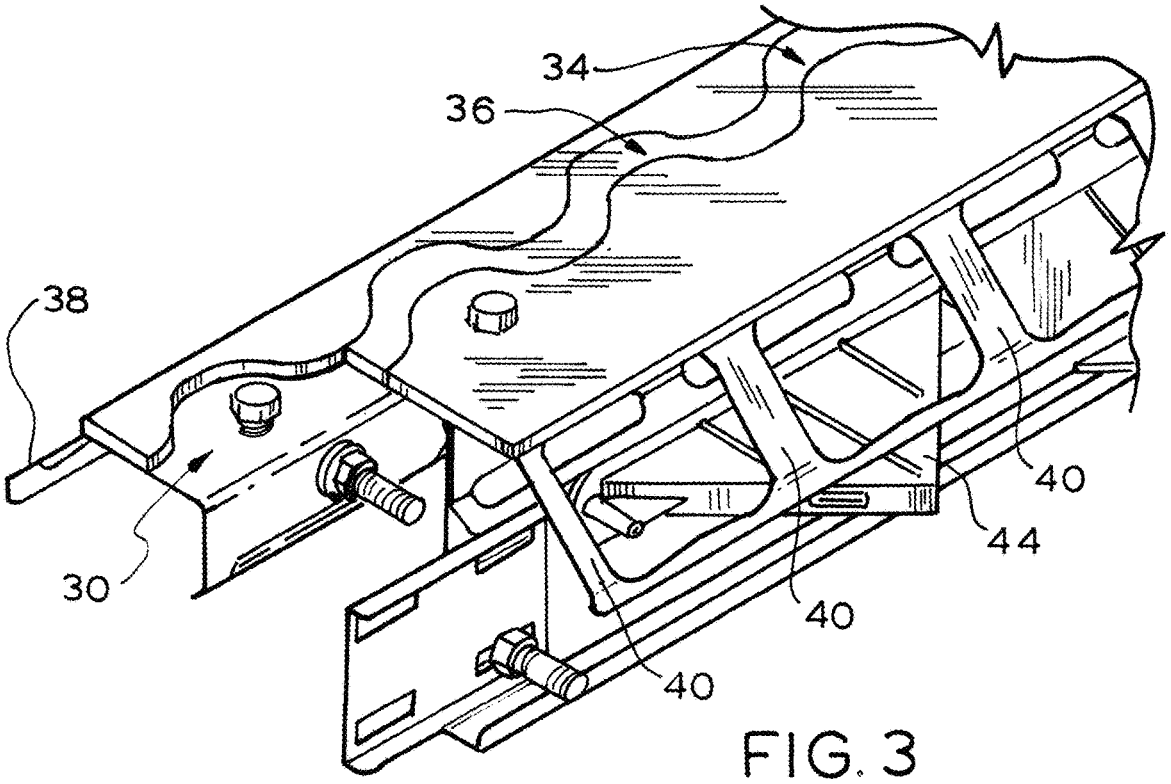
FIG. 3 shows a top perspective view of the joint edge protection apparatus having a wave-like gap between the plates filled.
Figure 4:
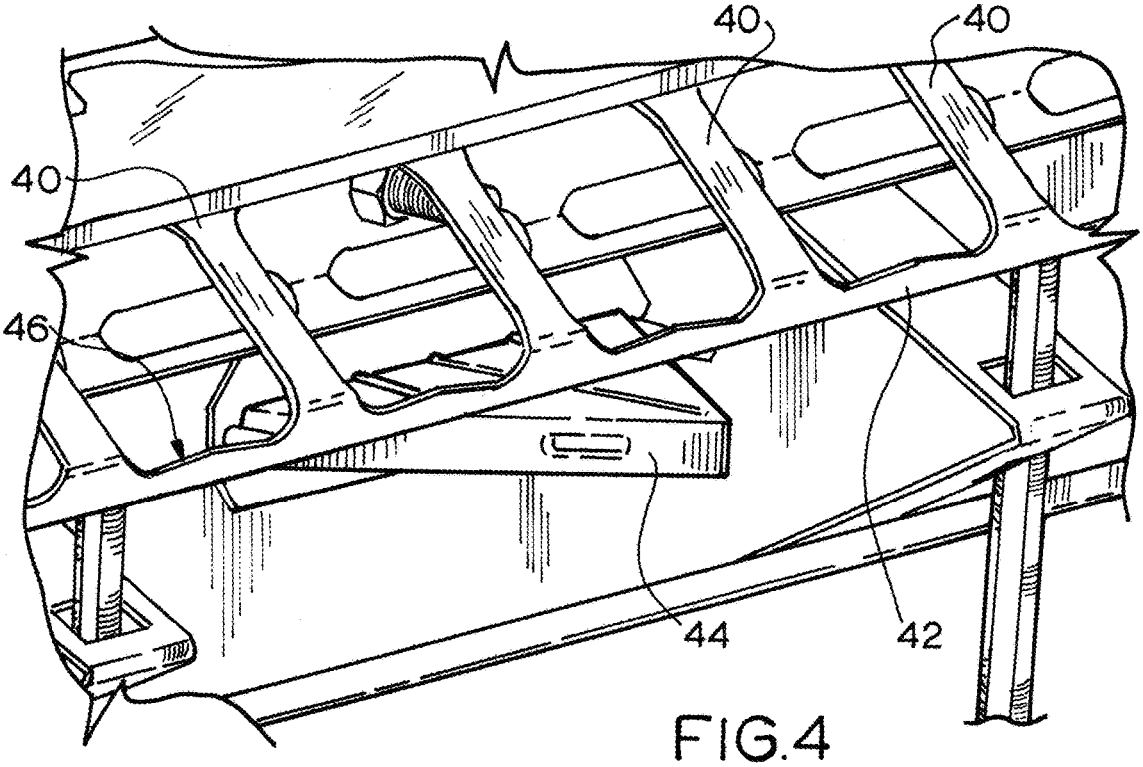
FIG. 4 shows a side perspective view of a joint edge protection apparatus having a disruptive folded continuous sheet metal anchor rail.

The armoured joint in the form of the joint edge protection apparatus 10 may include at least one dowel 44 for maintaining level of the second anchorage part 20 relative to the first anchorage part 42. In particular, as shown in FIG. 3 and FIG. 4, the joint edge protection apparatus 10 may include a plate dowel which is movable within one or more housing/sheath/sleeve fitted to the second anchorage part 20 and/or the first anchorage part 18. The dowel 44 may be in the form of a plate dowel being generally rectangular or square in shape and, in situ, having edges extending at an angle to a central axis of the joint 16. In particular, the plate dowel may have edges extending at an angle of approximately 45° to a central axis of the joint.

As can be seen in FIG. 4, the anchorage lacer bar 42 varies in width between the ribs 40. Specifically, it can be seen that, between adjacent ribs 40, the lacer bar 42 increases in width to a thickest portion which is midway between the adjacent ribs 40. This is achieved by having a straight lower edge to the lacer bar 42 and a tapered upper edge to the lacer bar 42, which upper edge tapers outwardly to an apex 46 which is midway between the adjacent ribs 40.

Accordingly, in this way, between each pair of successive ribs 40, the upper edge of the lacer bar 42 is tapered progressively outwardly to the apex 46 and then progressively inwardly to the next rib 40. As such, between each pair of successive ribs 40, the upper edge of the lacer bar 42 has a generally wave-like form. Even more specifically, in the example shown, between each pair of successive ribs 40 the upper edge of the lacer bar 42 has a single wave form. The lacer bar 42 may be in the form of a part of sheet metal.

As can be seen in FIG. 6 and FIG. 7, each of the spaced ribs 40 has a tapered foot 48 which tapers outwardly into the lacer bar 42. Each tapered foot 48 progressively tapers outwardly into the lacer bar 42. As will be appreciated in symmetry, the first lacer bar 38 may take a similar form to the second lacer bar 42, as shown in FIG. 6 and FIG. 7.

Each rib 40 may be bent at the tapered foot 48 such that the lacer bar 42 is tilted out of a plane of the ribs 40 (see FIG. 5. In the particular example shown in the drawings, each of the ribs 40 is angled at an acute angle relative to the first plate 22 (that is, an outside angle between the ribs 40 and the horizontal is an acute angle), and the second lacer bar 42 is tilted to be substantially perpendicular to the first plate 22. Similarly, the first lacer bar 38 is also tilted to be substantially perpendicular to the first plate 22.

Accordingly, as will be appreciated from the above, this aspect relates to:

A continuous sheet metal studding rail—or lacer bar—to anchor the joint evenly into the concrete components. More consistent anchorage along the armoured plate joint may be achieved with this arrangement.

Large cut-outs to allow adequate concrete and aggregate flow around anchor points and under joint plates.

Folded through anchor point to provide better pull-out resistance. That is, the arrangement requires the fold to un-bend before the anchor can pull out. This removes a sheet metal blade nature of anchorage.

Fold on end of anchor points is connected between points by a sheet metal lacer bar—this ties anchorage at each stud into the neighbouring points, increasing pull out resistance.

The lacer bar fold adds stiffness and rigidity to the entire rail length.

Cut-outs are broken up along the rail length with the cut-outs continuing around the fold. This potentially removes a crack-inducing nature of a straight edge in the slab.

Additional wave formation along the straight edge between anchor points increases the surface area of the bottom of the cut-out giving better anchorage.

3. Anti-Skew Stake Bracket

Turning to FIGS. 8, 9 and 42 to 49, there is also shown a joint edge protection apparatus 10 being supported by an anti-skew stake bracket 50. Advantageously, the bracket 50 has mirrored angled legs which provide stronger support for heavier joints, achieved by the arc of movement of the legs.

More specifically, as will be appreciated from the above, the joint edge protection apparatus 10 provides an armoured joint for protecting an edge of the first component 12 formed of settable material and an edge of the second component 14 formed of settable material at the joint 16. The apparatus 10 includes the first anchorage part 18 for anchoring to the first component 12 and the second anchorage part 20 for anchoring to the second component 14. The apparatus 10 also includes the first plate 22 coupled to the first anchorage part 18 and the second plate 24 coupled to the second anchorage part 20. The first plate 22 defines the first abutment surface 26 in the form of a first edge and the second plate 24 defines the second abutment surface 28 in the form of a second edge. The first edge 26 and the second edge 28 are correspondingly shaped to facilitate bringing together of the first edge 26 and the second edge 28. In particular, the second anchorage part 20 is adapted to be movable relative to the first anchorage part 18 from a close configuration (see FIG. 32) in which the second edge 28 is brought together with the first edge 26 to a spaced configuration (see FIG. 30) in which the second edge 28 is spaced relative to the first edge 26.

Figure 9:
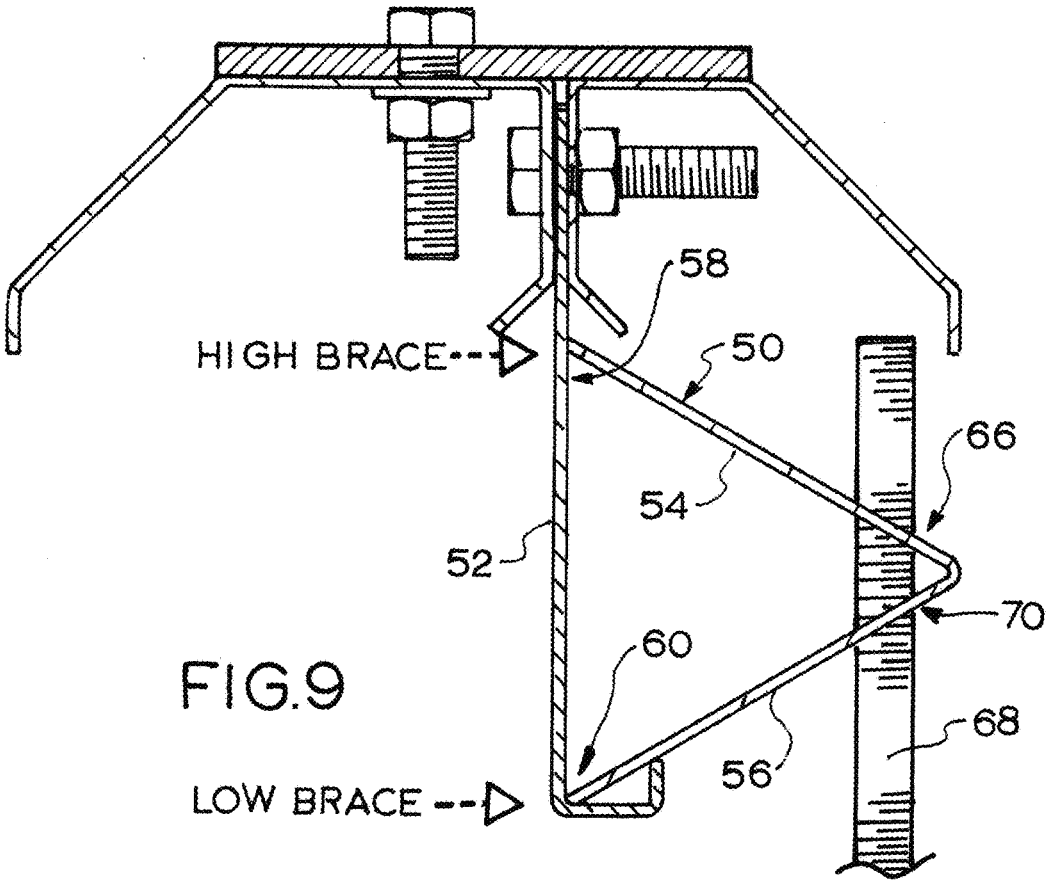
FIG. 9 shows a further cross sectional view of the stake bracket shown supporting a joint edge protection apparatus.

The first anchorage part 18 or the second anchorage part 20 has a support section 52, the armoured joint including the bracket 50 for supporting the armoured joint relative to a ground surface. The bracket 50 comprises an angled upper leg 54 and an angled lower leg 56, the bracket 50 being fixed to the support section 52 by the angled upper leg 54 and the angled lower leg 56. With reference to FIG. 9, the angled upper leg 54 is fixed to the support section 52 to extend downwardly from the support section 52 at a first angle 58, and the angled lower leg 56 is fixed to the support section 52 to extend upwardly from the support section 52 at a second angle 60 of the same magnitude as the first angle 58.

Figure 8:
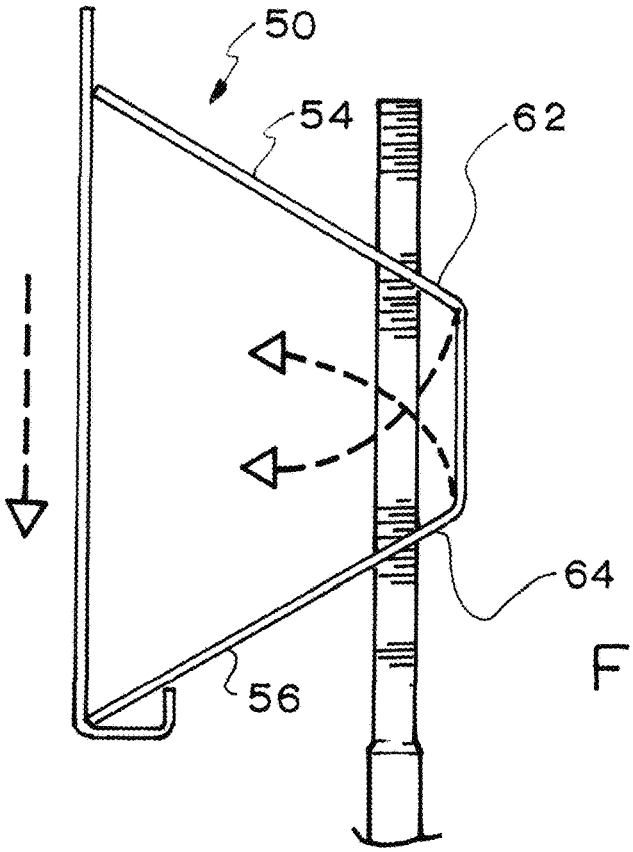
FIG. 8 shows a cross sectional view of an anti-skew stake bracket.

A distal end 62 of the upper leg 54 is fixed relative to a distal end 64 of the lower leg 56. The distal end 62 of the upper leg 54 may be connected to the distal end 64 of the lower leg 56 by way of an intermediate portion as shown in FIG. 8, or, alternatively, may be directly connected as shown in FIG. 9. The upper leg 54 may be in the form of a straight part and the lower leg 56 may be in the form of a straight part.

Figure 10:
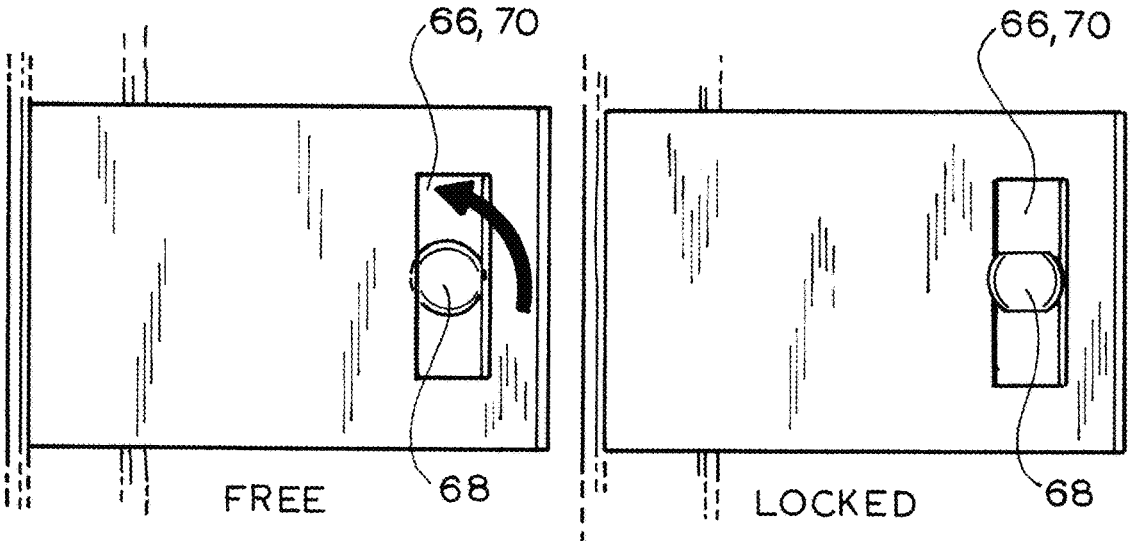
FIG. 10 shows free and locked orientations of a stake relative to an aperture of the stake bracket.
Figure 11:
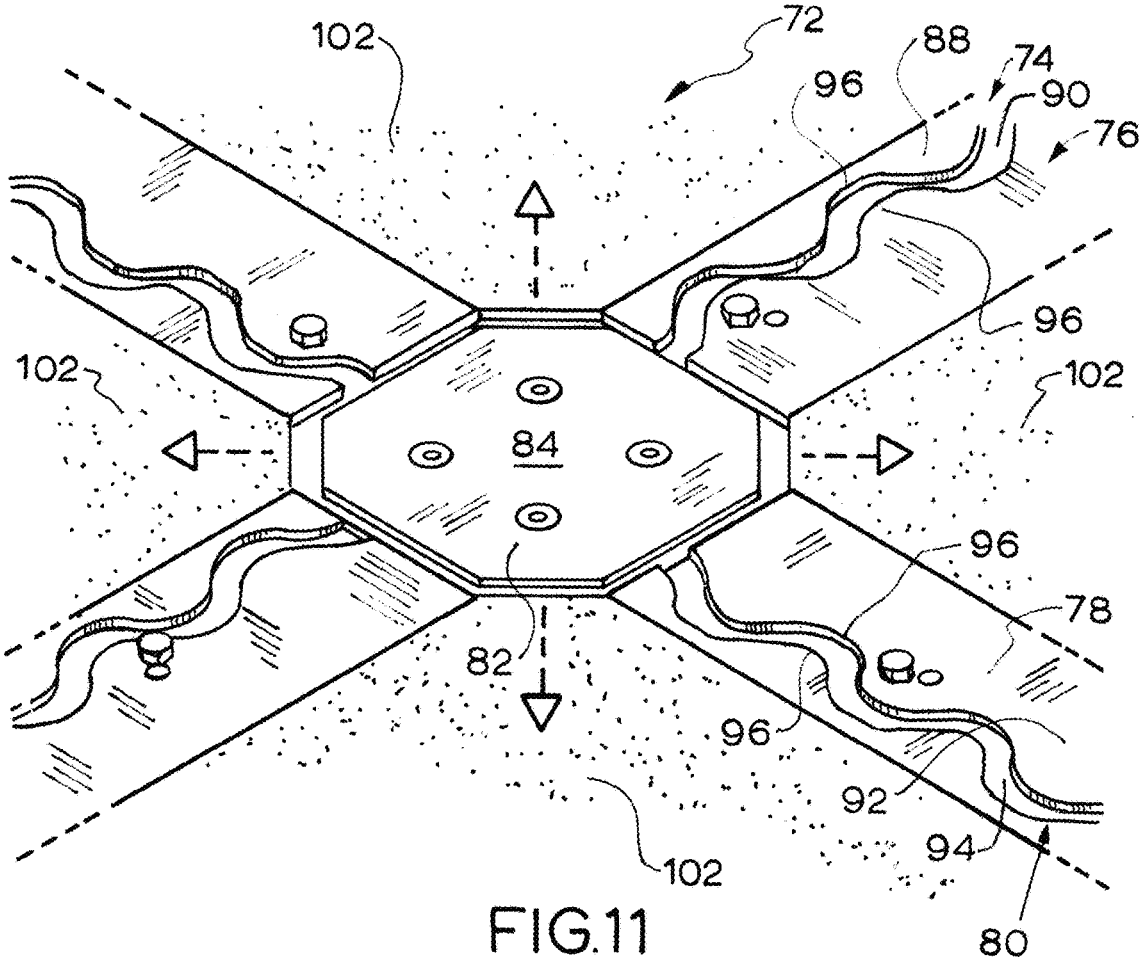
FIG. 11 shows a top perspective view of an edge protection system having a floating cover plate at an intersection.
Figure 12:
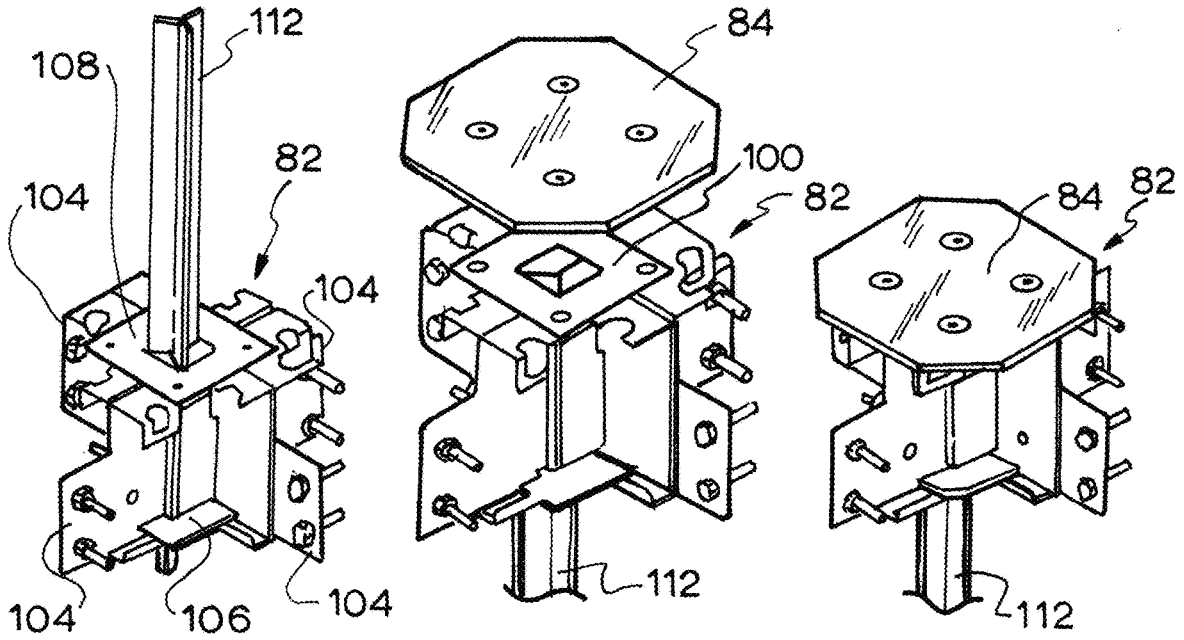
FIG. 12 shows detail of an intersection module including the cover plate.
Figure 13:
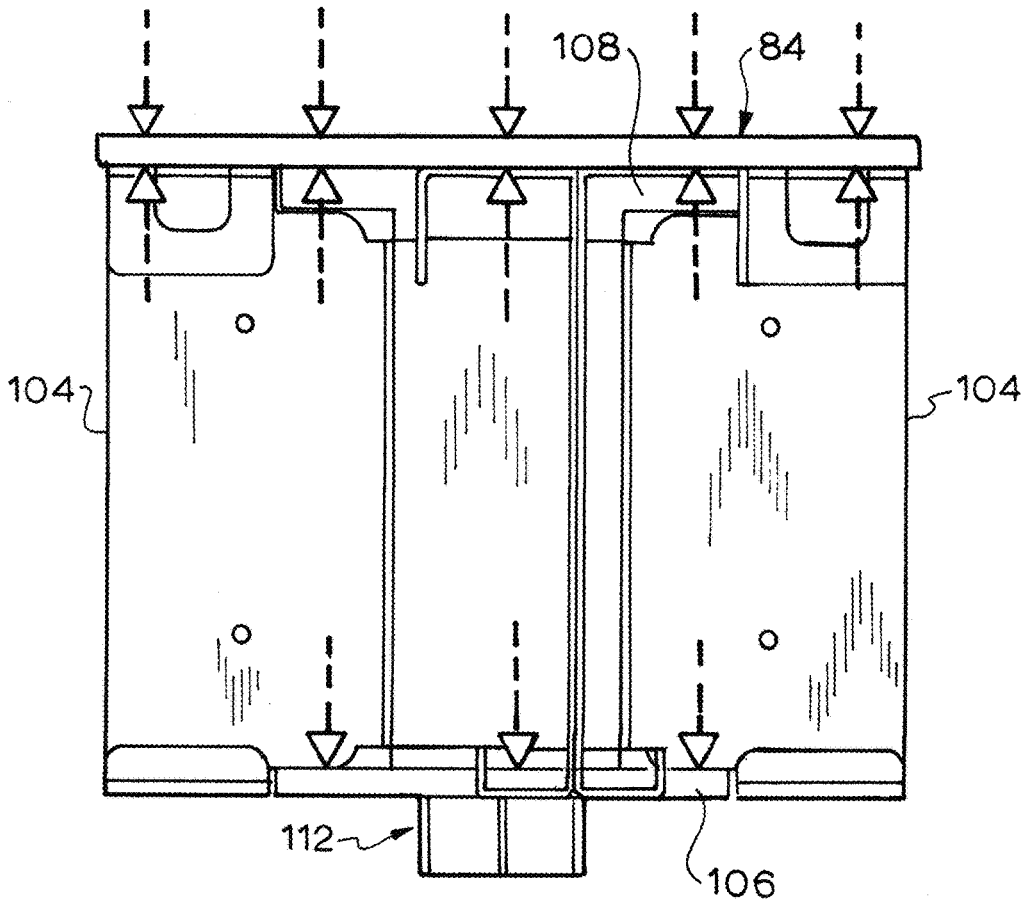
FIG. 13 shows a sectional view of the intersection top plate anchorage through the central column.
Figure 14:
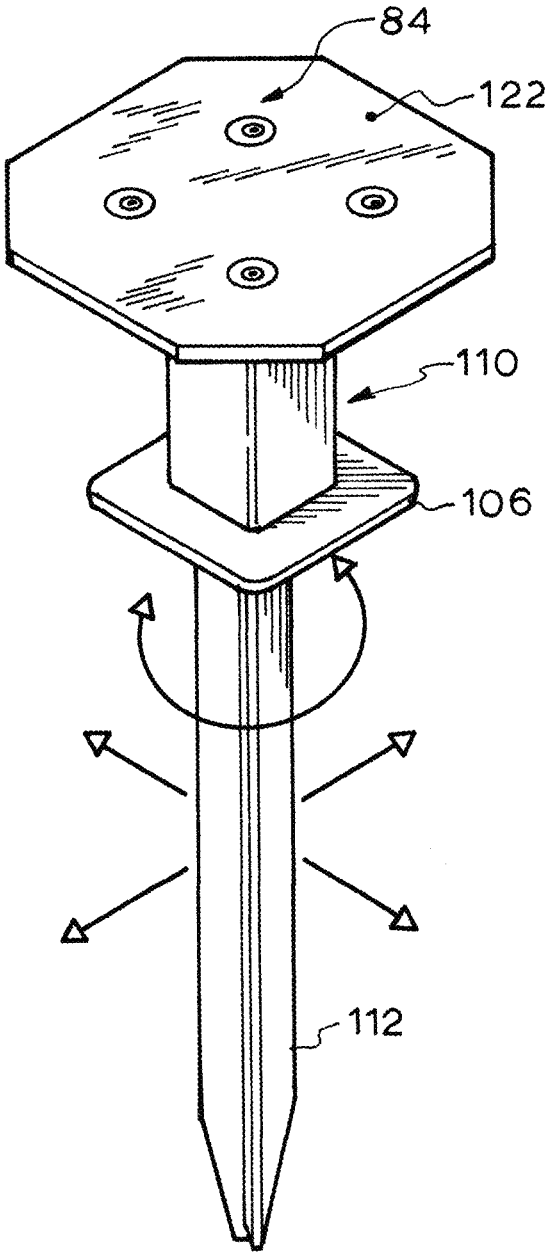
FIG. 14 shows a top perspective view of the intersection module shown anchored by a stake.
Figure 15:
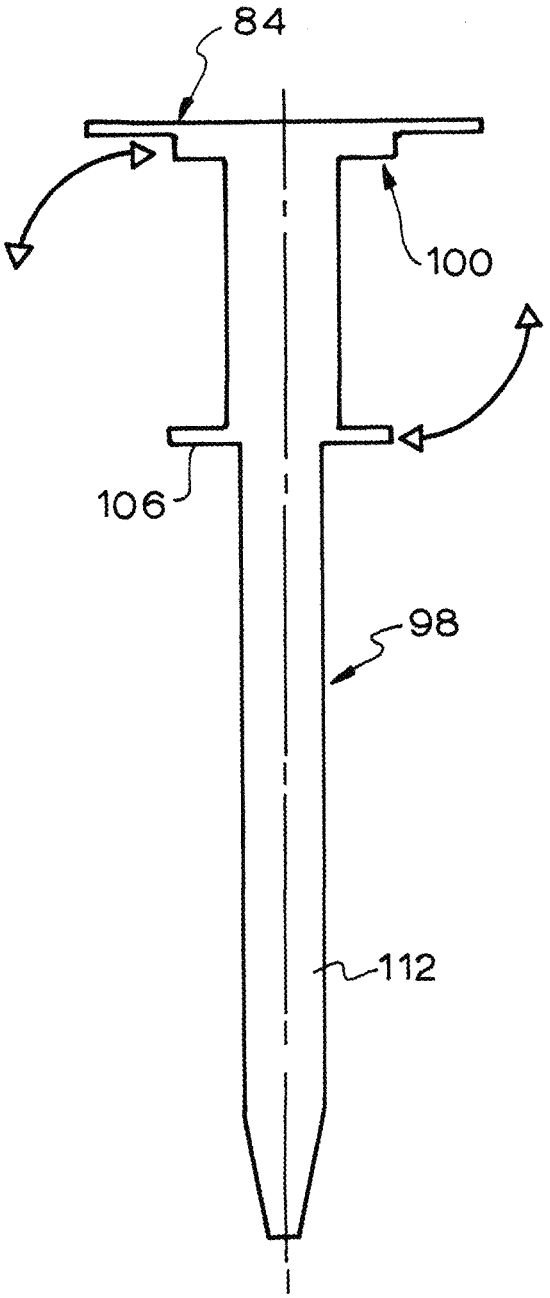
FIG. 15 shows a side view of the intersection module shown anchored by the stake.
Figure 16:
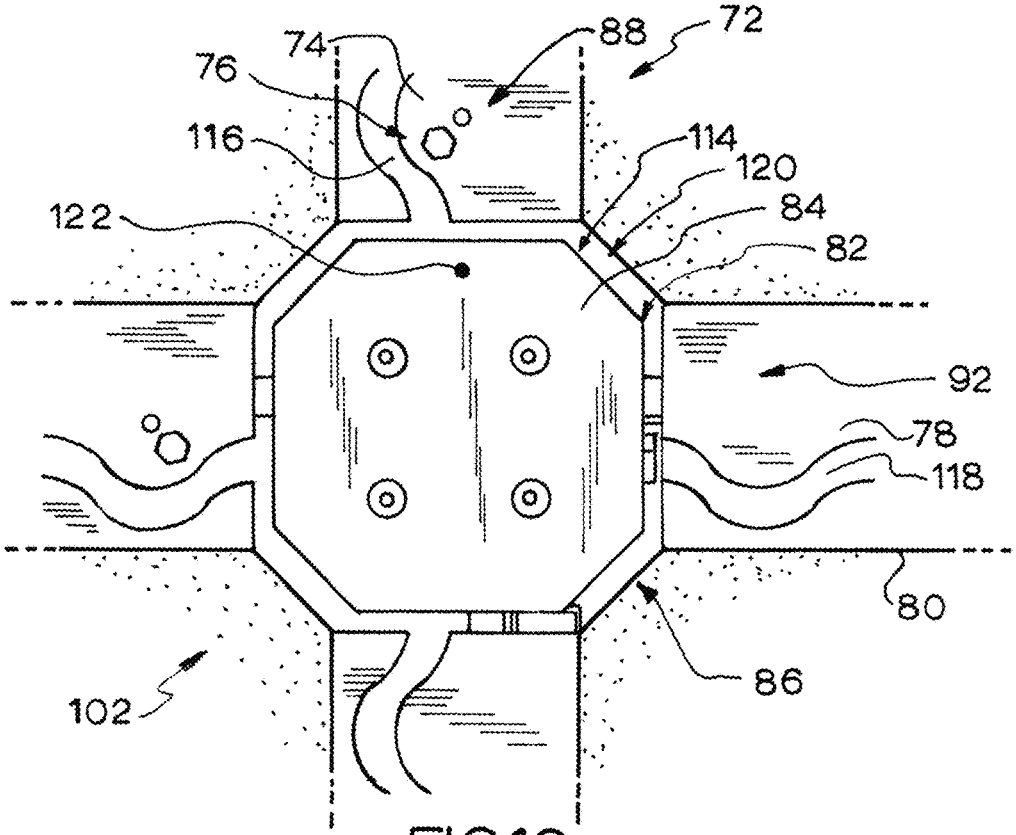
FIG. 16 shows a top view of an intersection module providing a continuous perimeter joint line.

As shown in FIGS. 9 and 10, the upper leg 54 may be provided with an aperture 66 for receiving a support stake 68, for supporting the armoured joint relative to a ground surface, and the lower leg 56 may be provided with an aperture 70 for receiving the support stake 68. The aperture 66 of the upper leg 54 and the aperture 70 of the lower leg 56 are arranged to receive the support stake 68 with the support stake 68 in a substantially perpendicular orientation relative to a plane of the first plate 22. In other words, the support stake 68 may be substantially vertical whereas the first plate 22 is substantially horizontal.

Turning to FIG. 10, the apertures 66, 70 and the support stake 68 are arranged to provide a sliding condition (see left-hand side of FIG. 10) in which the stake 68 is able to be slid relative to the bracket 50 and a locked condition (the right-hand side of FIG. 10) in which the stake 68 is locked against sliding relative to the bracket 50. This may be achieved, as shown, by configuring the apertures 66, 70 each as an elongated slot, with the stake 68 having a cross-section with parallel straight sides. In this way, the stake 68 is rotated about its longitudinal axis relative to the bracket 50 between the sliding condition and the locked condition.

The upper leg 54 may meet the lower leg 56 at a bent portion of the bracket 50, as shown in FIG. 9. Alternatively, the upper leg 54 may meet the lower leg 56 at an intermediate vertical section between the upper leg 54 and the lower leg 56. The bracket 50 may be symmetrical in a horizontal central plane.

There may also be provided the armoured joint together with the stake in an assembly. In other words, there may be provided an assembly including an armoured joint as described above, in combination with a stake, wherein the stake extends through the upper leg and the lower leg.

As shown clearly in FIG. 10, the stake 68 is non-circular and the aperture 66, 70 in each of the upper leg 54 and lower leg 56 is non-circular. In this way, the stake 68 is able to be rotated relative to the bracket 50 between a sliding condition, in which the stake 68 is able to be slid relative to the bracket 50, and a locked condition, in which the stake 68 is locked against sliding relative to the bracket 50.

The first anchorage part 18 may include the elongated angled anchorage lacer bar 38, the elongated angled anchorage lacer bar 38 being supported by a series of spaced ribs 40 and the lacer bar 38 being tilted out of the plane of the ribs 40.

The first anchorage part 18 may define the support surface 30 to support the second plate 24 as the second anchorage part 20 is moved between the close configuration and the spaced configuration. In the close configuration, an interface between the first edge 26 and the second edge 28 is offset relative to the joint 16 between the first component 12 and the second component 14 such that the interface of the first edge 26 and the second edge 28 is positioned above (and supported by) the support surface 30.

Each of the apertures 66, 70 may be in the shape of a slot (see FIG. 10), and the stake 68 may have a cross-sectional shape having opposed parallel flat sides connected at either end by a round portion.

Accordingly, as will be appreciated from the above, this aspect relates to:

Mirrored angled legs 54, 56 of the stake bracket 50 provide stronger support for heavier joints. They resist skewing under weight by requiring the angled leg to overcome the mirrored angle of the opposing leg of the bracket 50 before skewing.

Angled nature of bracket 50 moves fixing points on separation plate both higher (on top) and lower (on bottom) to help brace the joint where it is required.

Stake brackets 50 have slots 66, 70 which work with twist-and-lock stakes 68 for joint height adjustment, levelling and lock-off.

4. Floating Cover Plate System on Intersection

With reference to FIGS. 11 to 15 and FIGS. 50 to 60, there is disclosed an edge protection system 72 having a floating cover plate system on an intersection. Advantageously, the floating cover plate system provides a centralised cover plate which allows concrete slab sections at the intersection to open away from the cover plate, leaving the cover plate fixed in place.

More specifically, there is shown an edge protection system 72 including a first expandable armoured joint 74 to protect a first joint 76 extending in a first direction, a second expandable armoured joint 78 to protect a second joint 80 extending in a second direction and an intersection module 82 including a cover plate 84 located at an intersection 86 of the first expandable armoured joint 74 and the second expandable armoured joint 76. The first expandable armoured joint 74 and the second expandable armoured joint 78 may each be in the form of a joint edge protection apparatus 10 as described above.

The first expandable armoured joint 74 includes a first pair of plates 88 arranged to be moved apart to open a crevice 90 between the plates in response to expansion of the first joint 76, and the second expandable armoured joint 78 includes a second pair of plates 92 arranged to be moved apart to open a crevice 94 between the plates 92 in response to expansion of the second joint 80. Each of the first pair of plates 88 has a wavy edge 96, the wavy edges 96 being brought together in a contracted condition of the first expandable armoured joint 74. Each of the second pair of plates 92 also has a wavy edge 96, the wavy edges 96 being brought together in a contracted condition of the second expandable armoured joint 78.

The cover plate 84 is removable from a remainder of the intersection module 82.

The edge protection system 72 includes an anchored support 98 for supporting the intersection module 82 relative to a ground surface. An upper support 100 of the intersection module 82 is adapted to receive the cover plate 84 fastened thereto. The anchored support 98 anchors the intersection module 82 in a fixed location relative to the ground surface during expansion of the first expandable armoured joint 74 and the second expandable armoured joint 78.

In the example shown, the first joint 76 is a joint between concrete slab sections 102 and the second joint 80 is also a joint between concrete slab sections 102. The cover plate 84 is a load supporting member being braced by each slab section 102 when the slab sections 102 move through slab shrinkage. In particular, it is typical for the slab sections 102 to shrink during drying of the concrete. More specifically, the cover plate 84 is a load supporting member being braced by each slab section 102 when the slab sections 102 move through slab shrinkage with each slab moving up to 20 mm. This support may be achieved by way of the intersection module 82 having a separate anchorage part 104 for each of the separate slab sections 102, such that each anchorage part 104 is cast into a respective one of the slab sections 102. In turn, the anchorage parts 104 are vertically supported by a central lower shoulder 106 and a central upper shoulder 108 of the intersection module 82.

The intersection module 82 includes a central support column 110, the central support column 110 having an upper support plate (in the form of central upper shoulder 108) and a lower anchor plate (in the form of central lower shoulder 106), the cover plate 84 being fastened to the upper support plate 108 so as to be connected to the central support column 110 and the lower anchor plate 106 to remain vertically coupled to the concrete slab sections 102.

The edge protection system 72 includes a stake 112 which is inserted through the central support column 110 for supporting the intersection module 82 relative to the ground surface. The upper support plate (central upper shoulder 108) may be in the form of an upper cleat plate which is spaced vertically from the lower anchor plate (central lower shoulder 106).

The stake 112 may be in the form of a star picket. The stake 112 may be arranged to prevent the central support column 110 from rotating relative to the ground surface and from translational movement relative to the ground surface, as depicted by arrows in FIGS. 14 and 15. The cleat plate 108 and the lower anchor plate 106 restrict movement of the star picket angularly at spaced locations of the central support column 110.

In the example shown in the drawings, the first direction is not parallel to the second direction such that the first joint 76 is not parallel to the second joint 80. More specifically, in the example shown in the drawings, the first direction is perpendicular to the second direction such that the first joint 76 is perpendicular to the second joint 80.

Accordingly, as will be appreciated from the above, this aspect relates to:

- A centralised cover plate 84 which allows the slab sections 102 at the intersection 86 to open away from the cover plate 84, leaving the cover plate 84 fixed in place.
- The cover plate 84 is load supporting, being braced by each slab section 102 when the slab sections 102 move through slab shrinkage up to 20 mm.
- Anchor plate is fixed down without studs, using its connection to the central support column 110 and bottom anchor plate 106 to remain fixed to the concrete slab.
- The top cover plate 84 can be removed, and the star picket 112 can be hammered down the central column 110 through the guide holes in the top cleat plate 108 and the bottom anchor plate 106 acting like an axis to fix and support the top plate assembly. The star picket 112 can be hammered flush with the top cleat plate 108 before replacing the top cover plate above to cover.
- The star picket 112 prevents the central assembly from rotating and fixes it laterally in both 'X' and 'Y' directions.
- The guides at the cleat plate (top) 108 and anchor plate (bottom) 106 restrict movement against the star picket 112 angularly at opposite ends of the assembly.

5. Intersection Continuous Perimeter Joint Line

With reference to FIGS. 16 to 19 and FIGS. 61 to 64, there is shown an edge protection system 72 having an intersection continuous perimeter joint line 114. Advantageously, this feature results in the joint line circling a perimeter of the centralised cover plate 84 to the next joint run rather than continuing directly across the intersection module 82 meaning that, no matter where infill lengths of the wavy plates 88, 92 are cut, they will connect to the active joint line at the intersection module 82.

More specifically, as shown in the drawings, there is depicted an edge protection system 72 including a first expandable armoured joint 74 to protect a first joint 76 extending in a first direction and a second expandable armoured joint 78 to protect a second joint 80 extending in a second direction. The edge protection system 72 also includes an intersection module 82 at an intersection 86 of the first expandable armoured joint 74 and the second expandable armoured joint 78. The first expandable armoured joint 74 has a first joint line 116 and the second expandable armoured joint 78 has a second joint line 118. The intersection module 82 provides a perimeter joint line 120 such that there is a continuous joint line including the first joint line 116, the perimeter joint line 120 and the second joint line 118.

The intersection module 82 includes the cover plate 84, and the continuous joint line extends at least partially around a perimeter of the cover plate 84 between the first joint line 116 and the second joint line 118.

The first joint line 116 has a generally wavy form and the second joint line 118 also has a generally wavy form. The cover plate 84 is arranged such that, regardless of where lengths of the wavy first and second plate pairs 88, 92 are cut, the wavy first joint line 116 and the wavy second joint line 118 will connect to the active joint line of the intersection module 82. In one form, the cover plate 84 is arranged to ensure that joint lines are matched to standard joint runs.

Figure 17:
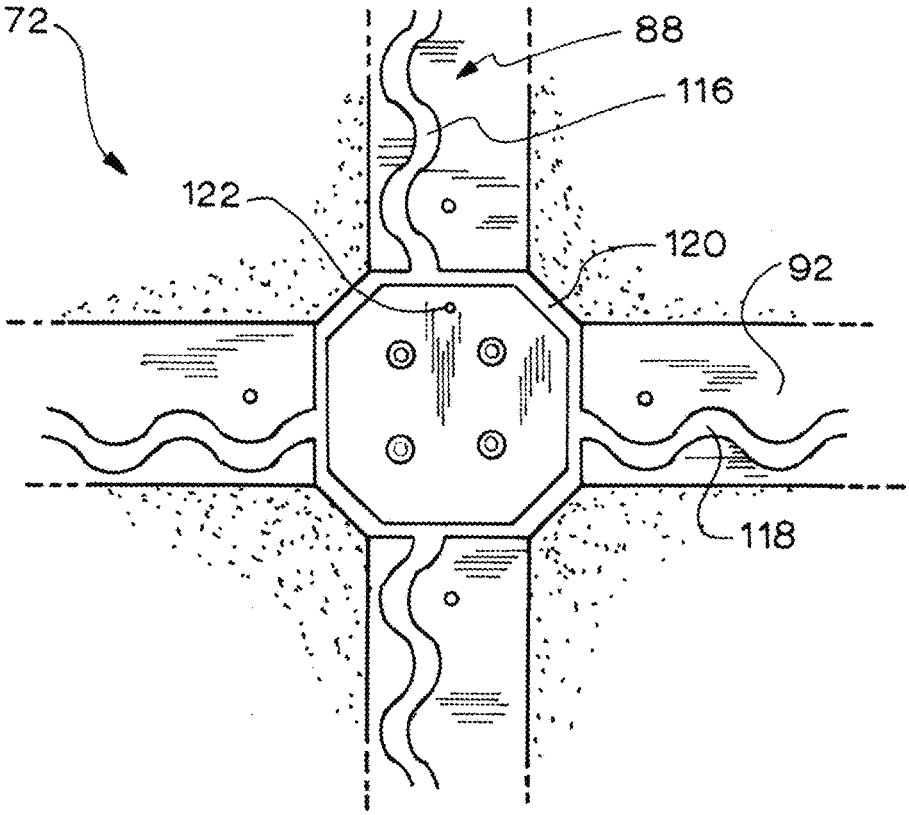
FIG. 17 shows a top view of the intersection module shown at a four-way intersection of joint gap openings.
Figure 18:
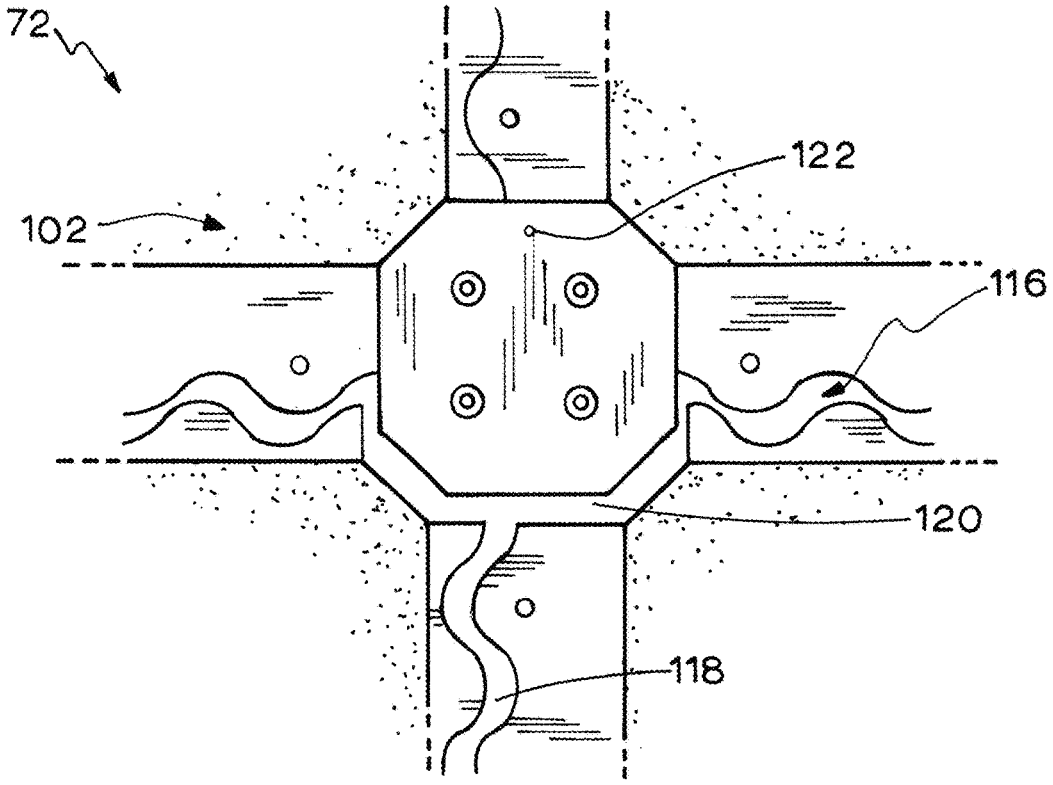
FIG. 18 shows a top view of the intersection module shown at a three-way intersection of joint gap openings.
Figure 19:
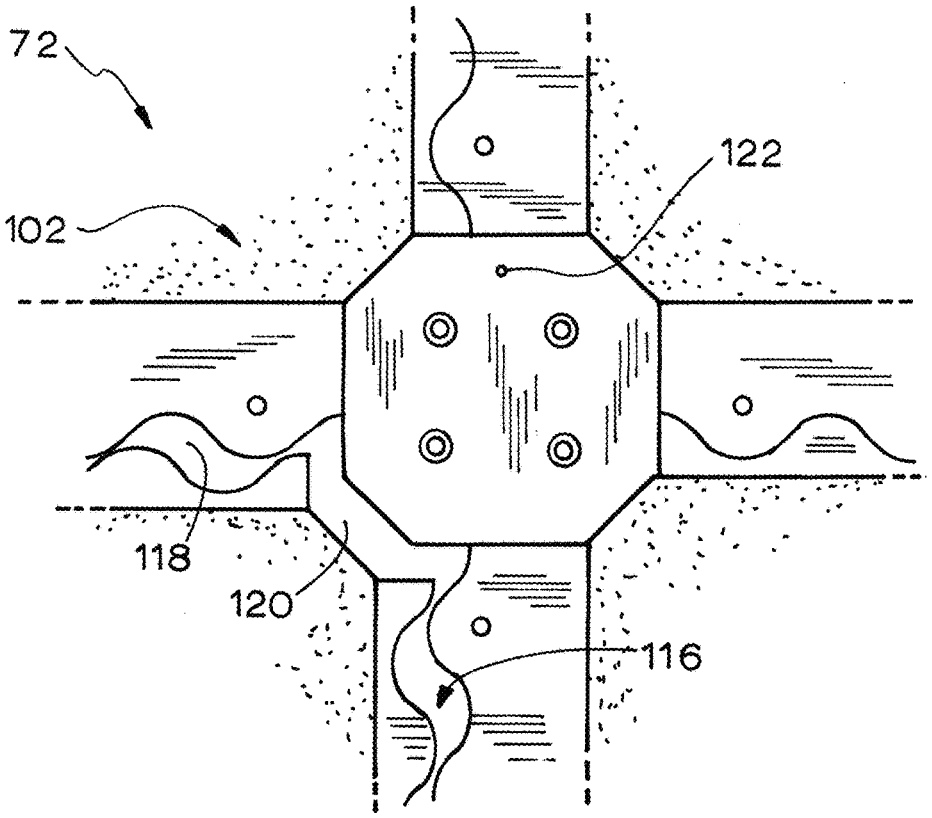
FIG. 19 shows a top view of the intersection module shown at a two way intersection of joint gap openings.
Figure 20:
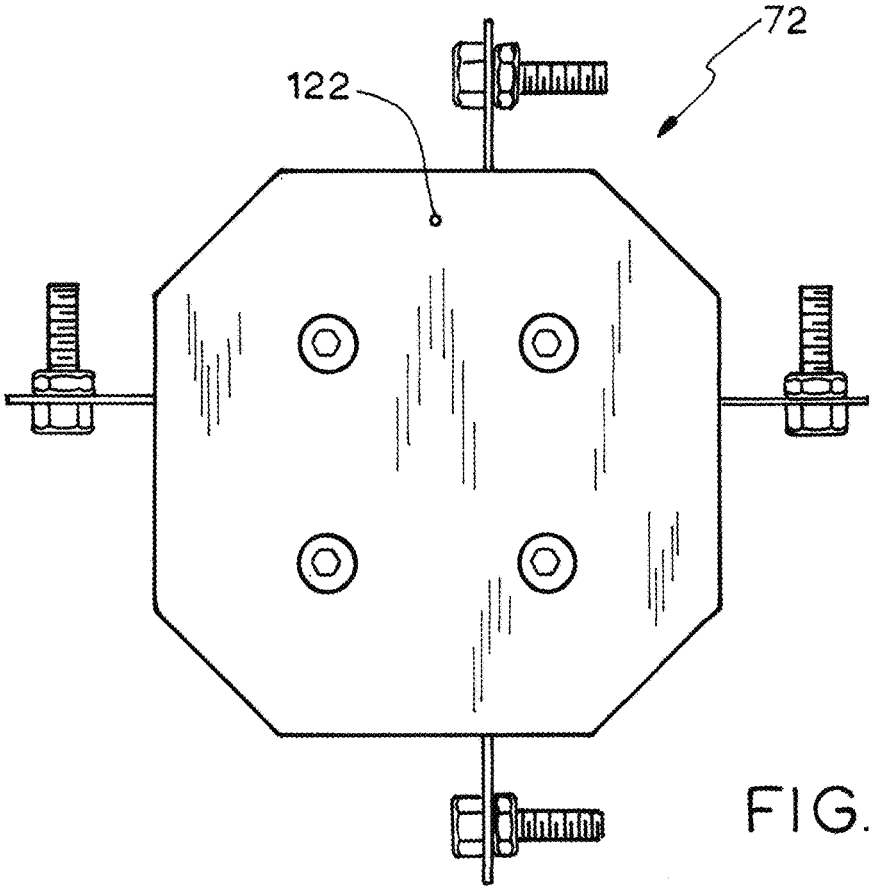
FIG. 20 shows a top view of the intersection module having a joint orientation marker on the top plate.
Figure 21:
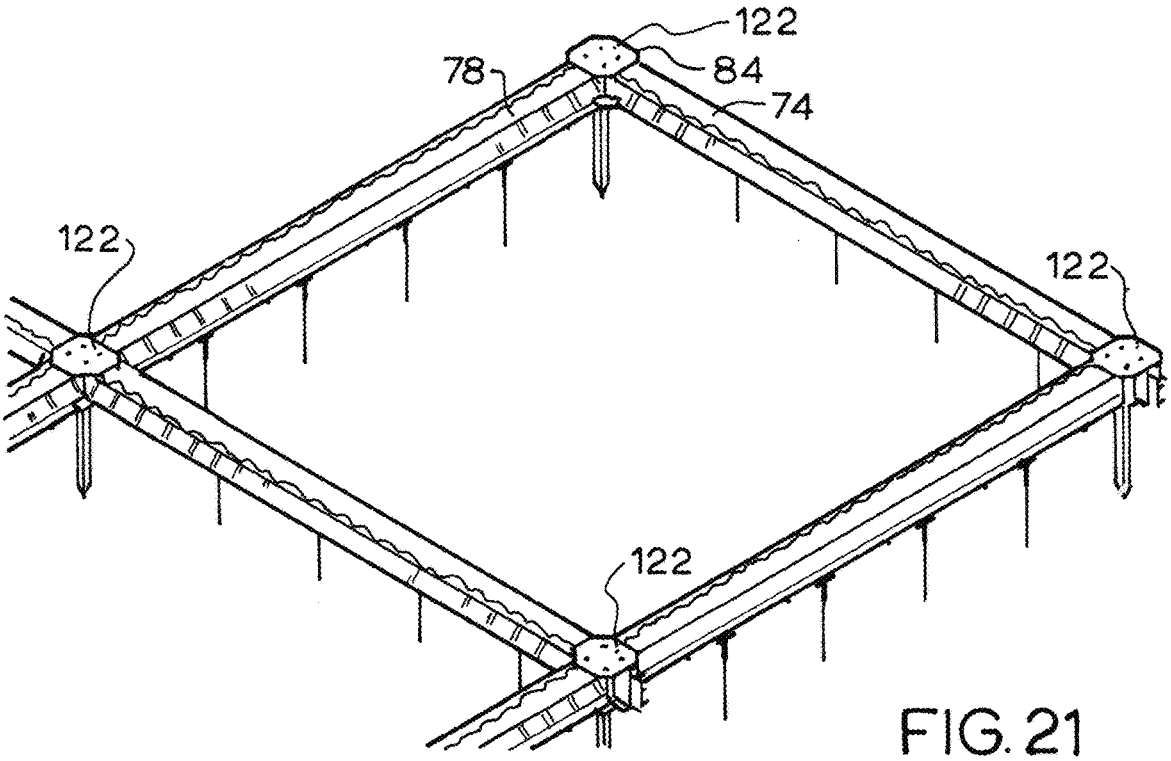
FIG. 21 shows a top perspective view of an edge protection system having a plurality of intersection modules, each of the intersection modules having a marker oriented in a common direction.

As will be appreciated by those skilled in the art, joint openings at the perimeter of the cover plate 84 are halved in thickness when used in a four-way intersection configuration, as shown in FIG. 17. In particular, a joint gap may be split up on either side of the cover plate 84. The edge protection system 72 may also be used at a three-way intersection configuration as shown in FIG. 18 or a two-way intersection configuration as shown in FIG. 19.

Accordingly, as will be appreciated from the above, this aspect relates to:

- The joint line does not continue directly across the intersection module, it instead circles the perimeter of a centralised cover plate 84 to the next joint run.
- A perimeter joint line means that no matter where infill lengths of the wavy plates 88, 92 are cut, they will connect to the active joint line of the intersection module 82.
- Joint lines 116, 118 are never mismatched to standard joint runs.
- Joint gap openings at the perimeter of the central plate 84 are halved when used in 4-way intersection configuration (most common). The joint gap is split up on either side of the central plate 84.

6. Joint Orientation Marker on Intersection

With reference to FIGS. 20 to 25 and FIGS. 65 to 69, there is also disclosed an edge protection system 72 having a joint orientation marker 122 to ensure correct orientation of the intersection module 82, rotationally about a central axis of the intersection module 82.

In particular, the edge protection system 72 includes a first expandable armoured joint 74 to protect a first joint 76 extending in a first direction and a second expandable armoured joint 78 to protect a second joint 80 extending in a second direction. The edge protection system 72 also includes an intersection module 82 at an intersection 86 of the first expandable armoured joint 74 and the second expandable armoured joint 78. The intersection module 82 has an indicator 122 to enable a user to ensure correct orientation of the intersection module 82.

The intersection module 82 includes a cover plate 84 which is generally symmetrical in shape. In particular, as shown in the drawings, the cover plate 84 is generally octagonal in shape.

The indicator 122 may be in the form of a discreet marking. In one particular form, the indicator 122 may be in the form of a small hole in the cover plate 84. The indicator 122 is provided to enable a user to orientate joints during installation on-site in a common direction to ensure joint lines match.

This is important as although the cover plate 84 itself appears to be symmetrical from above, the components of the intersection module 82 below the cover plate 84 are not symmetrical. Specifically, it is important that the anchorage parts 104 of the intersection module 82 align with the joints of the concrete slab sections 102, as well as with the anchorage parts 104 of the other intersection modules 82 within the edge protection system 72.

In a method of installation, the indicator 122 is positioned in one of four rotational orientations on a first intersection module 82 on-site depending upon a first pour location. Subsequent intersection modules 82 within the same edge protection system 72 (see FIG. 21) are placed each with the respective indicator 122 oriented in the same direction as for the first intersection module 82.

Figure 22:
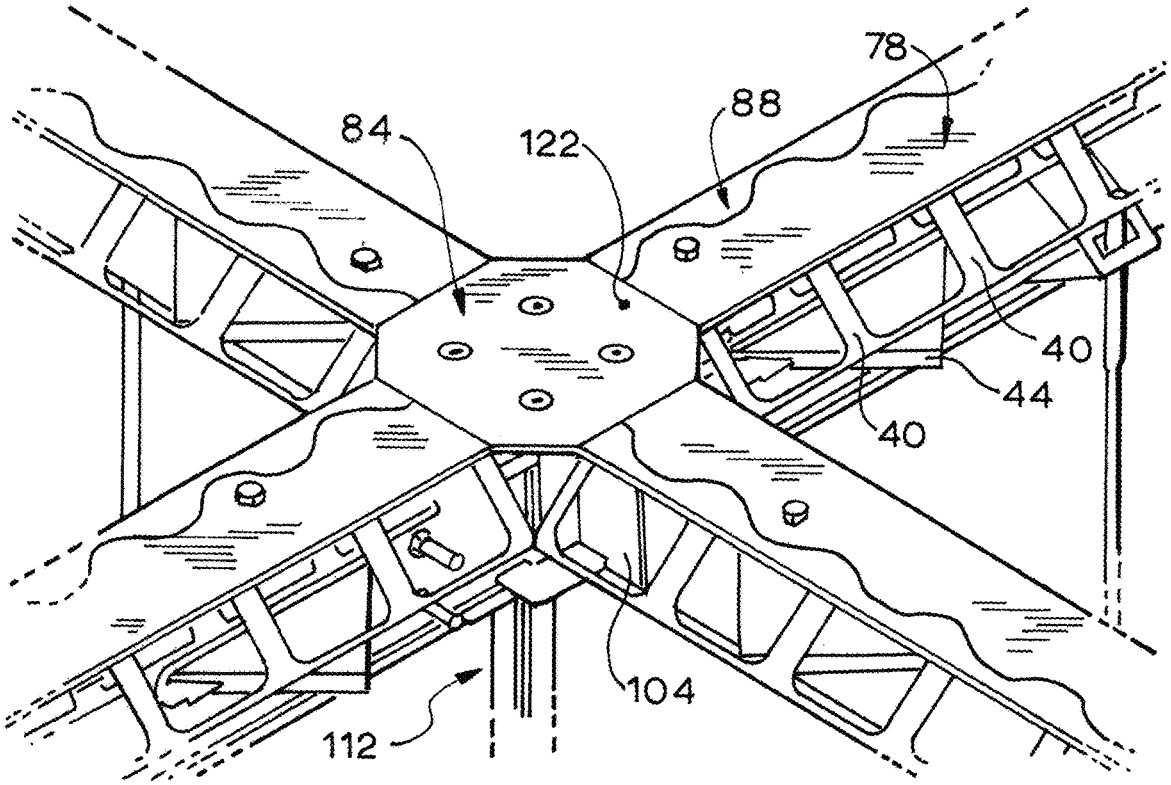
FIG. 22 shows a top perspective view of the edge protection system in a four-way intersection, showing orientation of the marker.
Figure 23:
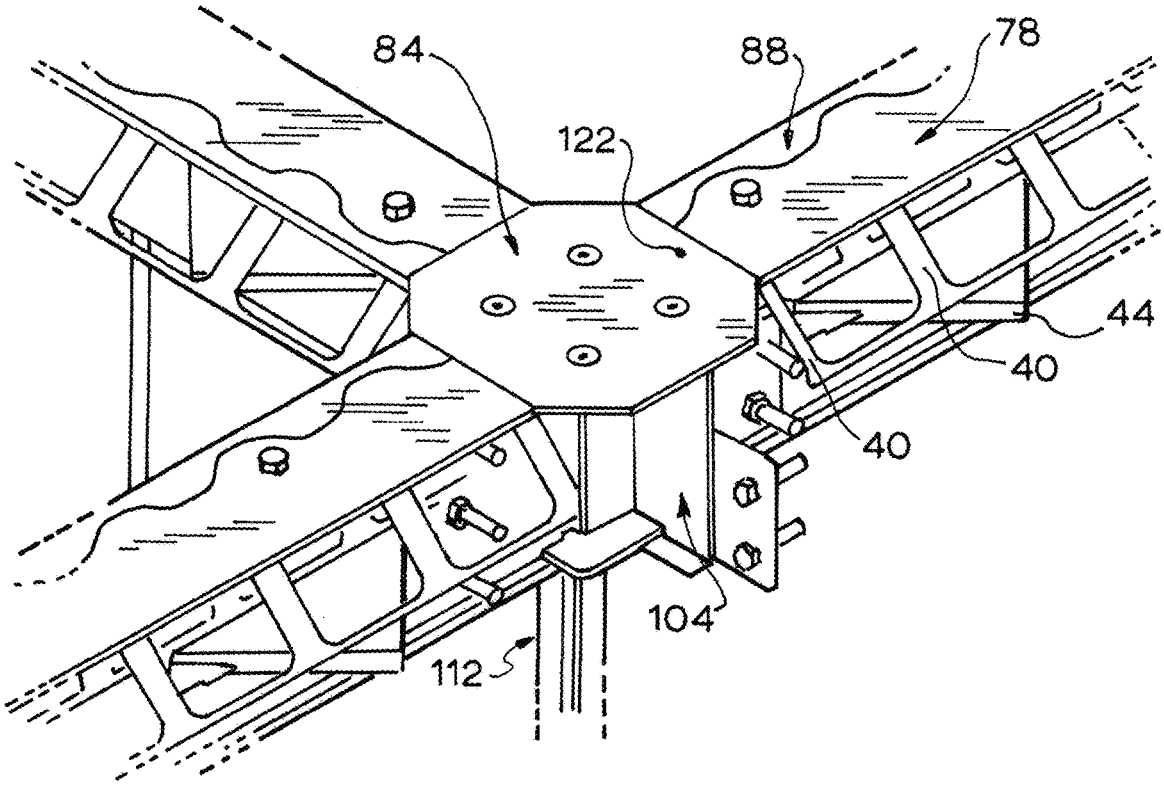
FIG. 23 shows a top perspective view of the edge protection system in a three-way intersection, showing orientation of the marker.
Figure 24:
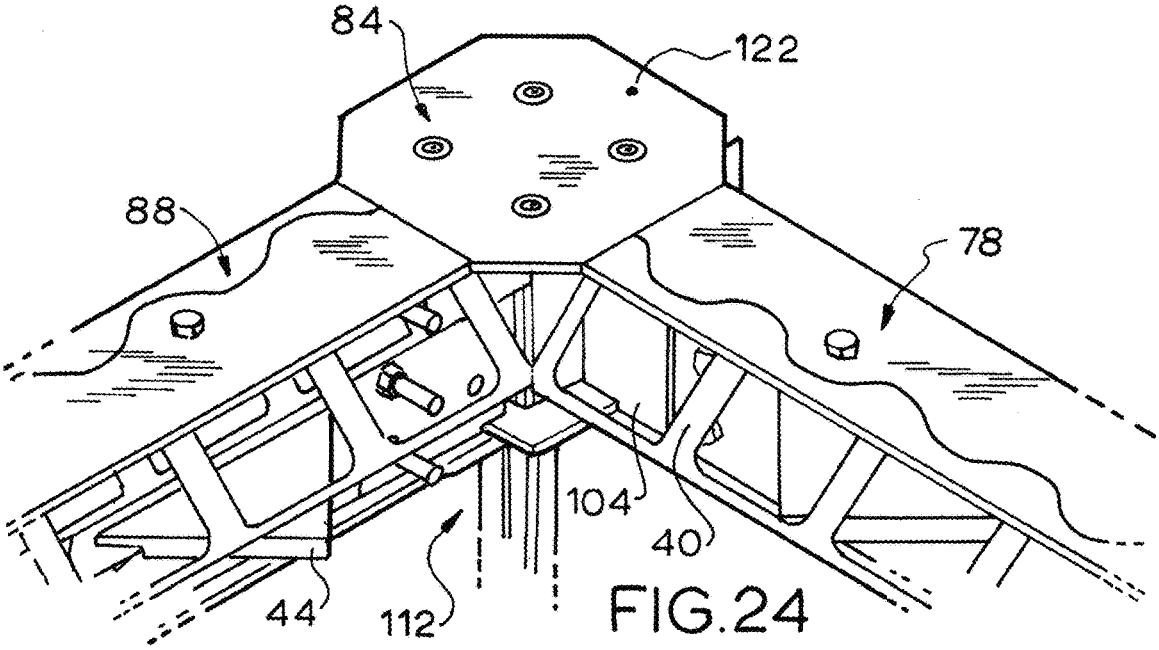
FIG. 24 shows a top perspective view of the edge protection system in a two way intersection, showing orientation of the marker.

The intersection module 82 may be arranged to allow for two-way, three-way and four-way intersections to be formed without adjusting orientation of the intersection module 82. FIG. 22 shows a four-way intersection, FIG. 23 shows a three-way intersection and FIG. 24 shows a two-way intersection.

Figure 25:
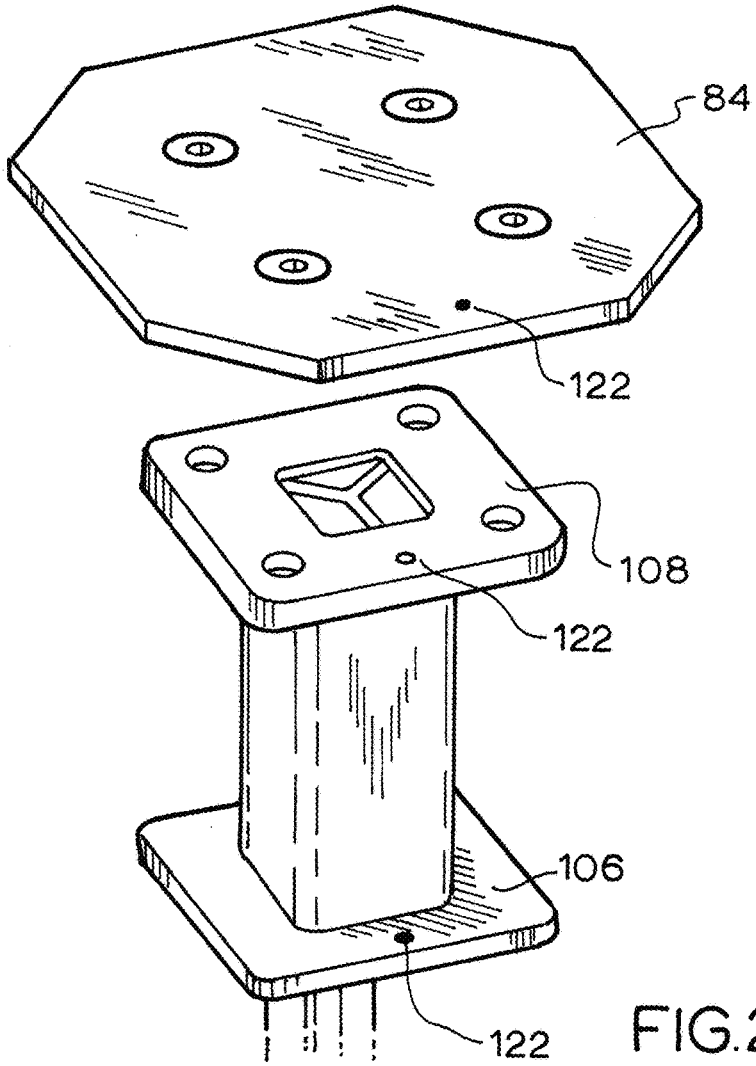
FIG. 25 shows the marker being replicated on multiple components of the intersection module to ensure correct relative orientation/alignment of the components.
Figure 26:
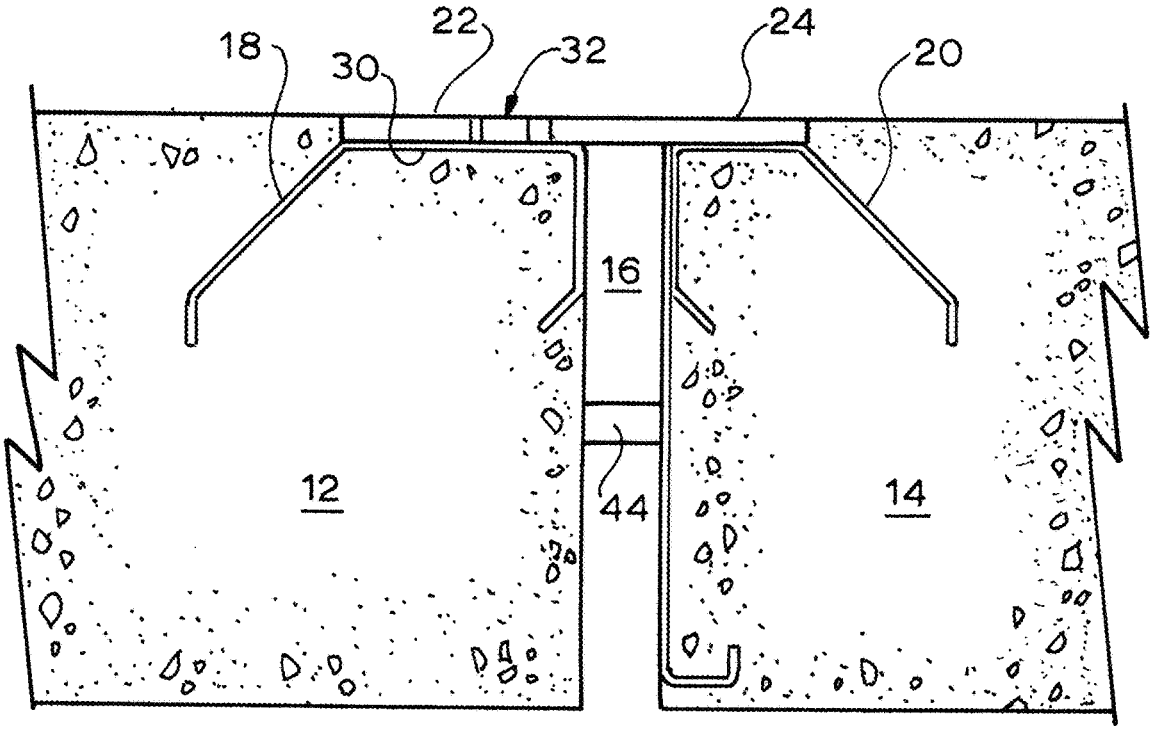
FIG. 26 shows fully bridged wave plates—end view (offset joint lines)
Figure 27:
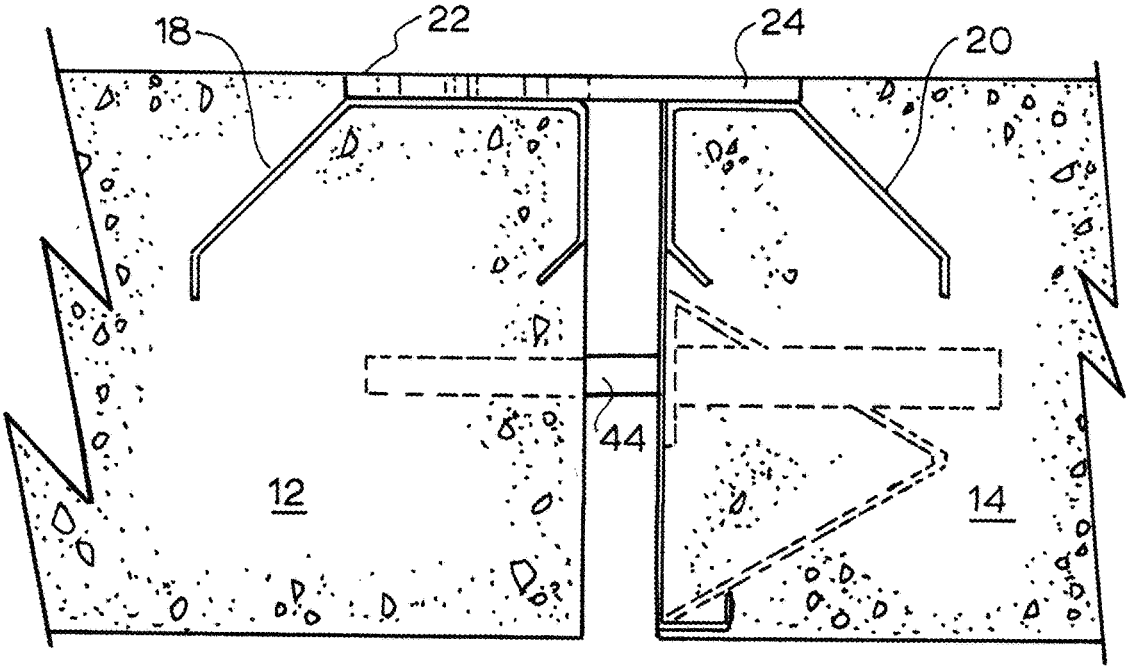
FIG. 27 shows fully bridged wave plates—end view (offset joint lines with hidden)
Figure 28:
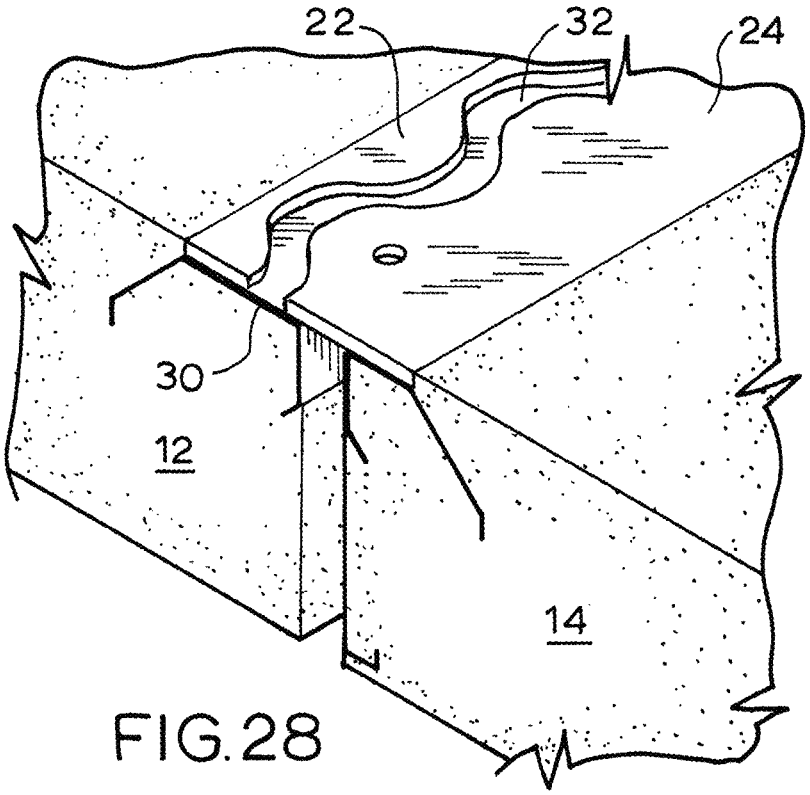
FIG. 28 shows fully bridged wave plates—perspective (offset joint lines)
Figure 29:
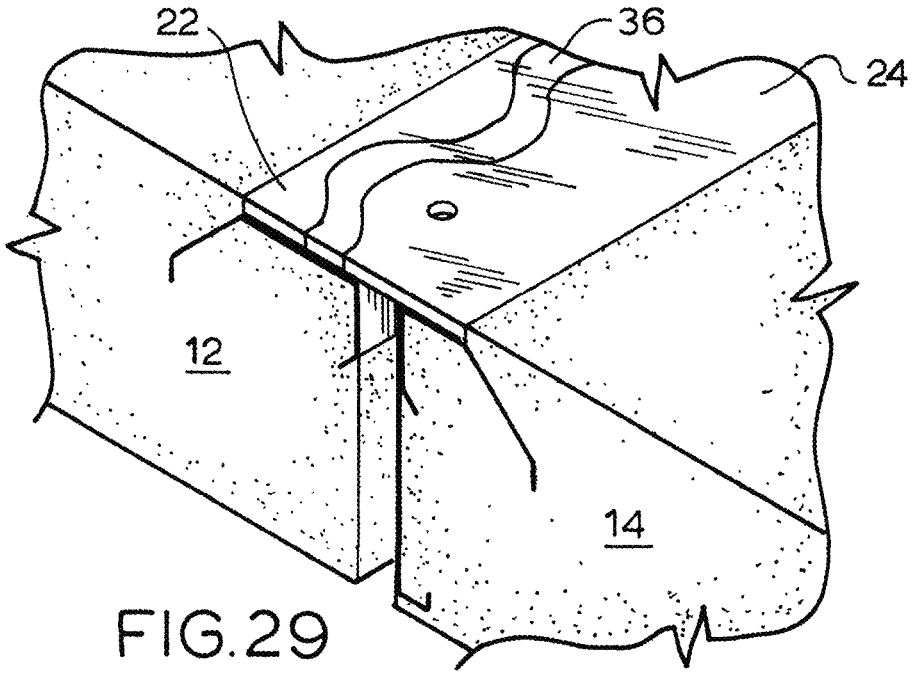
FIG. 29 shows fully bridged wave plates—perspective (offset joint lines, with filler)
Figure 30:
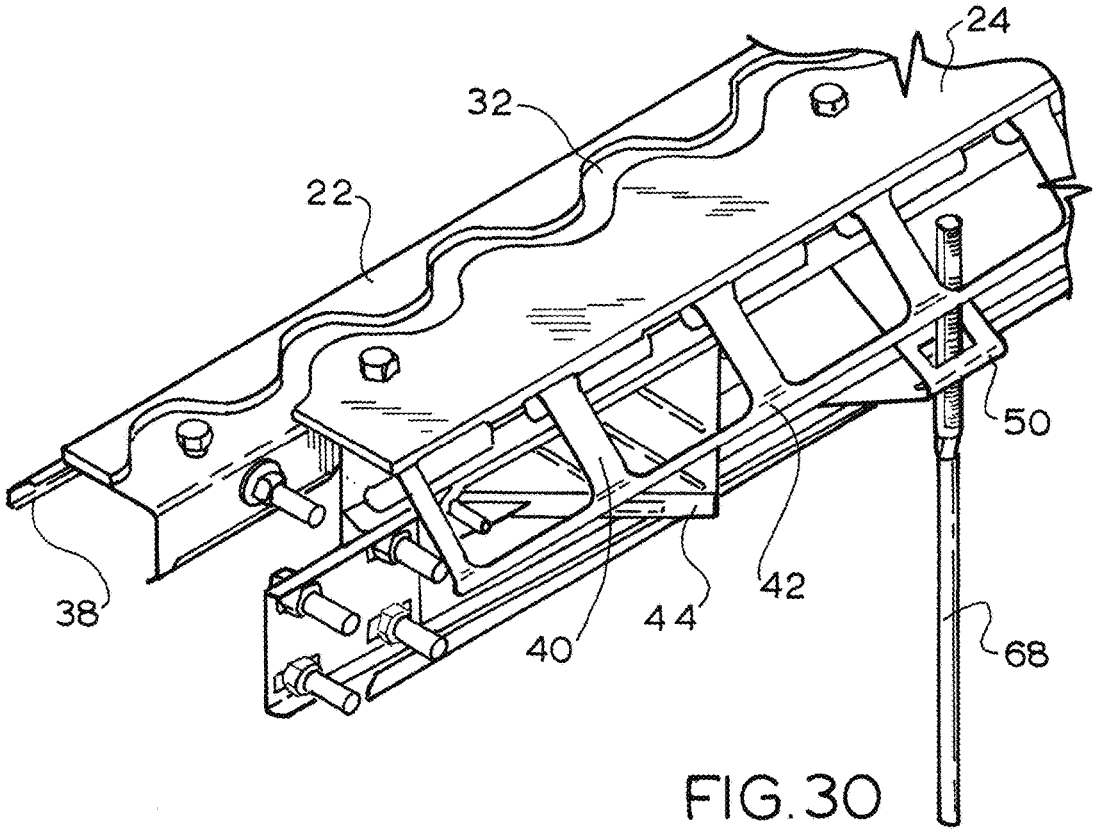
FIG. 30 shows fully bridged wave plates—perspective (open)
Figure 31:
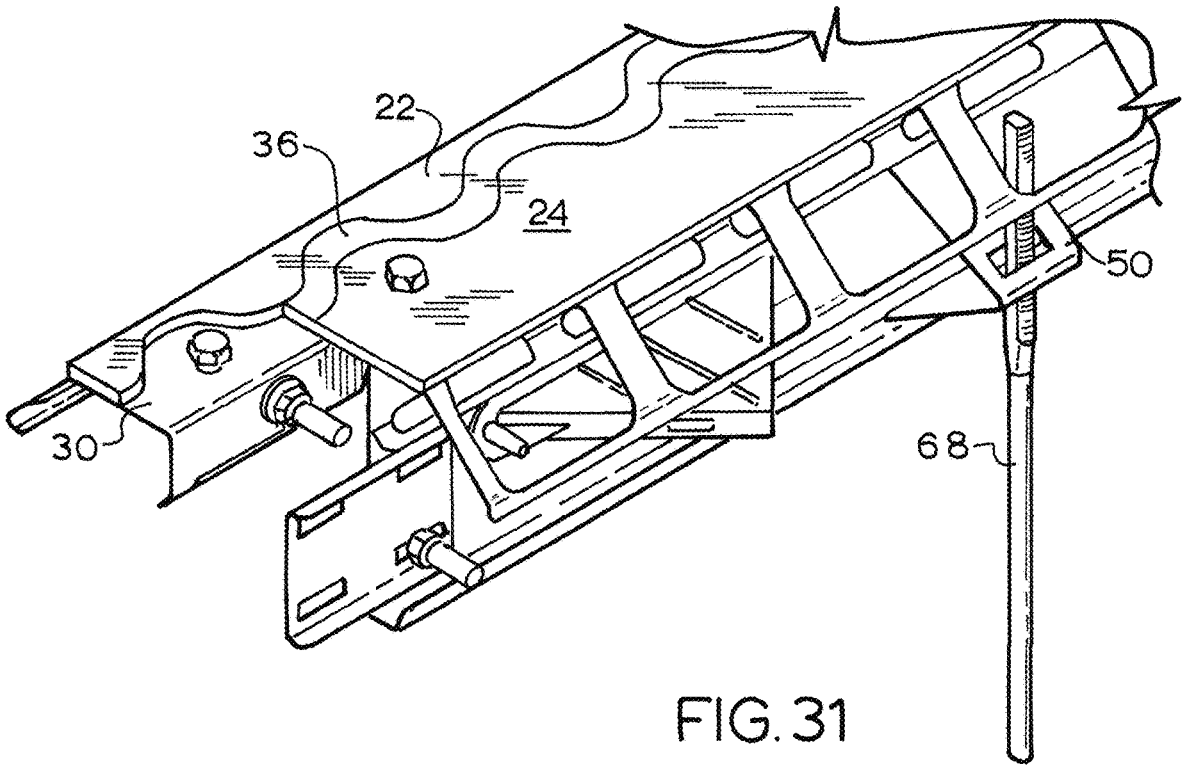
FIG. 31 shows fully bridged wave plates—perspective (open, with filler)
Figure 32:
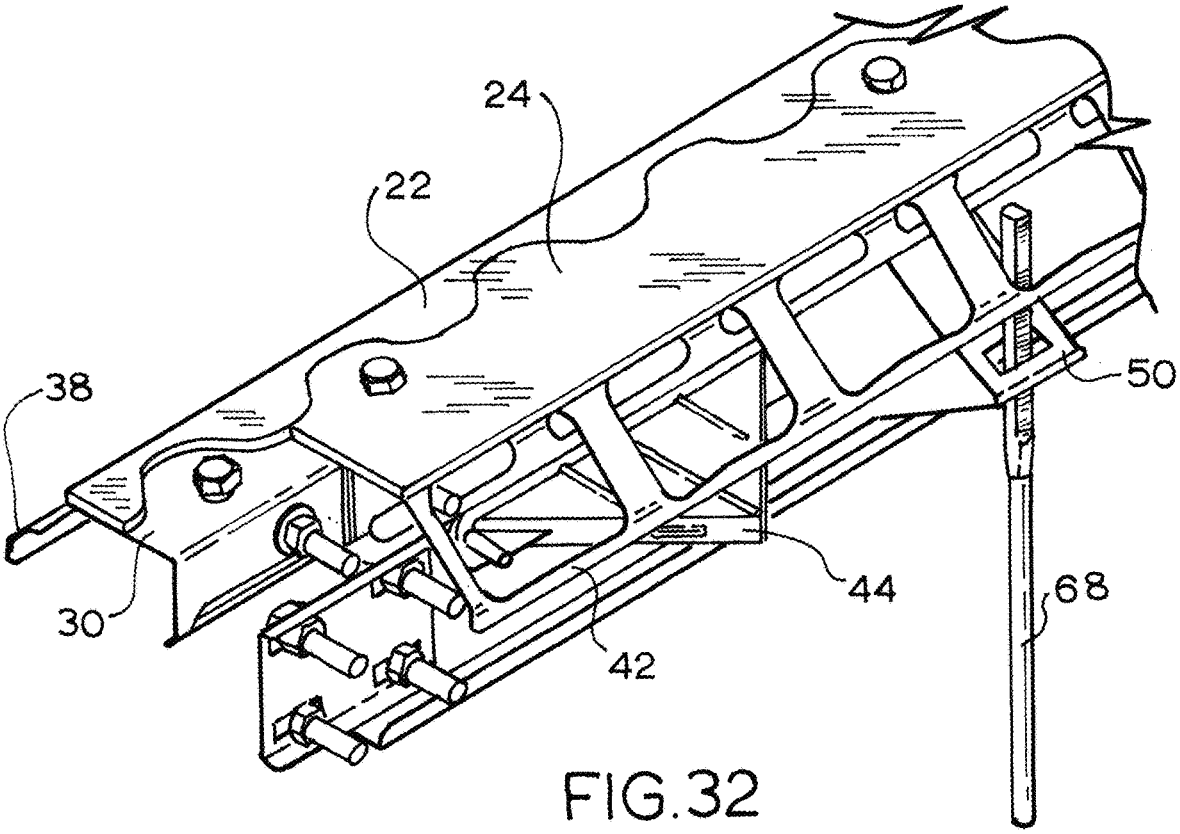
FIG. 32 shows fully bridged wave plates—perspective (closed)
Figure 33:
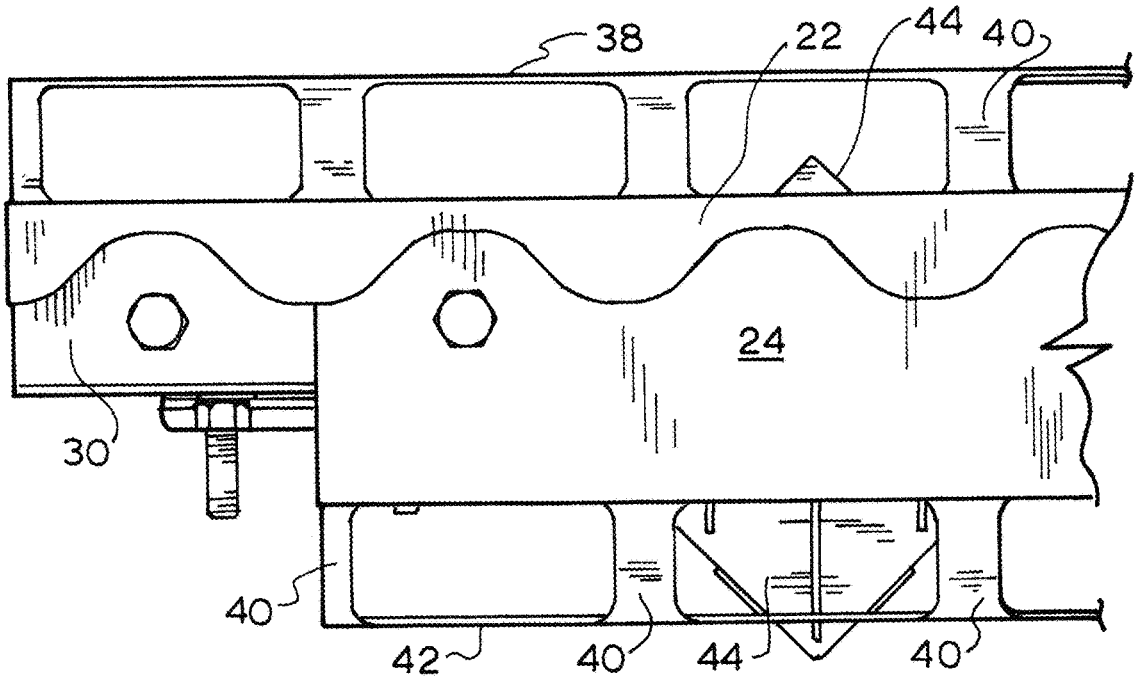
FIG. 33 shows fully bridged wave plates—plan view (closed)
Figure 34:
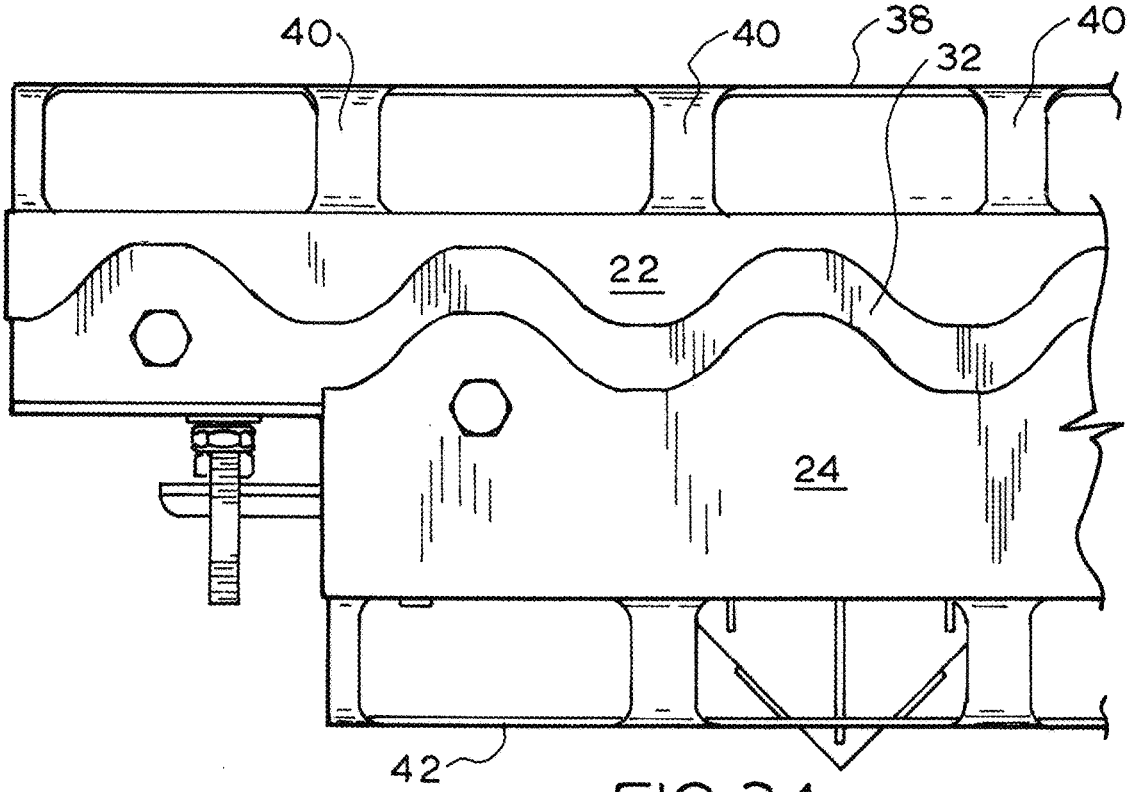
FIG. 34 shows fully bridged wave plates—plan view (open)
Figure 35:
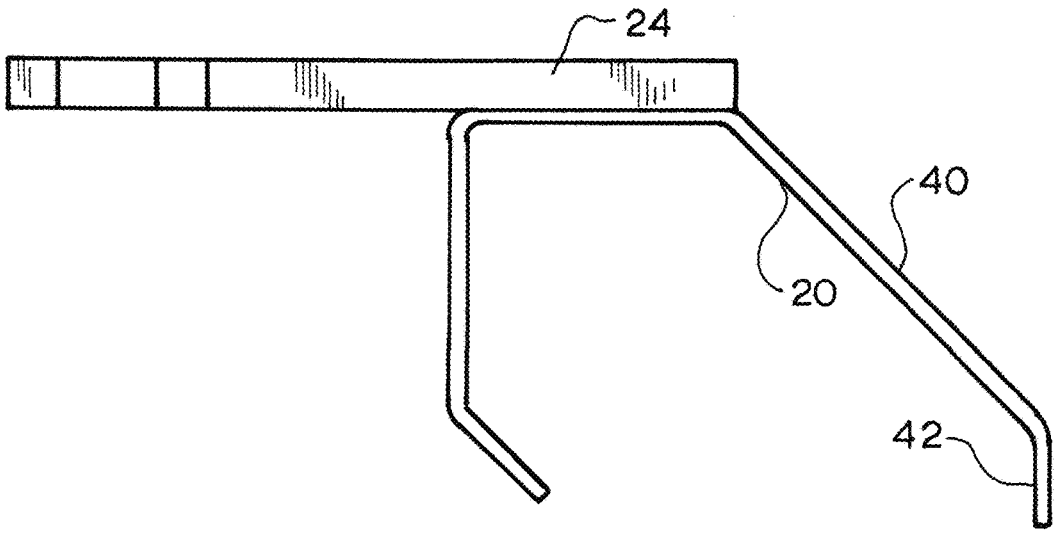
FIG. 35 shows disruptive folded anchor rail—end view (simples, one side)
Figure 36:
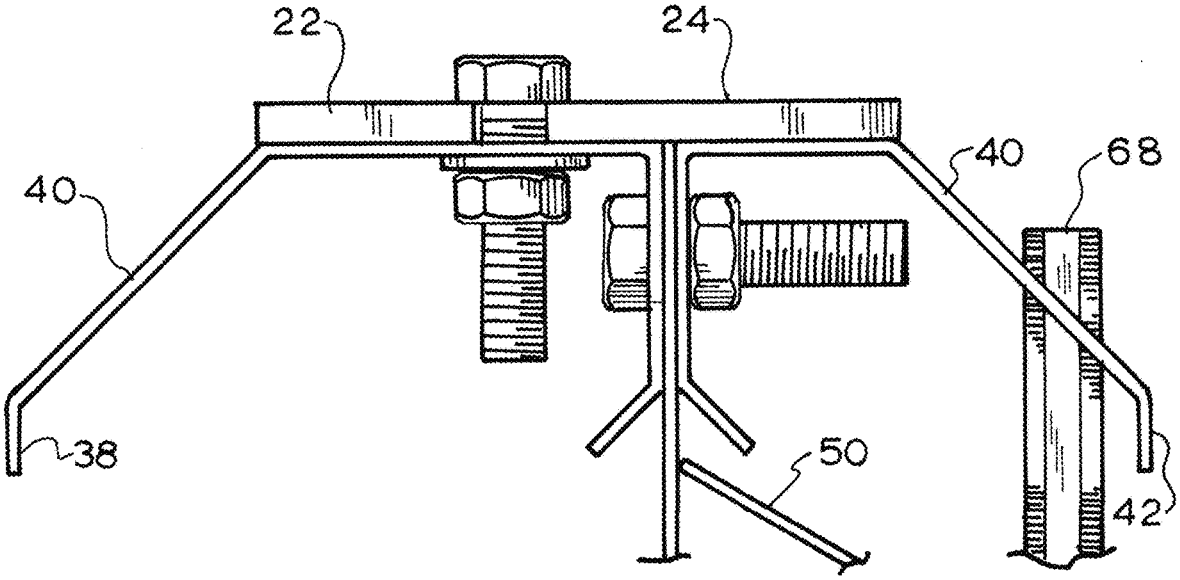
FIG. 36 shows disruptive folded anchor rail—end view.
Figure 37:
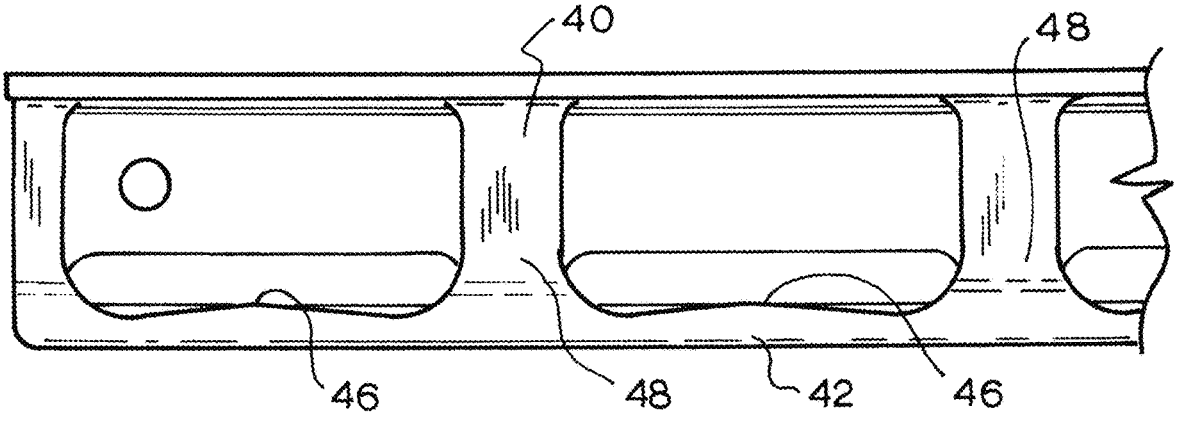
FIG. 37 shows disruptive folded anchor rail—front view.
Figure 38:
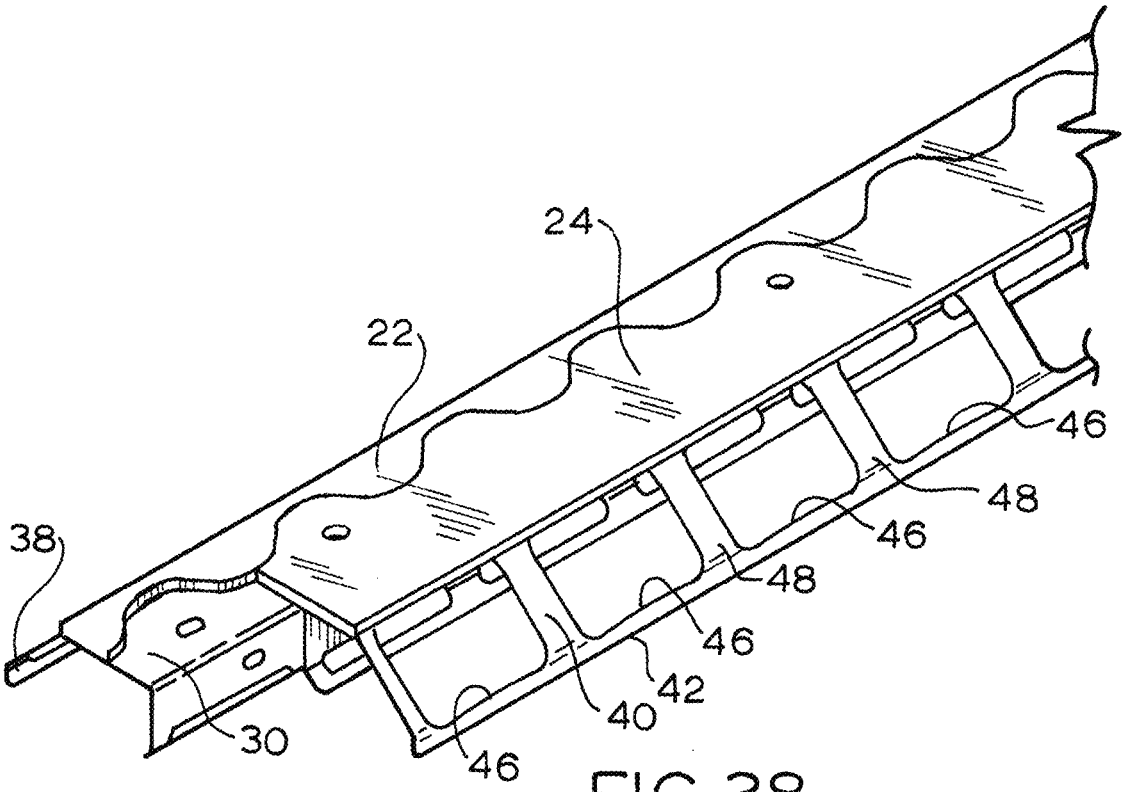
FIG. 38 shows disruptive folded anchor rail—perspective (full joint, simple)
Figure 39:
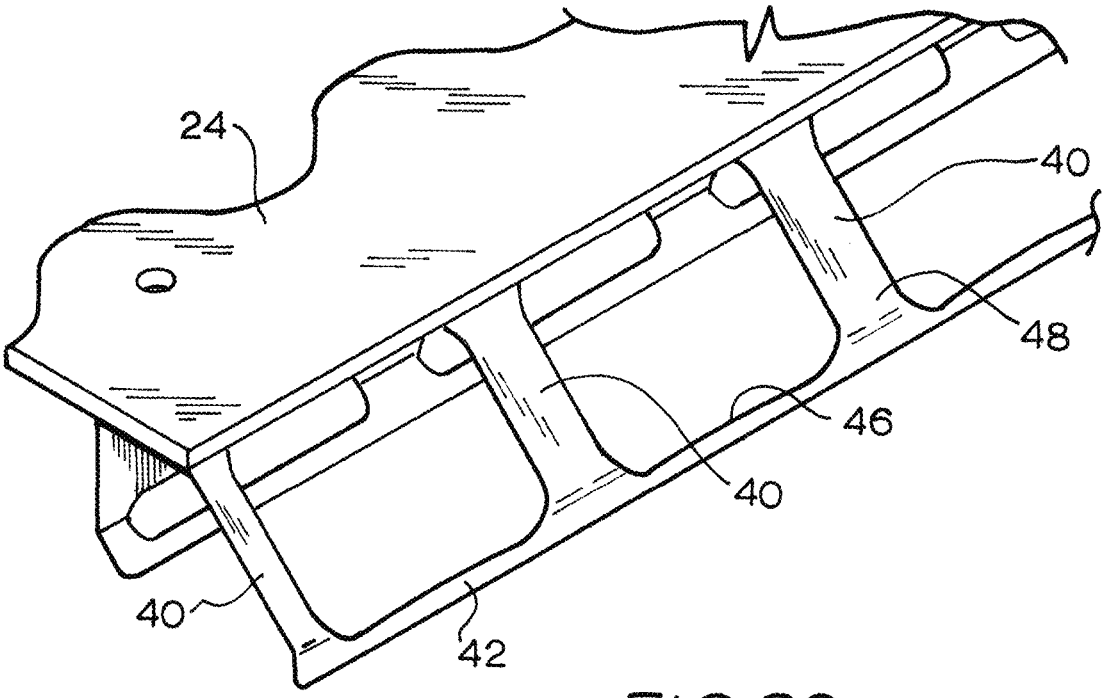
FIG. 39 shows disruptive folded anchor rail—perspective (one side)
Figure 40:
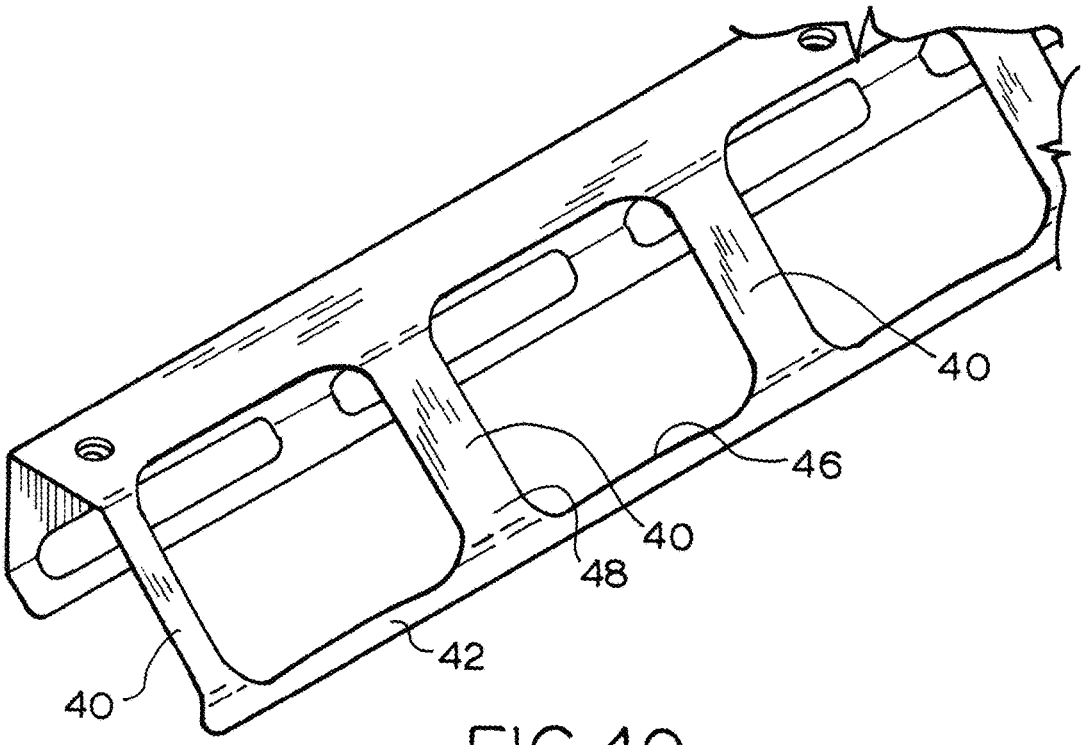
FIG. 40 shows disruptive folded anchor rail—perspective (one side, rail only)
Figure 41:
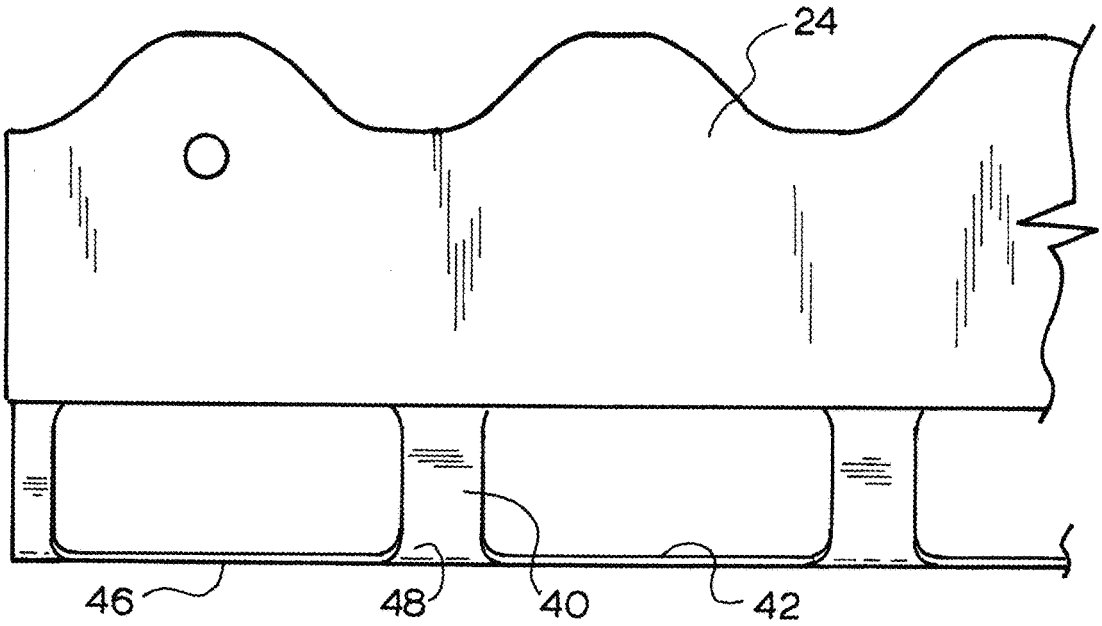
FIG. 41 shows disruptive folded anchor rail—top view (one side)
Figure 42:
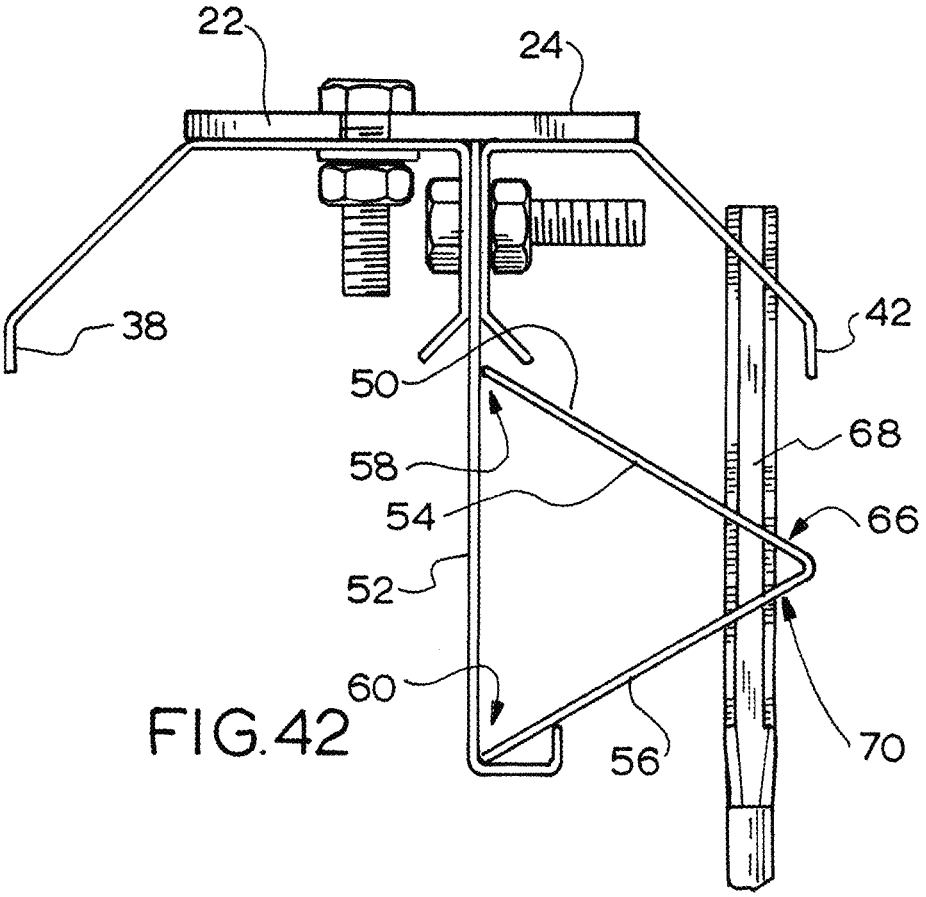
FIG. 42 shows anti skew stake bracket—end view (simple)
Figure 43:
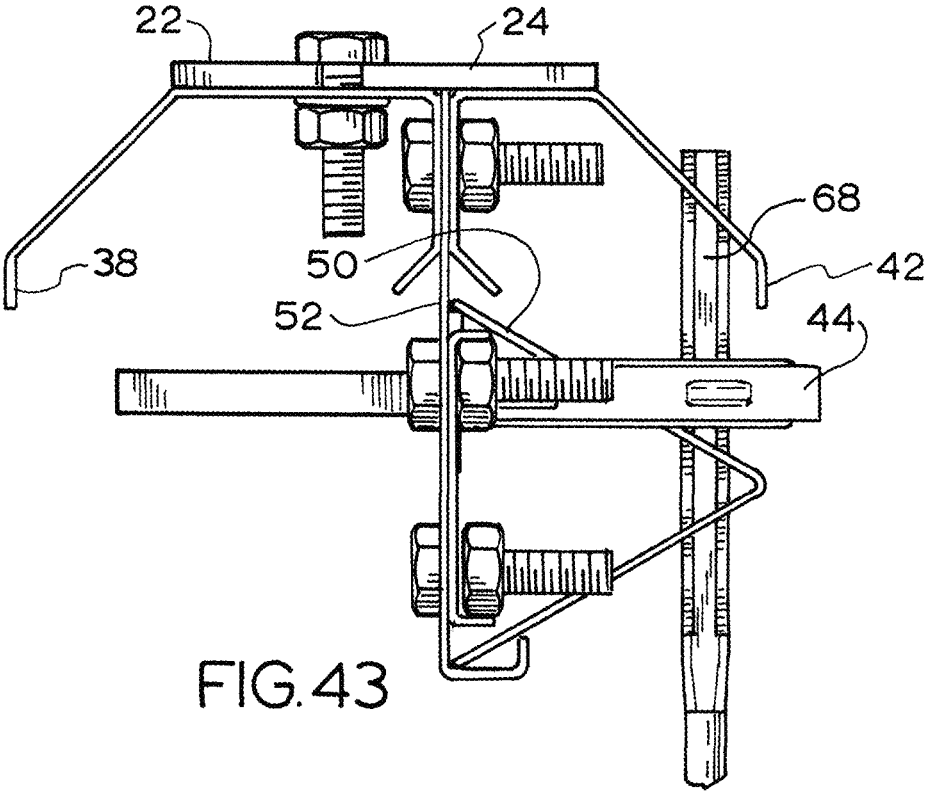
FIG. 43 shows anti skew stake bracket—end view.
Figure 44:
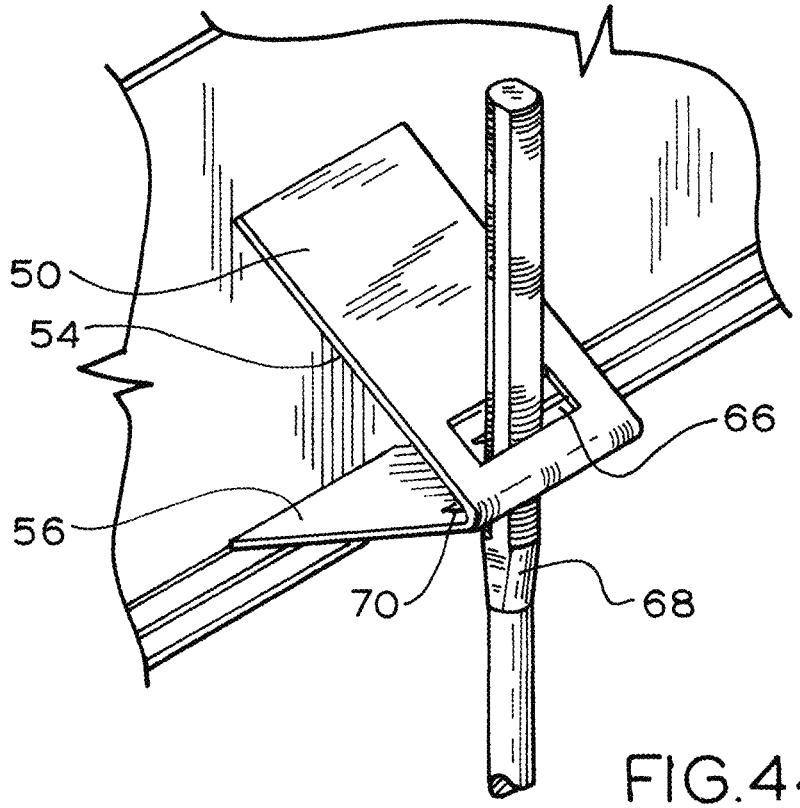
FIG. 44 shows anti skew stake bracket—perspective (locked stake)
Figure 45:
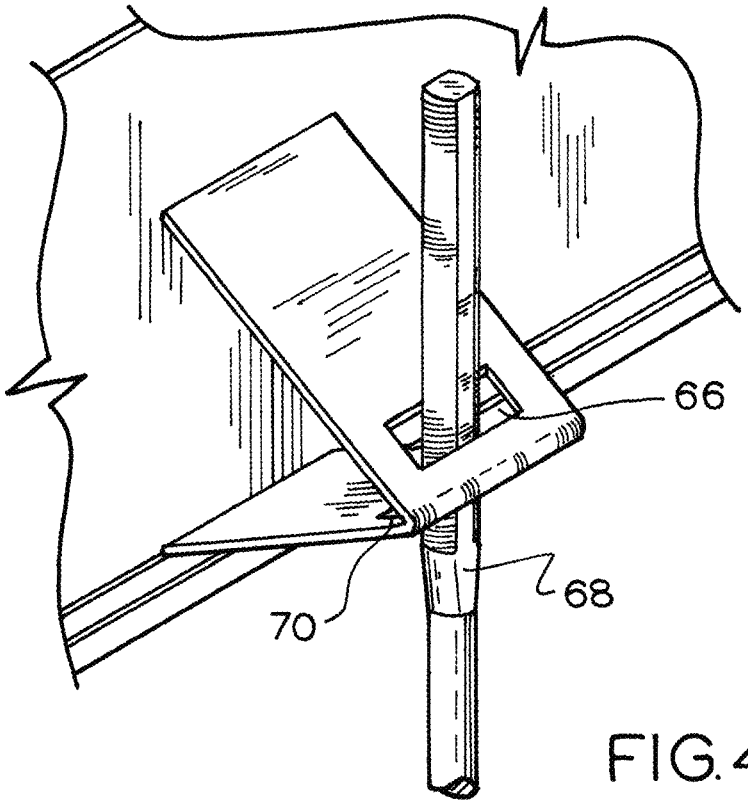
FIG. 45 shows anti skew stake bracket—perspective (loose stake)
Figure 46:
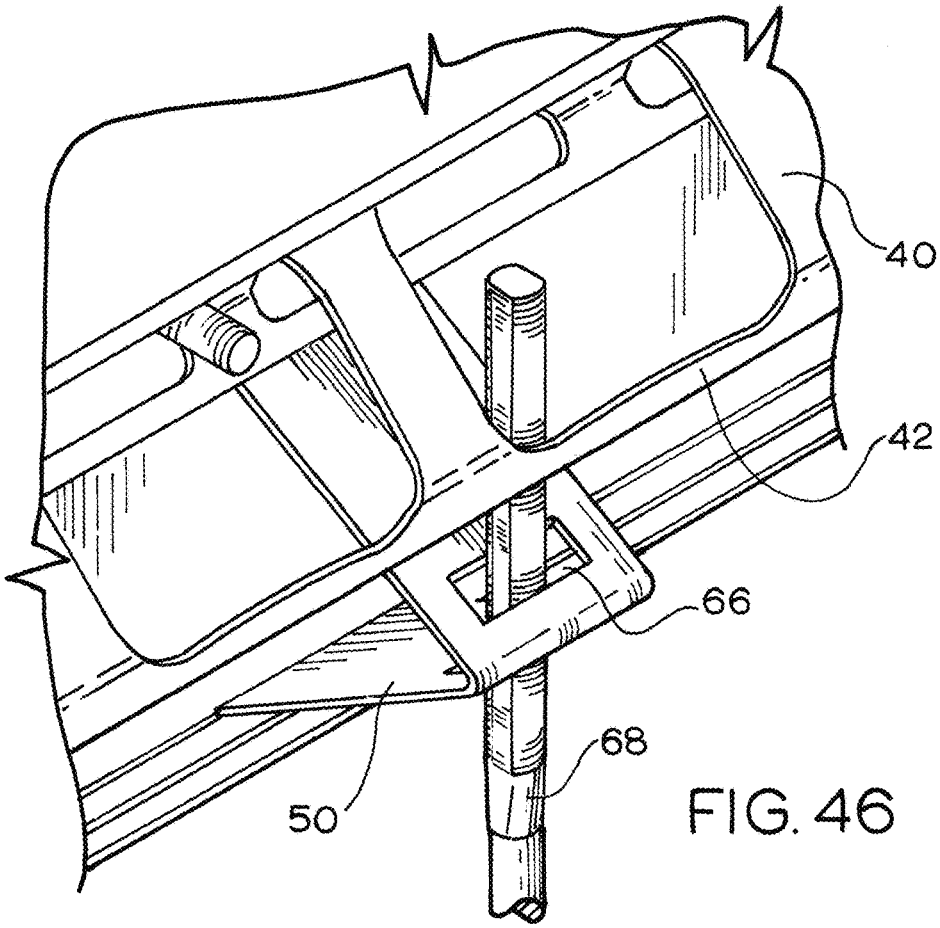
FIG. 46 shows anti skew stake bracket—perspective (simple)
Figure 47:
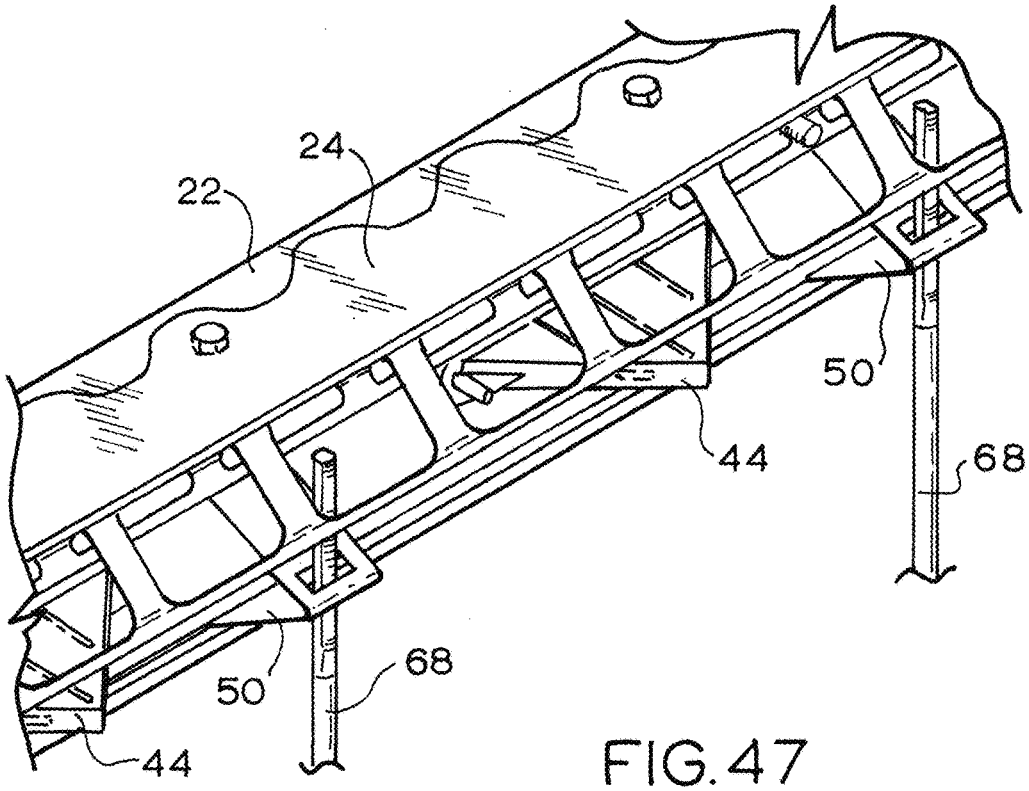
FIG. 47 shows anti skew stake bracket—perspective.
Figure 48:
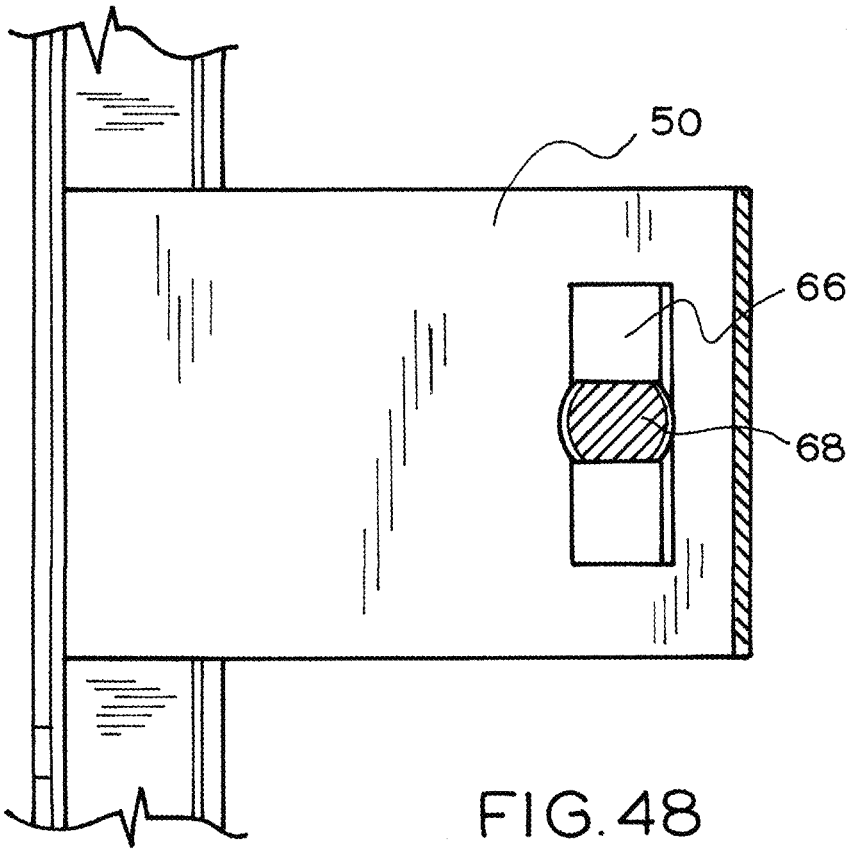
FIG. 48 shows anti skew stake bracket—plan view (locked stake)
Figure 49:
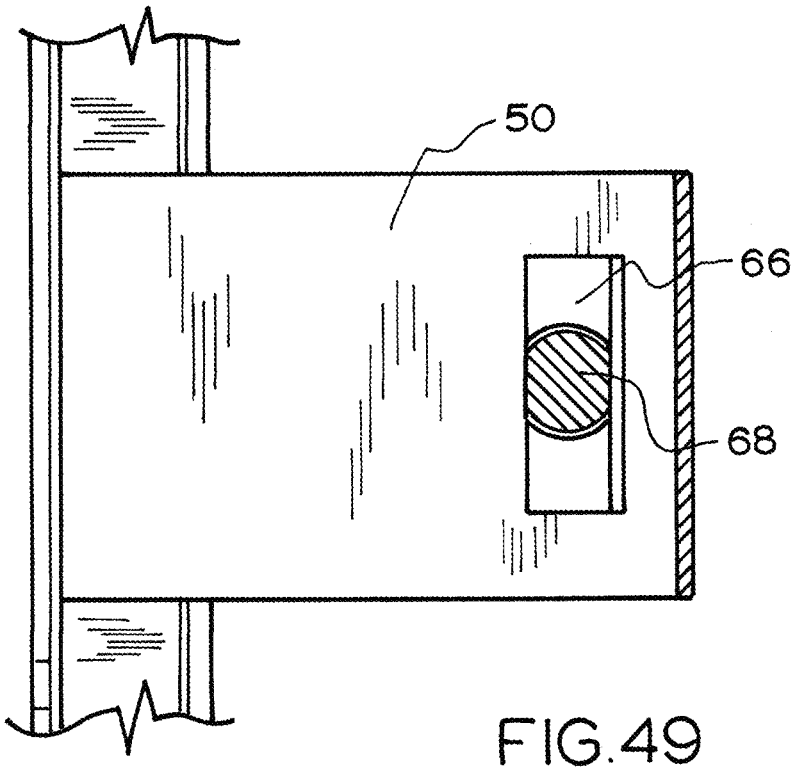
FIG. 49 shows anti skew stake bracket—plan view (loose stake)
Figure 50:
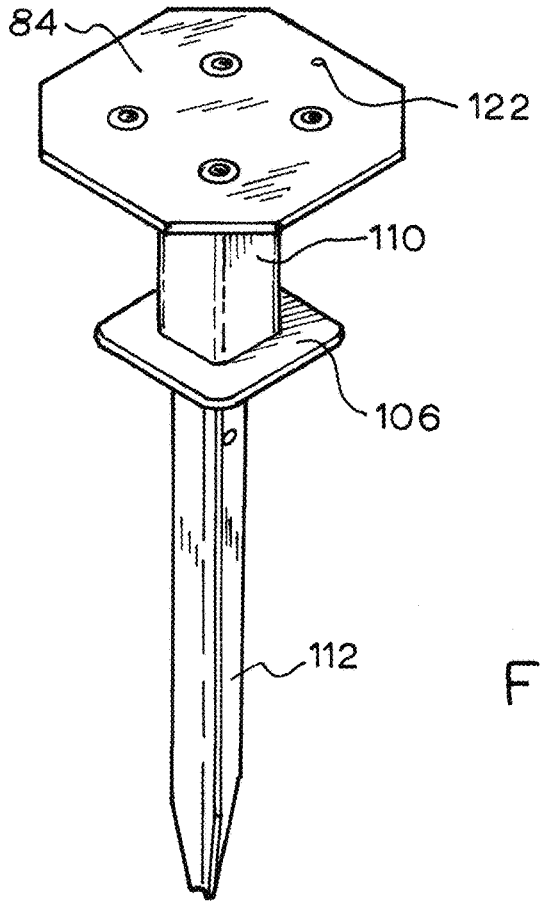
FIG. 50 shows floating cover plate on intersection—perspective (centre column)
Figure 51:
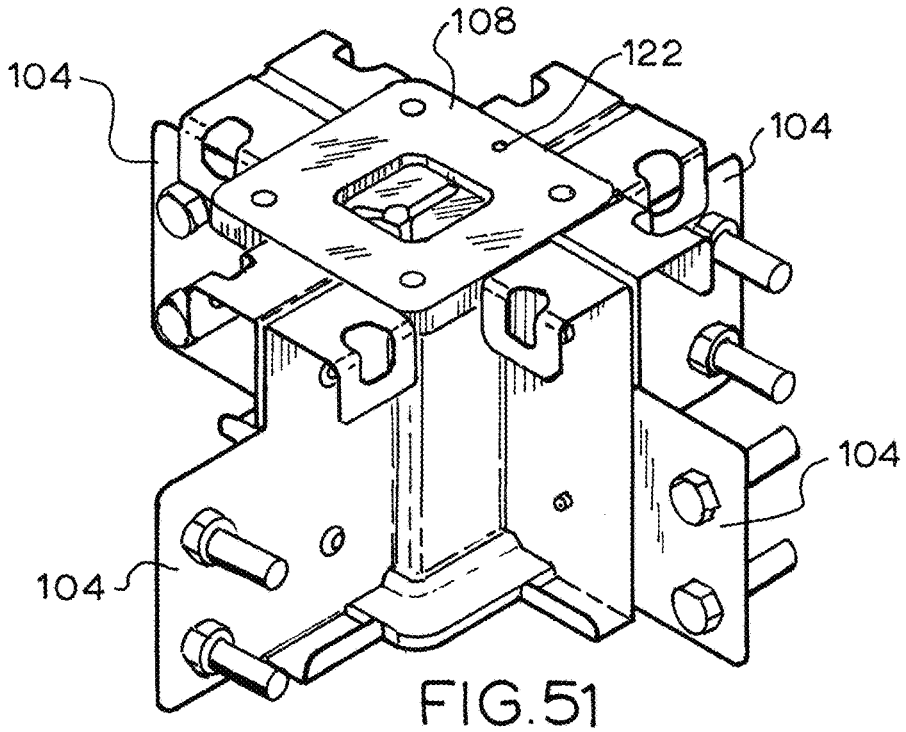
FIG. 51 shows floating cover plate on intersection—perspective (step 1)
Figure 52:
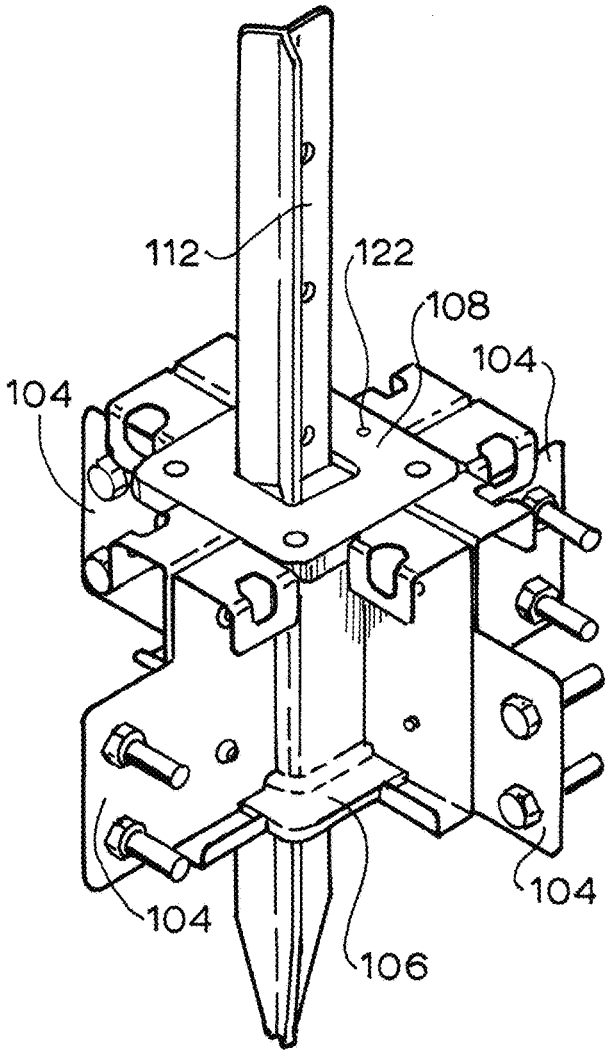
FIG. 52 shows floating cover plate on intersection—perspective (step 2)
Figure 53:
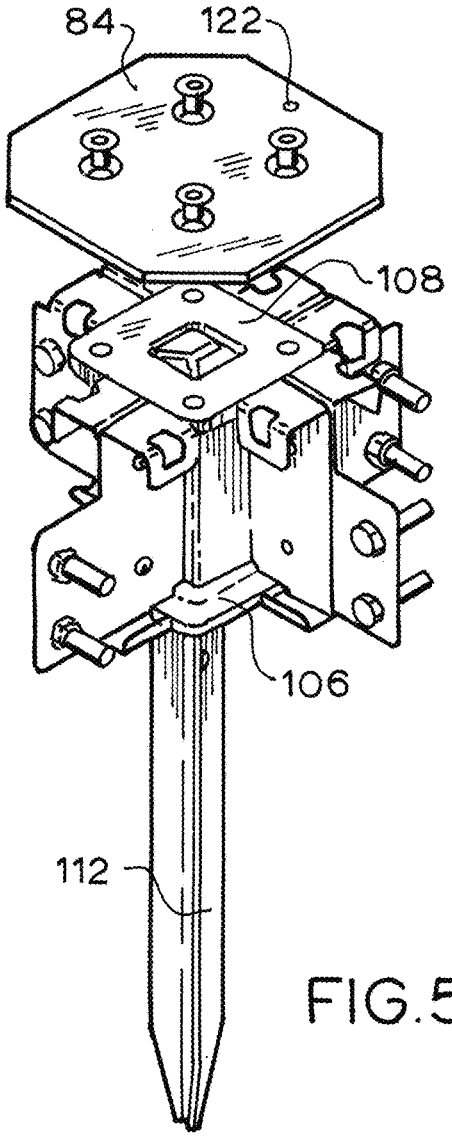
FIG. 53 shows floating cover plate on intersection—perspective (step 3)
Figure 54:
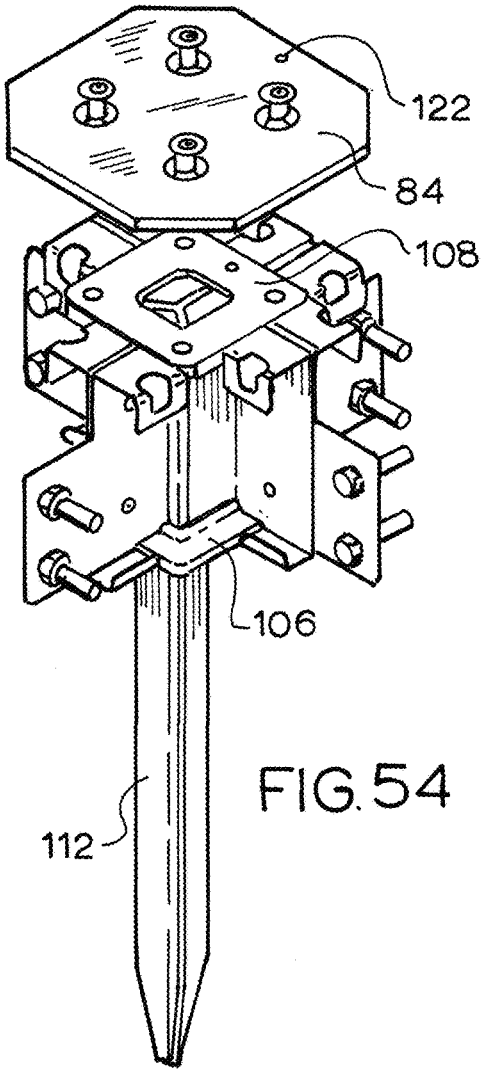
FIG. 54 shows floating cover plate on intersection—perspective (step 4)
Figure 55:
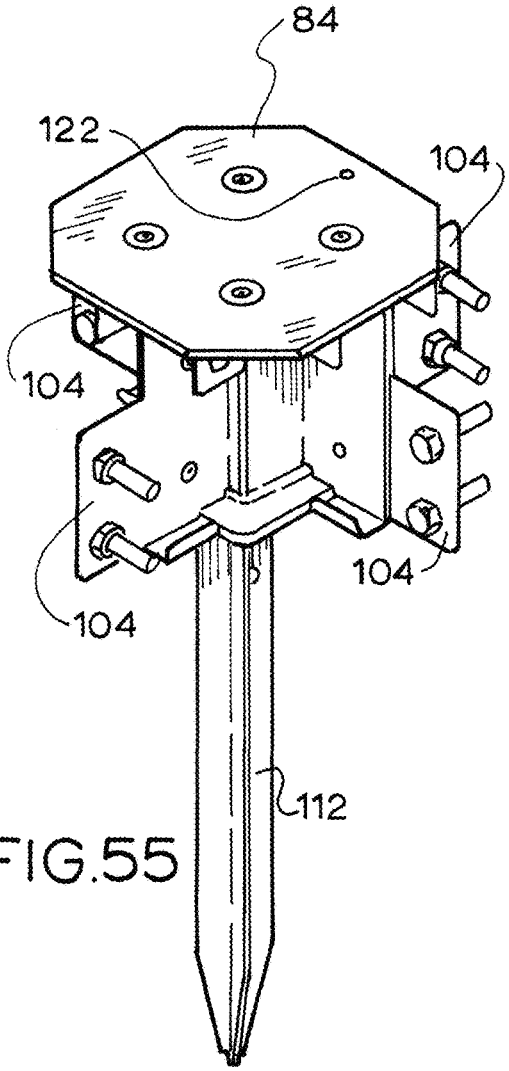
FIG. 55 shows floating cover plate on intersection—perspective (step 5)
Figure 56:
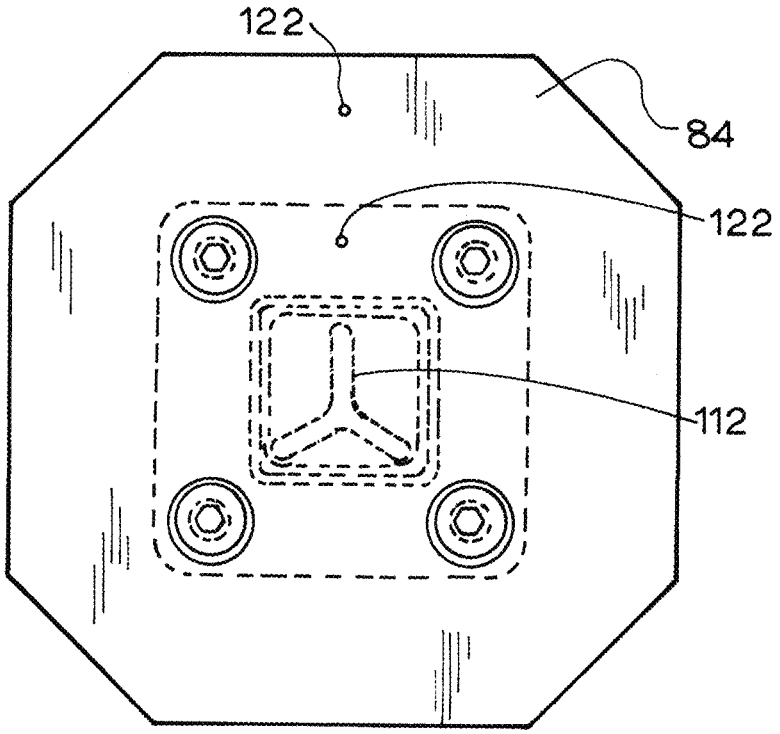
FIG. 56 shows floating cover plate on intersection—plan view (centre column)
Figure 57:
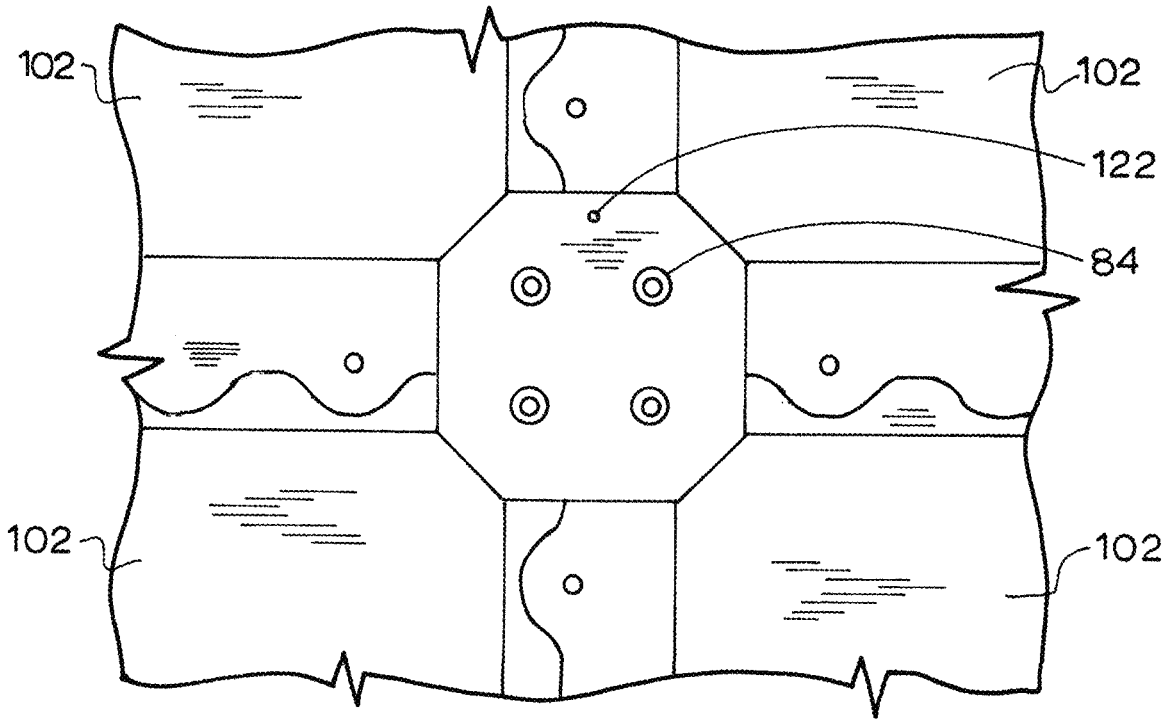
FIG. 57 shows floating cover plate on intersection—plan view (perimeter gap, closed)
Figure 58:
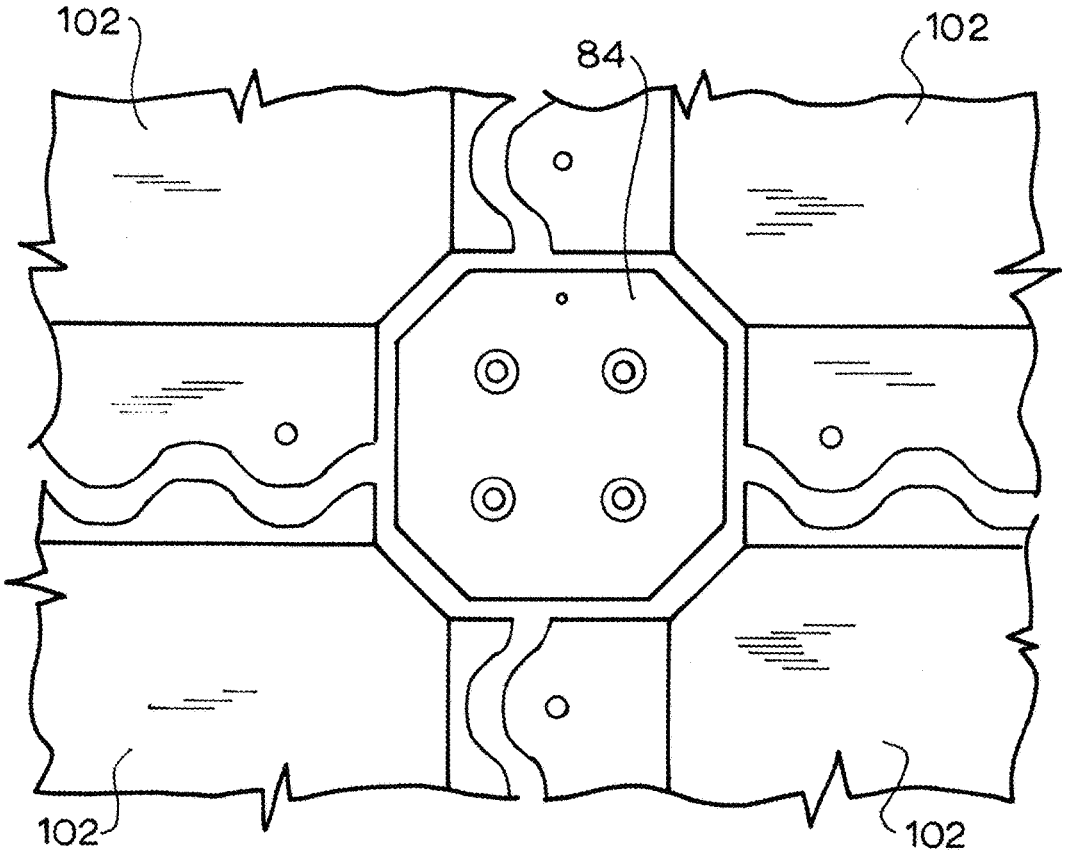
FIG. 58 shows floating cover plate on intersection—plan view (perimeter gap, open)
Figure 59:
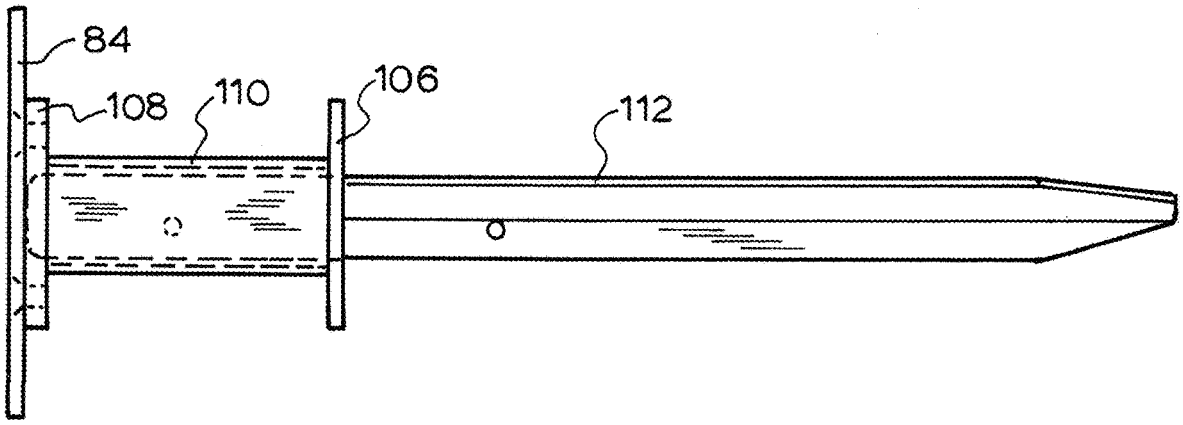
FIG. 59 shows floating cover plate on intersection—side view (centre column with hidden)
Figure 60:
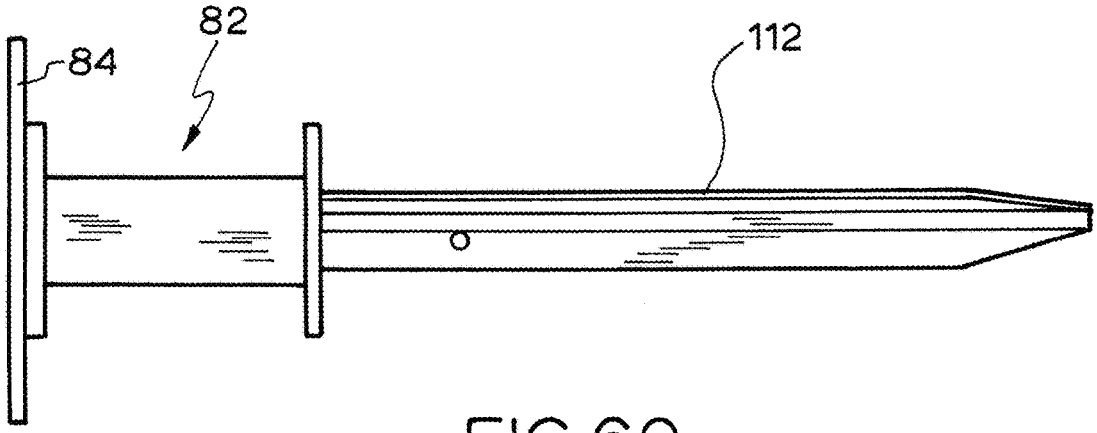
FIG. 60 shows floating cover plate on intersection—side view (centre column)
Figure 61:
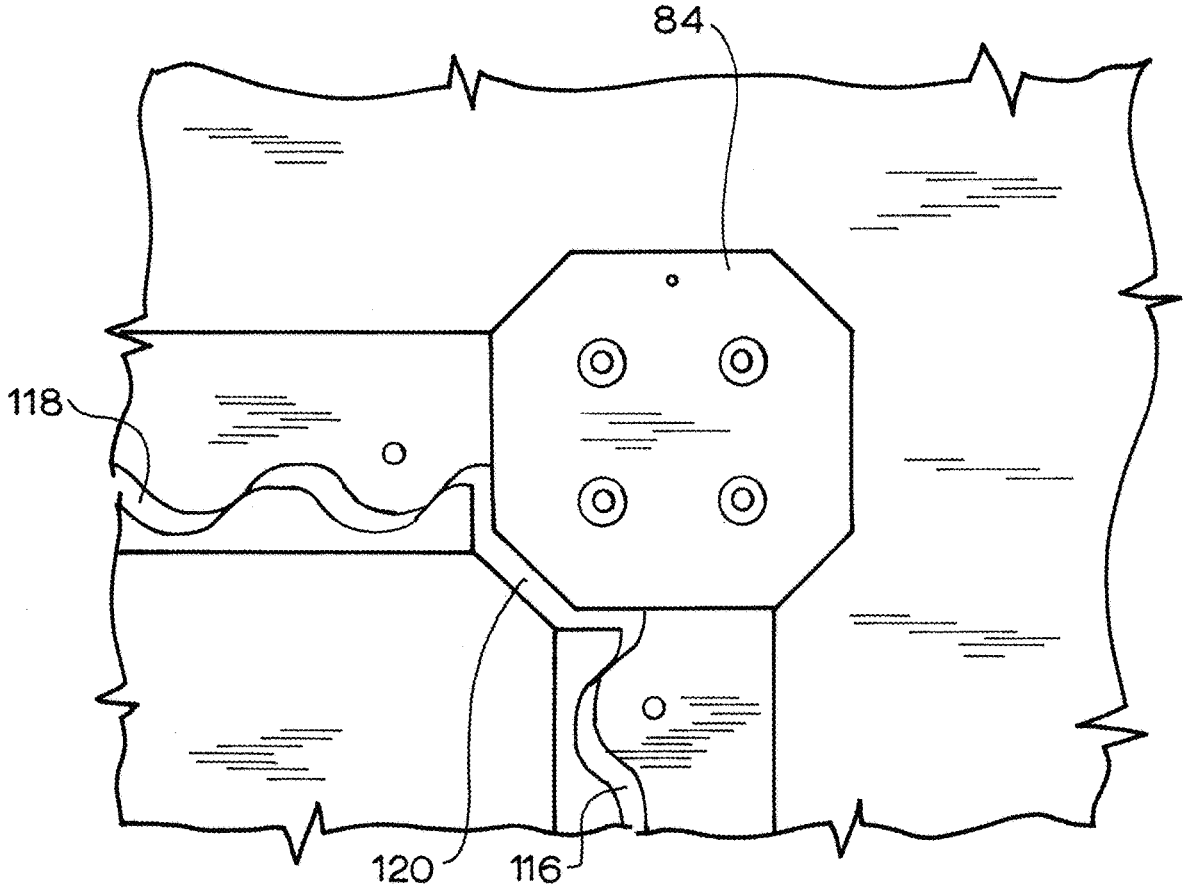
FIG. 61 shows intersection continuous perimeter joint line—plan view (2-way, open)
Figure 62:
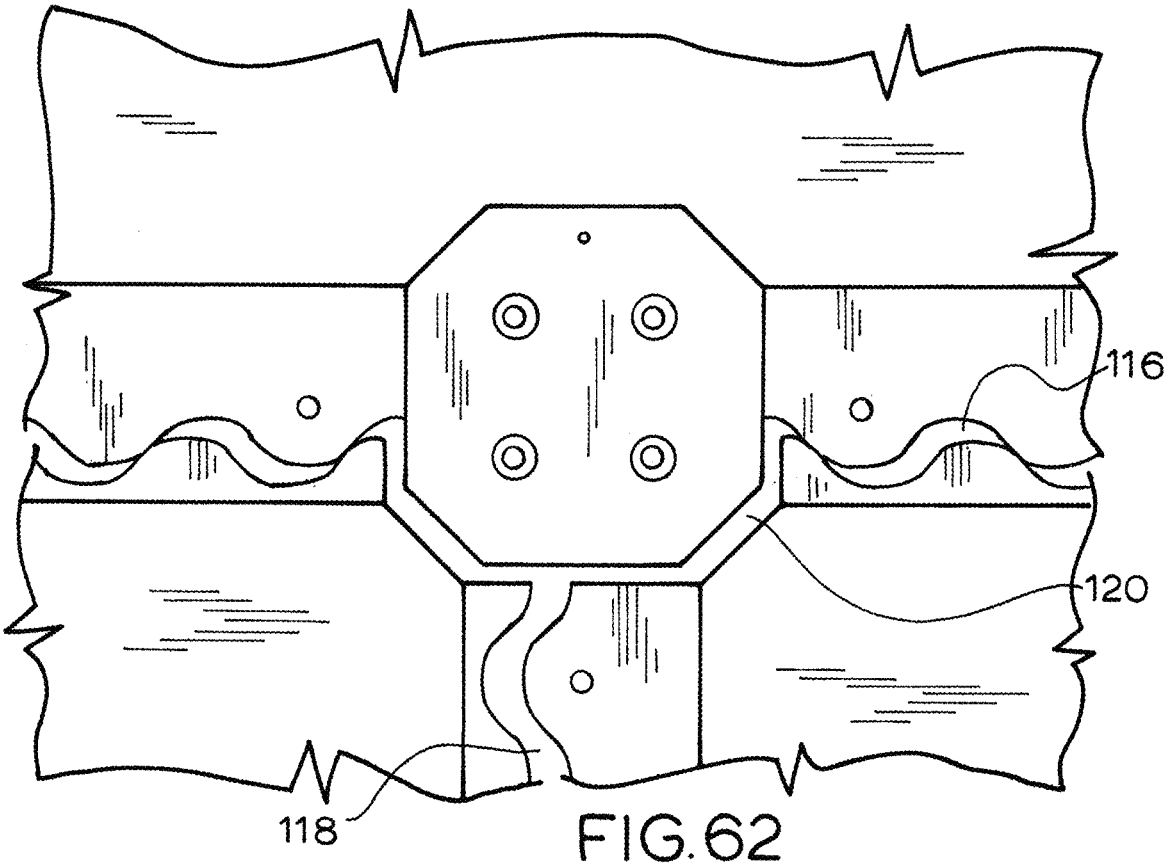
FIG. 62 shows intersection continuous perimeter joint line—plan view (3-way, open)
Figure 63:
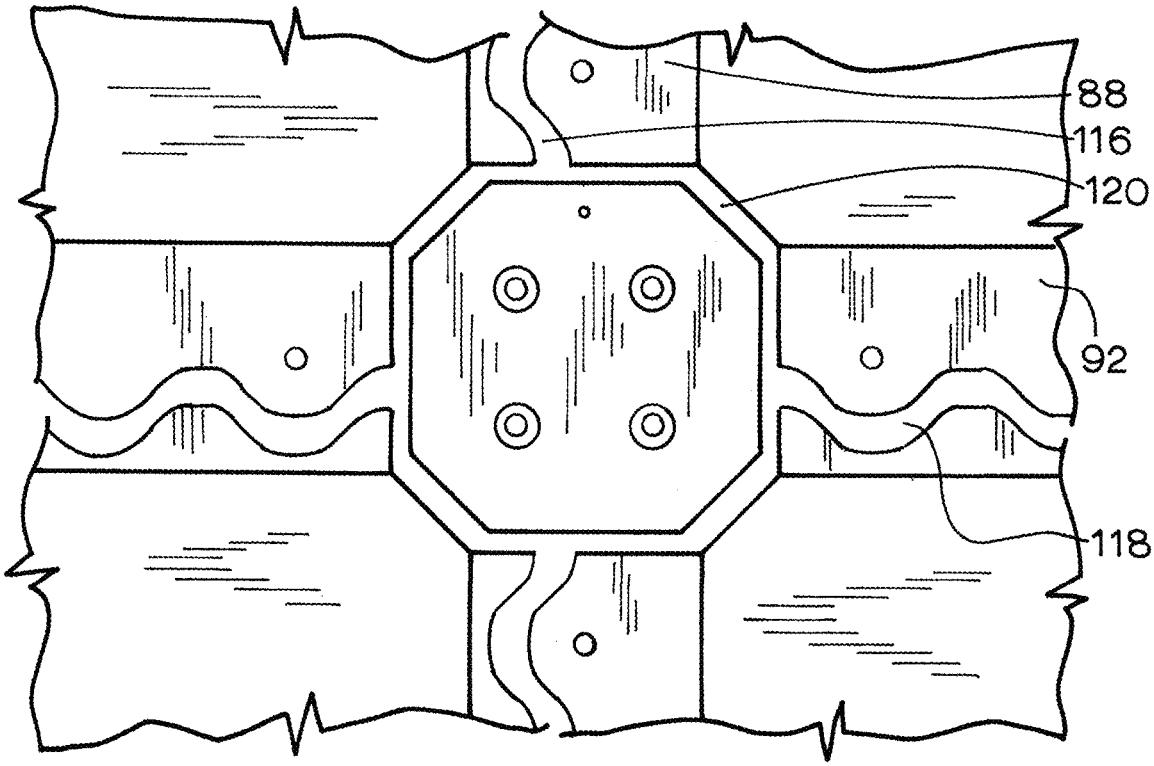
FIG. 63 shows intersection continuous perimeter joint line—plan view (4-way, open)
Figure 64:
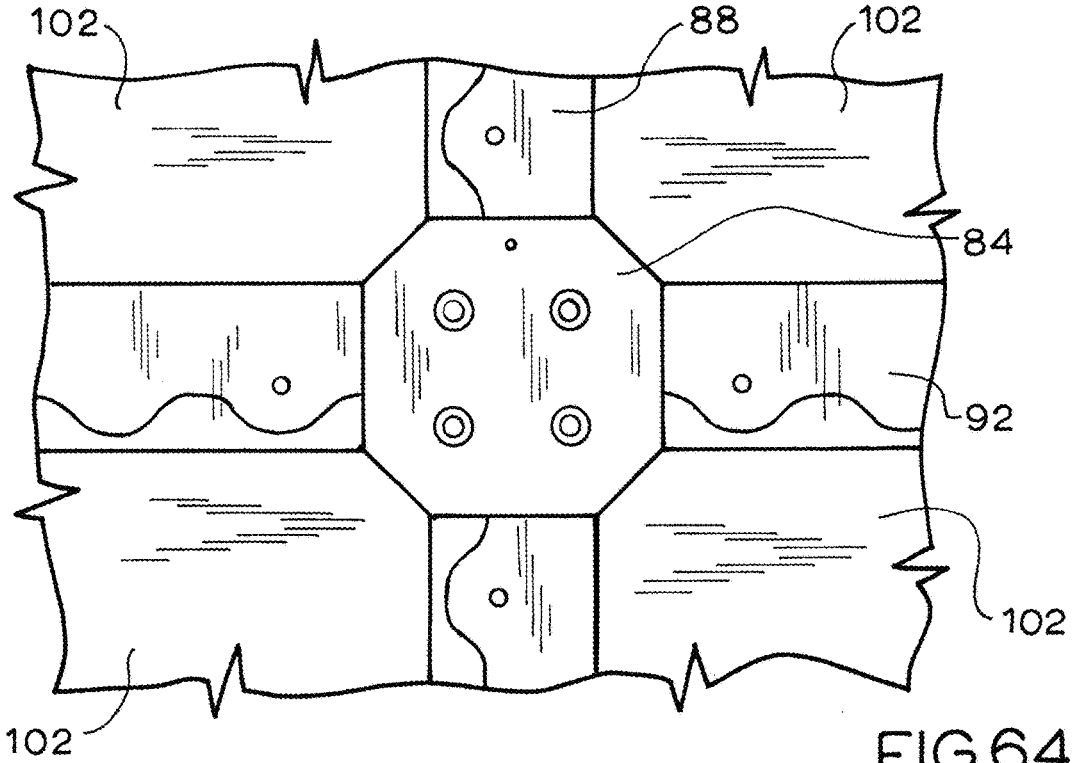
FIG. 64 shows intersection continuous perimeter joint line—plan view (closed)
Figure 65:
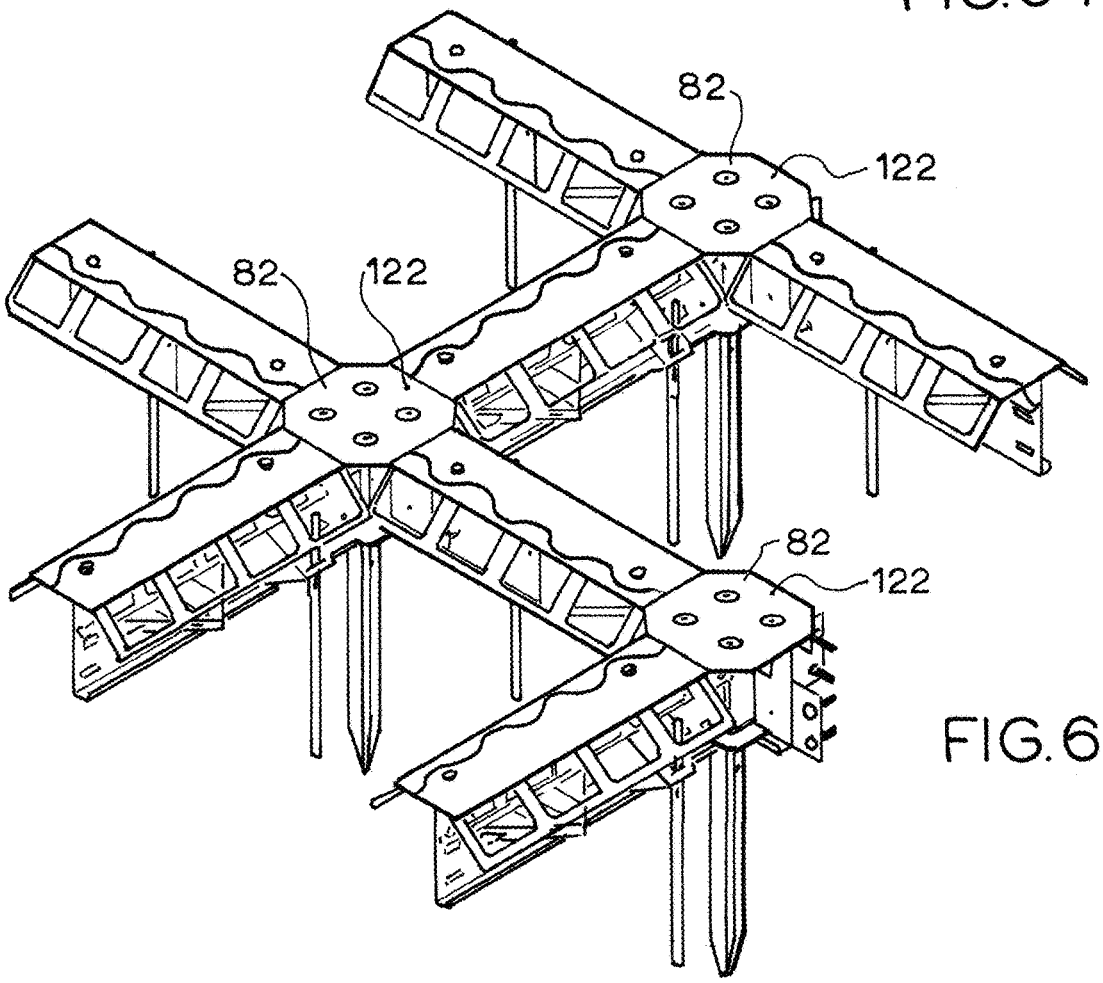
FIG. 65 shows joint orientation marker—perspective (intersection layout)
Figure 66:
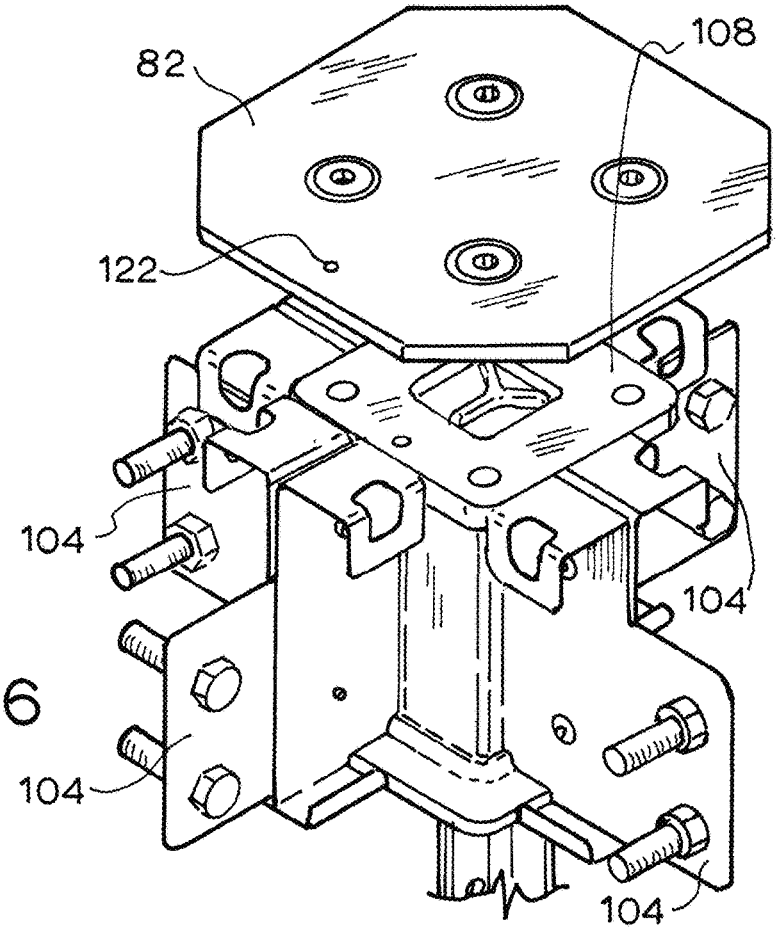
FIG. 66 shows joint orientation marker—perspective (matching holes)
Figure 67:
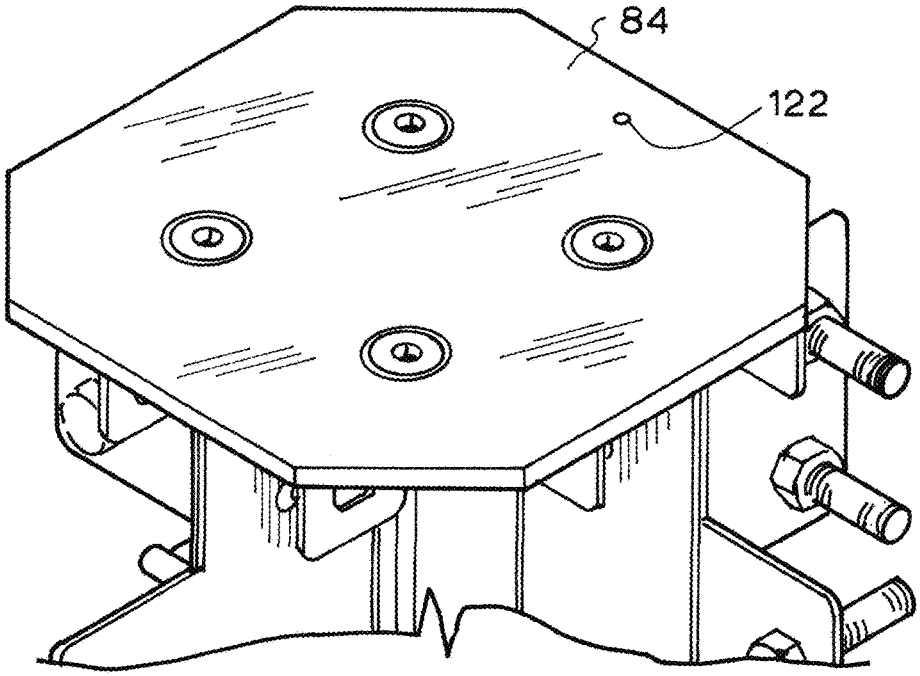
FIG. 67 shows joint orientation marker—perspective.
Figure 68:
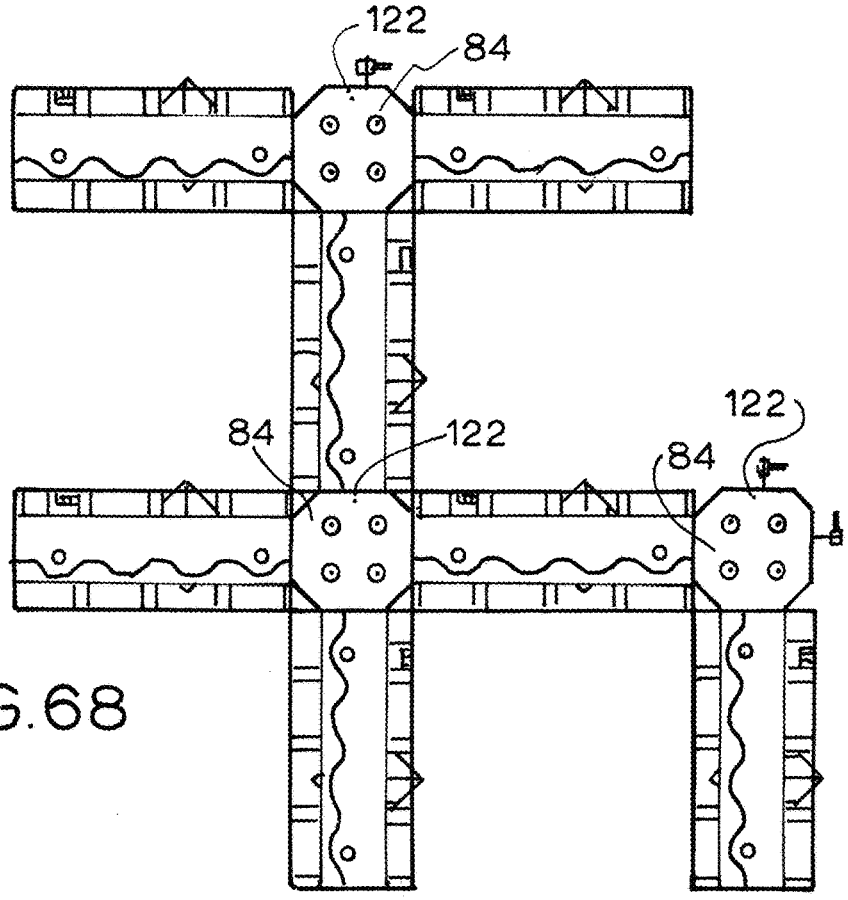
FIG. 68 shows joint orientation marker—plan view (intersection layout)
Figure 69:
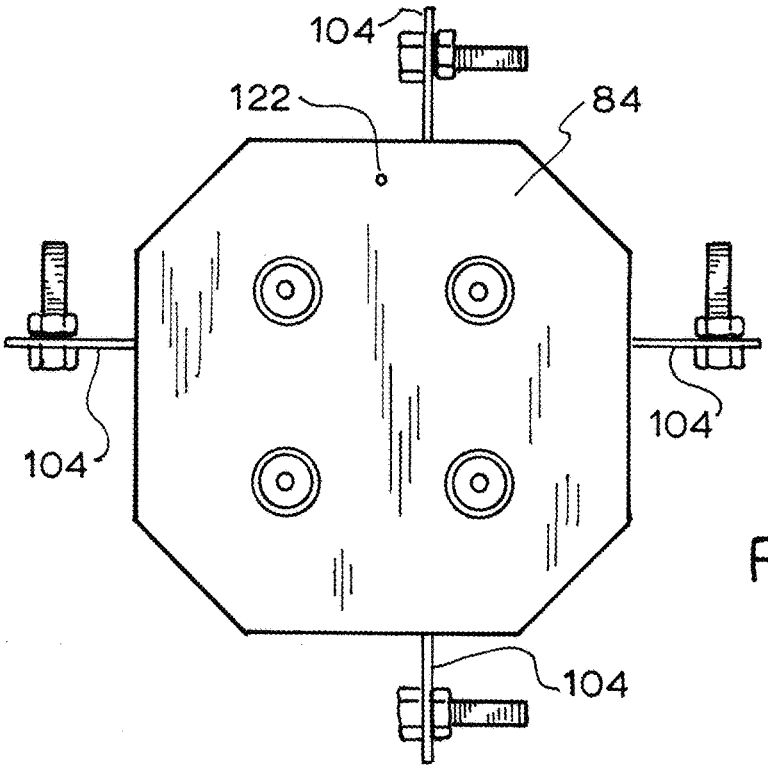
FIG. 69 shows joint orientation marker—plan view.

With reference to FIG. 25, the indicator 122 may be repeated on a plurality of assembly pieces of the intersection module 82 to assist with orientation of star picket guides to a common orientation. In particular, as shown in FIG. 25, the indicator 122 may be repeated on an upper support plate 108 and a lower support plate 106 of a support column 110 of the intersection module 82.

The first expandable armoured joint 74 may have a first joint line 116, and the second expandable armoured joint 78 may have a second joint line 118. The intersection module 82 may provide a perimeter joint line 120 such that there is a continuous joint line including the first joint line 116, the perimeter joint line 120 and the second joint line 118.

Accordingly, as will be appreciated from the above, this aspect relates to:

- A joint orientation marker 122 in the form of a small hole in the top cover plate 84 which acts as a positioning marker to orientate all joints during installation onsite in the same direction, ensuring joint lines match up.
- The small hole is to be positioned in one of four orientations on a first intersection onsite depending upon first pour location. All subsequent intersections for the project are to be place with the respective hole rotationally oriented in the same direction.
- Module nature on intersection allows for 2-way, 3-way and 4-way intersection to be formed without adjusting intersection orientation.
- Hole is repeated on all central top plate assembly pieces to help orientate star picket guides to the same orientation.

Advantageously, the applicant has identified that examples of the present disclosure may serve to prolong the serviceability of the floor (working surface). Forklift wheels are fully supported by the "wave" plate design to a joint width opening of 20 mm. Modular design intersection provides a fast, effective and intuitive set up of two, three and four way intersections, significantly mitigating the risk of restraint that leads to uncontrolled concrete cracking and spelling.

FIG. 70 shows an example of a joint edge protection apparatus 10 having a wave profile for providing a capability for extra lateral movement. More specifically, the wave form of one plate 22 is deliberately mismatched relative to the wave form of the other plate 24 so as to facilitate lateral movement.

In particular, FIG. 70 shows a joint edge protection apparatus 10 for protecting an edge of a first component formed of settable material and an edge of a second component formed of settable material at a joint. The apparatus 10 includes a first anchorage part for anchoring within the first component and a second anchorage part for anchoring within the second component, the first anchorage part being provided with a first plate 22. The second anchorage part is provided with a second plate 24. The first plate 22 defines a first interface surface 26 and the second plate 24 defines a second interface surface 28. The first interface surface 26 and the second interface surface 28 are shaped to facilitate abutment of at least a portion of the second interface surface 28 against the first interface surface 26. The second anchorage part is adapted to be movable relative to the first anchorage part from an abutting configuration in which at least a portion of the second interface surface 28 is in abutment with the first interface surface 26, to a spaced configuration in which the second interface surface 28 is spaced relative to the first interface surface 26. The first interface surface 26 and the second interface surface 28 are each shaped with a wave shape, wherein the wave shape of the first interface surface 26 is mismatched to the wave shape of the second interface surface 28 to facilitate periodic abutment of the second interface surface 28 against the first interface surface 26 in the abutting configuration. In other words, the wave shapes are mismatched so as to ensure gaps between the points/regions of periodic abutment.

Figure 70C:
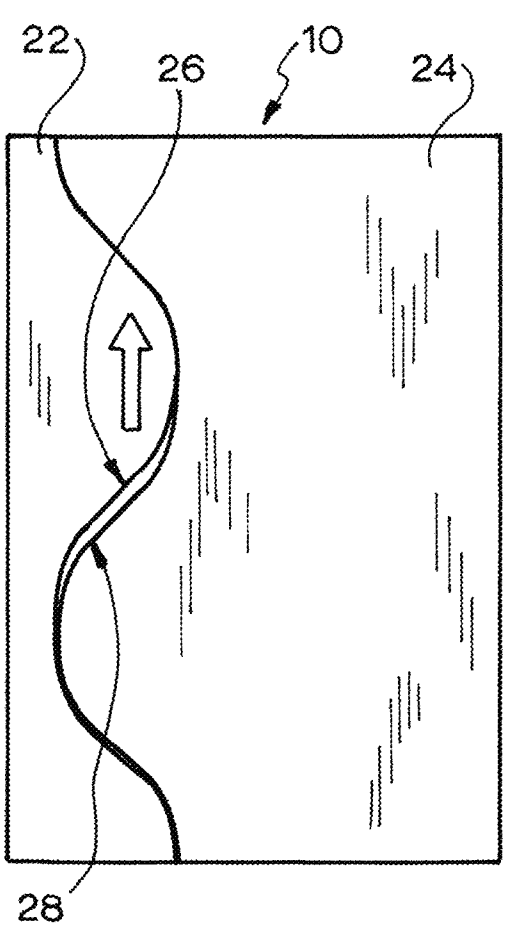
FIGS. 70*a* to 70*c* show an example of a joint edge protection apparatus having deliberately mismatched waves to facilitate lateral movement.
Figure 70B:
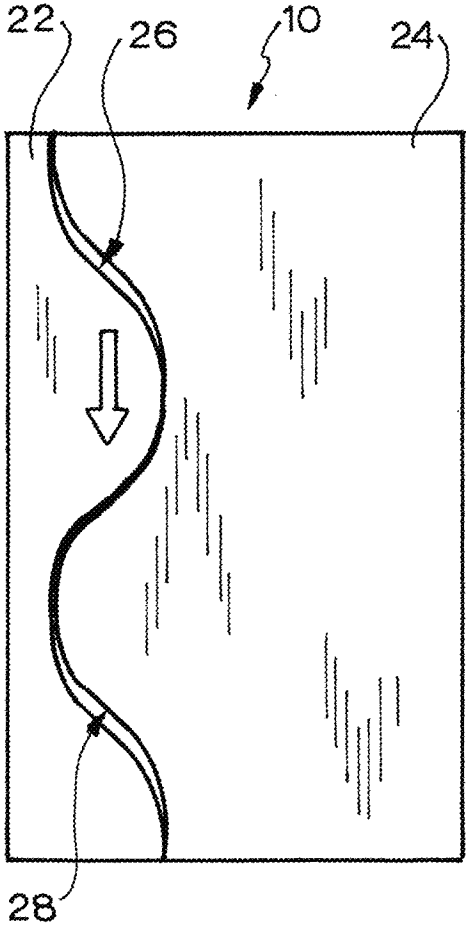
Figure 70A:
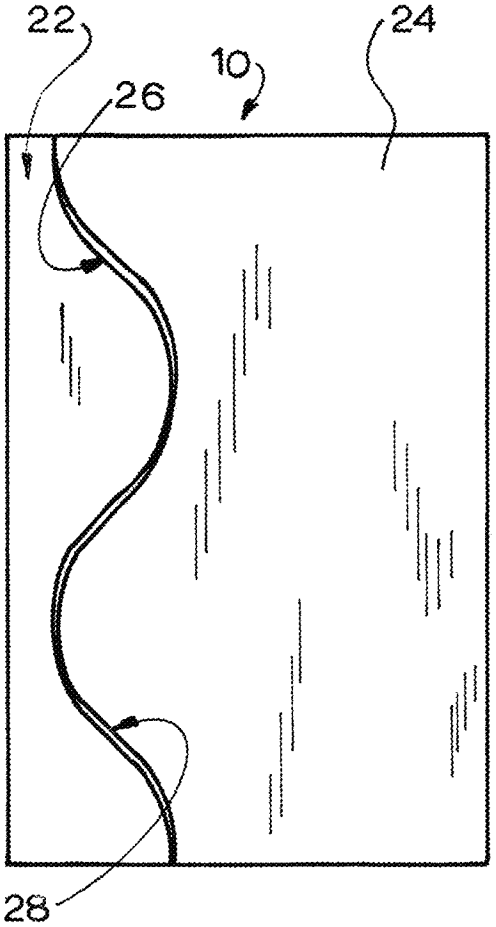

As can be seen in FIGS. 70*a*, 70*b* and 70*c*, each of these representations shows the joint edge protection apparatus 10 in the abutting configuration. FIG. 70*a* shows a default position in which the first plate 22 and the second plate 24 are laterally aligned such that points or regions of contact/abutment are at each peak and trough of the wave forms. The mismatching of the waveforms ensures in this default position that, between each peak and trough there is a gap between the first interface surface 26 and the second interface surface 28. FIG. 70*b* shows a configuration in which the first plate 22 is moved 2 mm downwardly relative to the second plate 24 in an arrangement in which slopes of the waveforms come together in a nested arrangement to form an S-shaped portion of abutment which extends from a peak of the wave form of the first interface surface 26 to a trough of the wave form of the first interface surface 26. Similarly, FIG. 70*c* shows a configuration in which the first plate 22 is moved 2 mm upwardly relative to the second plate 24 in an arrangement in which the slopes of the waveforms come together in a nested arrangement to form an S-shaped portion of abutment which extends from a peak of the waveform of the first interface surface 26 to a trough of the waveform of the first interface surface 26.

As will be appreciated, in each of the configurations shown in FIGS. 70*a*, 70*b* and 70*c*, there is periodic abutment in the abutting configuration in contrast to the arrangement shown in FIG. 22 in which the waveforms are matched such that the abutment there is continuous.

Returning to FIGS. 70*a* to 70*c*, advantageously, the joint top plates 22, 24 have a mismatched full length waved tooth profile to provide low impact joint transition while giving extra lateral movement accommodation during slab curing. An additional gap has been allowed either side of the teeth to allow lateral movement at 0 mm joint gap if required of up to 2 mm (in either direction). This additional gap is shown in FIG. 70*a* and is due to the mismatching of the wave forms. The teeth have tapered (45°) sides to provide 1:1 lateral movement versus joint opening, the additional 2 mm gap providing extra allowance for high shrinkage parts of the slab (corners) and rectangular slabs.

As shown in FIGS. 71*a* to 71*d*, the first plate 22 and second plate 24 may also be provided with predefined gaps 124 of 4 mm between the plates 22, 24 at joining lengths to allow joint lateral movement within binding during slab shrinkage. The arrangement shown provides adjustment capability when connecting joints while maintaining a minimum 2 mm predefined gap.

Figure 71D:
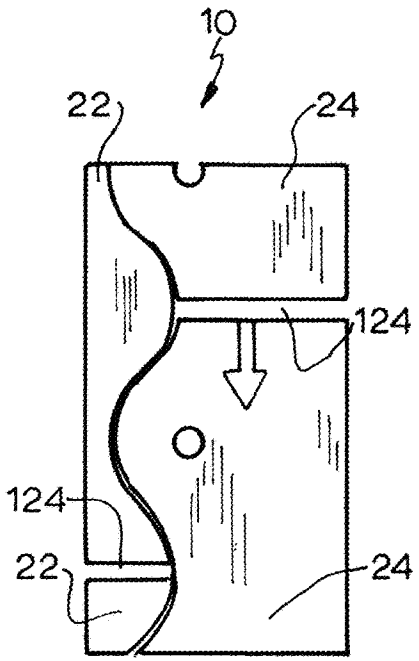
FIGS. 71*a* to 71*d* show another example of a joint edge protection apparatus having deliberately mismatched waves as well as predefined gaps to facilitate lateral movement.
Figure 71C:
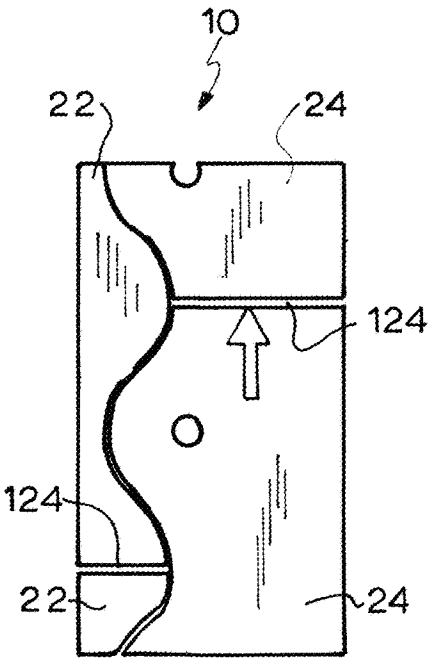
Figure 71B:
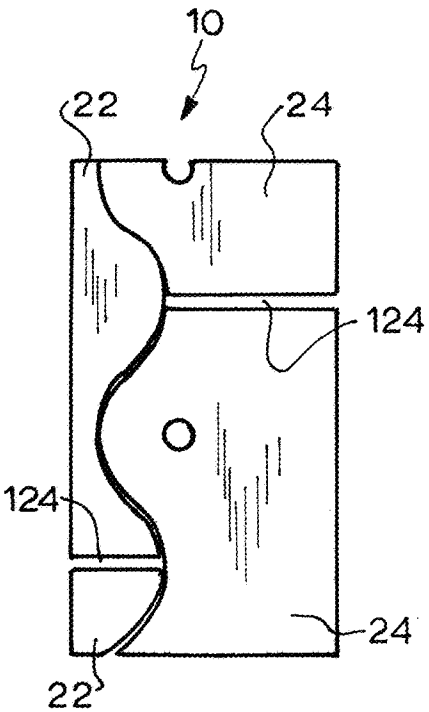
Figure 71A:
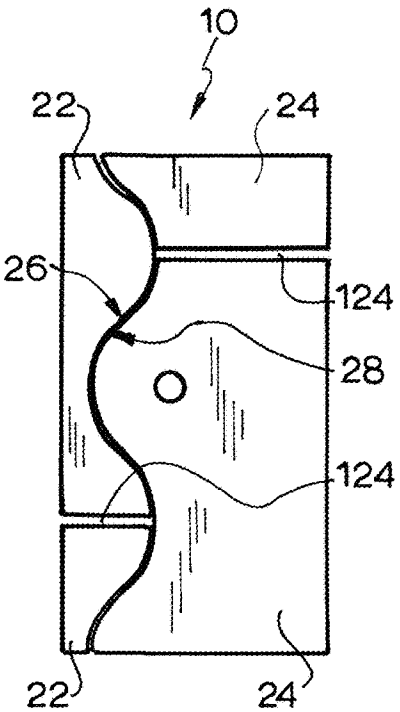

Accordingly, FIGS. 71*a* to 71*d* show another example of a joint edge protection apparatus 10 having deliberately mismatched waves as well as predefined gaps 124 to facilitate lateral movement. FIG. 71*a* shows the first plate 22 and the second plate 24 in a default position with a predefined gap 124 of 4 mm in place. FIG. 71*b* shows the first plate 22 moved upwardly relative to the second plate 24, with the predefined gaps 124 of 4 mm still in place. FIG. 71*c* shows the predefined gap 124 reduced to accommodate upward movement of one second plate 24 relative to the first plate 22 as well as relative to an adjacent second plate 24. FIG. 71*d* shows a predefined gap 124 increased to accommodate downward movement of one second plate 24 relative to the first plate 22 as well as relative to an adjacent second plate 24.

The described construction has been advanced merely by way of example and many modifications and variations may be made without departing from the spirit and scope of the present disclosure, which includes every novel feature and combination of features herein disclosed. In particular, the applicant has determined that other modifications may include one or more of the following:

- cutting of bottom sheet metal anchor above dowel plates and sleeves to allow better concrete compaction around dowels;
- added twist and lock stake receptacles on an opposite side of the joint to stake brackets to allow joint levelling during setup without welding;
- removed section of separation plate at top section at an offset end. This can be arranged to allow direct connection between top section pieces to prevent stepping of joint lengths;
- changing all clamping bolt nuts to wing nuts to aid in removal after pouring (if required);
- increased adjustment capability to offset clamping bolt by way of increased bolthole size;
- plug weld location under top plate change slots for fillet welds; and
- assembly bolthole (4 places) increase from 10.5 mm diameter to 11 mm diameter.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge.

LIST OF REFERENCE NUMERALS

10 joint edge protection apparatus
12 first component
14 second component
16 joint
18 first anchorage part
20 second anchorage part
22 first plate
24 second plate
26 first abutment surface
28 second abutment surface
30 support surface
32 gap
34 well
36 joint material
38 first lacer bar
40 spaced ribs
42 second lacer bar

44 dowel
46 apex
48 tapered foot
50 bracket
52 support section
54 upper leg
56 lower leg
58 first angle
60 second angle
62 distal end of the upper leg
64 distal end of the lower leg
66 aperture in upper leg
68 stake
70 aperture in lower leg
72 edge protection system
74 first expandable armoured joint
76 first joint
78 second expandable armoured joint
80 second joint
82 intersection module
84 cover plate
86 intersection
88 first pair of plates
90 first crevice
92 second pair of plates
94 second crevice
96 wavy edge
98 anchored support
100 upper support
102 concrete slab sections
104 anchorage part
106 central lower shoulder
108 central upper shoulder
110 central support column
112 stake
114 intersection continuous perimeter joint line
116 first joint line
118 second joint line
120 perimeter joint line
122 joint orientation marker
124 predefined gap

The invention claimed is:

1. An armoured joint for protecting an edge of a first component formed of settable material and an edge of a second component formed of settable material at a joint, the armoured joint comprising:

a first plate including a bottom surface and a first abutment surface;

a first anchorage part configured to be anchored within the first component, the first anchorage part including a first elongated angled anchorage lacer bar, the first elongated angled anchorage lacer bar being supported by a series of spaced first ribs and a first rail being tilted out of a first plane of the first ribs such that the first rail extends vertically downward relative to the bottom surface of the first plate, wherein the first plate is coupled to the first anchorage part;

a second anchorage part configured to be anchored within the second component; and a second plate coupled to the second anchorage part, the second plate including a second abutment surface, wherein the first abutment surface and the second abutment surface are shaped to facilitate abutment of a portion of the second abutment surface against the first abutment surface, and wherein the second anchorage part is movable relative to the first anchorage part from an abutting configuration in which the portion of the second abutment surface is in abutment with the first abutment surface to a spaced configuration in which the second abutment surface is spaced relative to the first abutment surface.

2. The armoured joint of claim 1, wherein the first elongated angled anchorage lacer bar is substantially perpendicular to the first plate.

3. The armoured joint of claim 1, wherein the second anchorage part has a second elongated angled anchorage lacer bar, the second elongated angled anchorage lacer bar being supported by a series of spaced second ribs and a second rail being tilted out of a second plane of the second ribs.

4. The armoured joint of claim 1, wherein the armoured joint includes at least one dowel configured to maintain a level of the second anchorage part relative to the first anchorage part.

5. The armoured joint of claim 1, wherein the first elongated angled anchorage lacer bar varies in width between at least two of the series of the first ribs.

6. The armoured joint of claim 1, wherein each of the spaced first ribs has a tapered foot that tapers outwardly into the first elongated anchorage angled lacer bar.

7. The armoured joint of claim 6, wherein each tapered foot progressively tapers outwardly into the first elongated angled anchorage lacer bar.

8. The armoured joint of claim 6, wherein each first rib is bent at the tapered foot such that the first elongated angled anchorage lacer bar is tilted out of the first plane of the first ribs.

9. The armoured joint of claim 1, wherein each of the first ribs is angled at an acute angle relative to the first plate, and the first elongated angled anchorage lacer bar is tilted to be substantially perpendicular to the first plate.

10. The armoured joint of claim 1, wherein, between each pair of successive first ribs, an upper edge of the first elongated angled anchorage lacer bar is tapered progressively outwardly then progressively inwardly.

11. The armoured joint of claim 1, wherein, between each pair of successive first ribs, an upper edge of the first elongated angled anchorage lacer bar has a generally wave-like form.

12. The armoured joint of claim 11, wherein, between each pair of successive first ribs, the upper edge of the first elongated angled anchorage lacer bar has a single wave form.

13. The armoured joint of claim 1, wherein the first elongated angled anchorage lacer bar is in the form of a part of sheet metal.

14. The armoured joint of claim 1, wherein the first anchorage part includes a support surface extending substantially parallel to the second plate and configured to support the second plate.

* * * * *